US007864013B2

(12) United States Patent
Muelleman

(10) Patent No.: US 7,864,013 B2
(45) Date of Patent: Jan. 4, 2011

(54) DEVICES AND METHODS FOR REDISTRIBUTING MAGNETIC FLUX DENSITY

(75) Inventor: Norman Muelleman, Cary, IL (US)

(73) Assignee: Double Density Magnetics Inc., Cary, IL (US)

( * ) Notice: Subject to any disclaimer, the term of this patent is extended or adjusted under 35 U.S.C. 154(b) by 778 days.

(21) Appl. No.: 11/486,318

(22) Filed: Jul. 13, 2006

(65) Prior Publication Data

US 2008/0012680 A1 Jan. 17, 2008

(51) Int. Cl.
*H01F 17/06* (2006.01)

(52) U.S. Cl. ..... 336/178

(58) Field of Classification Search ..... 336/212, 336/221, 213, 178; 323/358–359, 362; 324/126–127, 324/117 R, 117 H, 207.16, 16, 207
See application file for complete search history.

(56) References Cited

U.S. PATENT DOCUMENTS

| | | | | |
|---|---|---|---|---|
| 2,284,406 A | * | 5/1942 | D'Entremont | 336/73 |
| 2,866,955 A | | 12/1958 | Mees et al. | |
| 3,174,116 A | | 3/1965 | Sur | |
| 3,208,014 A | | 9/1965 | Stimler | |
| 3,317,863 A | | 5/1967 | Ngo | |
| 3,399,361 A | | 8/1968 | Belson | |
| 3,413,575 A | | 11/1968 | Campbell | |
| 3,497,848 A | | 2/1970 | Corrigall | |

(Continued)

FOREIGN PATENT DOCUMENTS

GB 937843 9/1963

(Continued)

OTHER PUBLICATIONS

Vincent Molcrette, Jean-Luc Kotny, Jean-Paul Swan, and Jean-François Brudny, "Reduction of Inrush Current in Single-Phase Transformer Using Virtual Air Gap Technique," IEEE Transactions on Magnetics, vol. 34, No. 4, Jul. 1998, pp. 1192-1194.

(Continued)

*Primary Examiner*—Tuyen Nguyen
(74) *Attorney, Agent, or Firm*—Wayne Tang; Nixon Peabody L.L.P.

(57) ABSTRACT

Redistributing magnetic flux density within electro-magnetic or permanent magnet devices, as described herein, causes the device to increase its utilization of its magnetic core material and thereby increase its power density (Watts/volume). The preferred embodiment uses magnetic core bias currents, synchronized to the device's magnetizing current, through uniform, longitudinally isolated, magnetic core sections. The preferred embodiment can be complemented with local core bias currents that generate magnetic flux that oppose the incident magnetizing flux in local magnetic core sections with high flux density concentrations such as core corners. An alternative embodiment longitudinally interlaces magnetically isolated core sections of equal magnetic path length and uniform areal cross section. Another alternative embodiment redirects the magnetic flux in spiral wound inductors and transformers to the circumferential direction used in toroids. All magnetic core shapes, materials, and sizes can be modified to accommodate bias currents; however, the tape wound toroidal core featured mostly in transformers and inductors, is the easiest core to modify. Examples of the types of electromagnetic and permanent magnet devices that benefit from the appropriate application of magnetic flux density redistribution include electrical devices such as transformers, inductors, delay lines, and electromechanical devices such as motors, generators, relays, solenoids, and rail guns.

43 Claims, 27 Drawing Sheets

U.S. PATENT DOCUMENTS

| | | | | |
|---|---|---|---|---|
| 3,573,666 | A | 4/1971 | Caffrey et al. | |
| 3,611,032 | A | 10/1971 | Skillicom | |
| 3,638,155 | A | 1/1972 | Combs | |
| 3,747,038 | A | 7/1973 | McGill | |
| 4,002,999 | A * | 1/1977 | Hesler et al. | 331/113 A |
| 4,004,251 | A * | 1/1977 | Hesler et al. | 331/113 A |
| 4,103,267 | A | 7/1978 | Olschewski | |
| 4,205,288 | A | 5/1980 | Lin et al. | 336/5 |
| 4,353,040 | A | 10/1982 | Krumm et al. | |
| 4,366,520 | A | 12/1982 | Finke et al. | |
| 4,524,342 | A | 6/1985 | Mas | |
| 4,536,733 | A | 8/1985 | Shelly | |
| 4,639,707 | A | 1/1987 | Tanaka et al. | |
| 4,707,619 | A | 11/1987 | Chu et al. | |
| 4,761,628 | A | 8/1988 | Nishi et al. | |
| 4,808,959 | A | 2/1989 | Weissman | |
| 4,814,735 | A | 3/1989 | Williamson | |
| 4,901,048 | A | 2/1990 | Williamson | |
| 4,922,156 | A | 5/1990 | Turcotte et al. | |
| 5,003,273 | A | 3/1991 | Oppenberg | |
| 5,210,377 | A | 5/1993 | Kennedy et al. | |
| 5,311,406 | A | 5/1994 | Snodgrass et al. | |
| 5,319,342 | A | 6/1994 | Kuroki | |
| 5,355,105 | A | 10/1994 | Angelucci, Sr. | |
| 5,430,426 | A | 7/1995 | Griebel | |
| 5,459,442 | A | 10/1995 | James | |
| 5,481,232 | A | 1/1996 | Wu et al. | |
| 5,502,430 | A | 3/1996 | Takahashi et al. | |
| 5,550,705 | A | 8/1996 | Moncrieff | |
| 5,574,419 | A | 11/1996 | Droho | |
| 5,644,276 | A | 7/1997 | Sturzebecher et al. | |
| 5,726,615 | A | 3/1998 | Bloom | |
| 5,748,013 | A | 5/1998 | Beauclair et al. | 336/233 |
| 6,054,914 | A | 4/2000 | Abel et al. | |
| 6,143,157 | A | 11/2000 | Andrus et al. | |
| 6,146,086 | A | 11/2000 | Snell et al. | |
| 6,198,374 | B1 | 3/2001 | Abel | |
| 6,737,951 | B1 | 5/2004 | Decristofaro et al. | |
| 6,980,077 | B1 * | 12/2005 | Chandrasekaran et al. | 336/212 |
| 6,992,555 | B2 * | 1/2006 | Hasegawa et al. | 336/178 |
| 7,026,905 | B2 | 4/2006 | Haugs et al. | 336/220 |
| 7,049,925 | B2 | 5/2006 | Kawano et al. | 336/234 |
| 7,136,293 | B2 | 11/2006 | Petkov et al. | 363/126 |
| 7,256,678 | B2 * | 8/2007 | Haugs et al. | 336/212 |
| 7,307,504 | B1 | 12/2007 | Yamashita et al. | 336/213 |
| 2004/0137247 | A1 * | 7/2004 | Ono et al. | 428/473.5 |
| 2004/0140879 | A1 * | 7/2004 | Schafer | 336/229 |
| 2006/0244561 | A1 | 11/2006 | Iwakura et al. | 336/212 |

FOREIGN PATENT DOCUMENTS

| | | |
|---|---|---|
| JP | 5-275960 | 10/1993 |

OTHER PUBLICATIONS

"Discrete and Integrated Passive Components on Polymer Film", http://www.xanodics.com, Xanodics LLC, 2003, pp. 1-2.

"Xanodics: About the Founders", http://www.xanodics.com/about_founders.html, Xanodics LLC, 2003, pp. 1-3.

"Xanodics, RF Networks", http://www.xanodics.com/rf_networks.html, Xanodics LLC, 2003, p. 1.

I. R. Mcnab, F. Stafani, M. Crawford, M. Erengil, C. Persad, S. Satapathy, H. Vanicek, T. Watt and C. Dampier, "Development of a Naval Railgun," IEEE Transactions on Magnetics, vol. 41, No. 1, Jan. 2005, pp. 206-210.

Yves Lembeye, Philippe Goubier, Jean-Paul Ferrieux, "Integrated Planar L-C-T Component: Design, Characterization and Experimental Efficiency Analysis," IEEE Transactions on Power Electronics, vol. 20, No. 3, May 2005, pp. 593-599.

Seán Cian Ó Mathúna, Patrick Byrne, Gerald Duffy, Weimin Chen, Matthias Ludwig, Terence O'Donnell. Paul McCloskey and Maeve Duffy, "Packaging and Integration Technologies for Future High-Frequency Power Supplies,"IEEE Transactions on Industrial Electronics, vol. 51, No. 6, Dec. 2004, pp. 1305-1312.

Joshua W. Phinney, David J. Perreault, and Jeffrey H. Lang, "Multiresonant Coreless Inductors and Transformers," MIT LEES' Laboratory Poster, Laboratory for Electromagnetics and Electronic Systems, May 24, 2004.

Robert Stanley Fielder, "Computer Aided Design and Fabrication of Magnetic Composite Multilayer Inductors," Thesis submitted to the Faculty of the Virginia Polytechnic Instituted and State University, Dec. 4, 2000, Abstract pg.

George Slama, "Low-Temp Co-Fired Magnetic Tape Yields High Benefits," Power Electronics Technology, Jan. 2003, pp. 30-34.

David G. Morrison, "Transformer Technology License Will Spur New Applications," Electronic Design, May 27, 2002, p. 40.

Chappell Brown, "Multicore Scheme Smooths Transformers" Electronic Engineering Times, Feb. 22, 1999, p. 57.

James Lau, "Flat-transformer Module Slashes Cost, Weight of High-Performance Power Supplies," Electronic Products, Jan. 1999, pp. 40-41.

Shinji Ikeda, Toshiro Sato, Atsushi Ohshiro, Kiyohito Yamasawa, and Toshiyuki Sakuma, "A Thin Film Type Magnetic/Dielectric Hybrid Transmission-Line with a Large Wavelength Shortening," IEEE Transactions on Magnetics, vol. 37, No. 4, Jul. 2001, pp. 2903-2905.

Gil Bassak, "Inductors Wind Their Way to Advances," Electronic Engineering Times, Dec. 20, 1999, pp. 61-66.

Luca Daniel, Charles R. Sullivan and Seth R. Sanders, "Design of Microfabricated Inductors," IEEE Transactions on Power Electronics, vol. 14, No. 4, Jul. 1999, pp. 709-723.

Shiro Yoshida and Hirokazu Tohya, "Novel Decoupling Circuit Enabling Notable Electromagnetic Noise Suppression and High-Density Packaging in a Digital Printed Circuit Board," Denver. IEEE EMC, Apr. 1998, pp. 641-646.

Takuya Miyashita, Shuichi Nitta, and Atsuo Mutoh, "Prediction of Noise Reduction Effect of Ferrite Beads on Electromagnetic Emission from a Digital PCB," Denver: IEEE EMC, Apr. 1998, pp. 866-871.

J.M. Lopera, Miguel Prieto, Alberto Pernía, Fernando Nuñ o, Martinus de Graaf, Jan Waanders, and Lourdes Barcia, "Design of Integrated Magnetic Elements Using Thick-Film Technology," IEEE Transactions on Power Electronics, vol. 14, No. 3, May 1999, pp. 408-414.

Yue-Quan Hu, David Ki-Wai Cheng, and Yim-Shu Lee, "New Fabrication Method for Planar Multilayer Windings Used in Low-Profile Magnetic Components," IEEE Transactions on Magnetics, vol. 35, No. 2, Mar. 1999, pp. 1055-1059.

Ning Li and Bruce M. Lairson, "Magnetic Recording on FePt and FePtB Intermetallic Compound Media," IEEE Transactions on Magnetics, vol. 35, No. 2, Mar. 1999, pp. 1077-1082.

S. Y. (Ron) Hui, Henry Shu-Hung Chung, and S. C. Tang, "Coreless Printed Circuit Board (PCB) Transformers for Power MOSFET/IGBT Gate Drive Circuits," IEEE Transactions on Power Electronics, vol. 14, No. 3, May 1999, pp. 422-437.

Z. Cai, S. Xiao, J. Bornemann, R. Vahldieck, "Tensor-Based Characteristic Impedance Calculations of Microstrips on Ferrite-Dielectric Substrates for Integrated Phase Shifter Applications," IEE Proceedings-H, vol. 139, No. 2, Apr. 1992, pp. 125-128.

D. C. Webb, "Microwave Magnetic Thin-Film Devices," IEEE Transactions on Magnetics, vol. 24, No. 6, Nov. 1988, pp. 2799-2804.

Sylvain Bolioli, Hafed Benzina, Henri Baudrand, and B. Chan, "Centimeter-Wave Microstrip Phase Shifter on a Ferrite-Dielectric Substrate," IEEE Transactions on Microwave Theory & Techniques, vol. 37, No. 4, Apr. 1989, pp. 698-705.

Robert A. Pucel and Daniel J. Massé, "Microstrip Propagation on Magentic Substrates—Part I: Design Theory," IEEE Transactions on Microwave Theory & Techniques, vol. MTT-20, No. 5, May 1972, pp. 304-313.

E. R. Bertil Hansson, Sheel Aditya, and Mats A. Larsson, "Planar Meanderline Ferrite-Dielectric Phase Shifter," IEEE Transactions on Microwave Theory & Techniques, vol. MTT-29, No. 3, Mar. 1981, pp. 209-215.

Marion E. Hines, "Reciprocal and Nonreciprocal Modes of Propagation in Ferrite Stripline and Microstrip Devices," IEEE Transactions on Microwave Theory & Techniques, vol. MTT-19, No. 5, May 1971, pp. 442-451.

P. A. Janse Van Rensburg, J. D. Van Wyk, and J. A. Ferreira, "Design and Construction of a Generic Multi-KVA Planar Integrated LCT for a Family of Series Resonant Converters," IEEE, Nov. 1996, pp. 1361-1368.

Richard A. Flinn and Paul K. Trojan, Engineering Materials and Their Applications, 3d Ed., Houghton Mifflin Company, Boston, pp. 674-675, 689-690.

Héctor H. Fiallo, "Multilayer Metal-Semiconductor-Relaxor Microstrip Line Low-Pass Filters for Communication and Wireless Electronic Applications: Design, Materials Selection, and Characterization," Thesis submitted to the Faculty of Pennsylvania State University Graduate School, Dec. 1993, pp. 10-18, 131, 160.

Héctor H. Fiallo, Joseph P. Dougherty, Sei-Joo Jang, Robert E. Newnham and Lynn A Carpenter, "Transmission Properties of Metal-Semiconductor-Relaxor Microstrip Lines," IEEE Transactions on Microwave Theory & Techniques, vol. 42, No. 7, Jul. 1994, pp. 1176-1182.

W. D. Kingery, H. K. Bowen, D. R. Uhlmann, Introduction to Ceramics, 2d Ed., John Wiley & Sons, New York, pp. 975-1008 (only figures attached).

Kazuhiko Atsuki and Eikichi Yamashita, "Analytical Method for Transmission Lines with Thick-Strip Conductor, Multi-Dielectric Layers and Shielding Conductor," Electronics and Communications in Japan, vol. 53-B, No. 6, 1970, pp. 85-91.

Reinmut K. Hoffmann, Integrierte Mikrowellenschaltungen, Springer-Verlag, Berlin, 1983, pp. 20-25.

Pervez A. Dalal, H. Y. Yang, and C.Q. Lee, "High Frequency Transmission Line Transformer for DC/DC Converters," IEEE, Jun. 1995, pp. 671-677.

C. R. Wilson, G. A. Erickson, and P.W. Smith, "Compact, Repetitive, Pulsed Power Generators Based on Transmission Line Transformers," Digest of Technical Papers, 7th IEEE Pulsed Power Conference, Jun. 1989, Publishing Services, IEEE, New York, Cat. No. 89CH2687-2, pp. 108-112.

"Comparison of Losses and Flux Distribution in 3 Phase 100kVA Distribution Transformers Assembled from Various Type of T-Joint Geometry", I. Daut, Dina M.M. Ahmad, S. Zakaria, S. Uthman, and S. Taib. American Journal of applied Sciences 3(9) pp. 1990-1992, 2006.

"The Distributed Energy Store RAligun, its Efficiency, and its Energy Store Implication", R.A. Marshall, IEEE Transaction on Magnetics, Vol. 31, No. 1, Jan. 1995.

"Railgun Performance Enhancement from Distribution of Energy Feeds", M.J. Matyac & F. Christopher, IEEE Transaction on Magnetics, Vol. 31, No. 1, Jan. 1995.

"Distributed Energy Store Powered Railguns For Hypervelocity Launch", B.L. Maas, D.P. Bauer, & R.A. Marshall, IEEE Transaction on Magnetic, vol. 29, No. 1, Jan. 1993.

"Distributed Energy Store Railgun: The Limiting Case", R.A. Marshall, IEEE Transaction on Magnetics, vol. 27, No. 1, Jan. 1991.

International Search Report—PCT/US07/15801; Dated Jul. 13, 2006; 5 Pages.

* cited by examiner

DEVICES AND METHODS FOR REDISTRIBUTING MAGNETIC FLUX DENSITY

FIELD OF THE DISCLOSURE

This disclosure relates generally to magnetic devices and more specifically to electromagnetic (E-M) and permanent magnetic (PM) devices that increase their power density (PD—Watts/volume) by redistributing the magnetic flux density (B) within the device's magnetic cores.

BACKGROUND

Introduction to Practical E-M Design

The term "E-M devices" includes, but is not limited to: passive electrical devices such as transformers, inductors, and delay lines; and electromechanical devices such as motors, generators, relays, solenoids, and the "rail gun." Some of these E-M devices also include permanent magnetic (PM) components that work synergistically with the E-M components to hold, lift, or torque magnetic susceptible material. PM components are also used to favorably change the magnetic material's magnetic saturation characteristic. Permanent magnets, PM, may also be used in magnetic devices without electro-magnetics (E-M).

All conventional E-M devices consist of a magnetizing current, $I_M(f)$, of an operating frequency (f) flowing in a conductive coil around and external to the magnetic core. The heart of all E-M devices and permanent magnetic devices is a magnetic core. The core may be made of grain oriented silicon steel, amorphous metal, ferrite, or other ferrous based materials. Some magnetic cores are a dielectric material such as plastic or air and have no ferrous enhancement of its magnetic permeability (μ) or limitations on its maximum flux density ($B_{Mx}(f)$).

A magnetic device determines its operational power from the steady state operating voltage (V(f)) which develops a steady state operating load current ($I_L(f)$) through the device. The steady state power (P(f)) required by the device is the product of its operating voltage, V(f), and load current, $I_L(f)$.

$$P(f)=V(f)*I_L(f).$$

Magnetic devices are usually designed so the magnetizing current, $I_M(f)$, is small and negligible with respect to the load current, $I_L(f)$. The device's maximum steady safe state power capability ($P_{Mx}(f)$) is the product of the device's maximum safe steady state voltage ($V_{Mx}(f)$) and its maximum safe steady state load current ($I_{Lx}(f)$).

$$P_{Mx}(f)=V_{Mx}(f)*I_{Lx}(f).$$

Power density, PD(f), at an operating frequency, f, is the maximum safe steady state power required by the E-M device divided by the device's magnetic material volume (vol).

$$PD(f)=P_{Mx}(f)/\text{vol}.$$

Maximum Current, $I_{Mx}(f)$, and Maximum Voltage, $V_{Mx}(f)$

The maximum operating electrical power for all these devices is determined by either the maximum current rating of the magnetic wire forming the magnetics' coil which conducts the maximum load current, $I_{Lx}(f)$, or the maximum operating voltage rating, $V_{Mx}(f)$, at which the maximum flux density, $B_{Mx}(r)$, is less than Bsat throughout all sections of the magnetic core. ($B_{Mx}(r) \leqq Bsat$) Optimal magnetics' power design, which minimizes material requirements for the magnetic core and coil, occurs when both the maximum load current, $I_{Lx}(f)$, and the maximum voltage, $V_{Mx}(f)$, are the device's simultaneous operating power limitations—indicates all of the coil and all of the core are efficiently used.

The magnetic core's current limitation is principally affected by the diameter of wire required for the core's coil. The product of the wire's cross sectional area ($A_{wr}$) and the number (N) of required coil turns determines, to a first order, the core's minimum required window opening to accommodate the coil winding. Optimal magnetic design requires the smallest practical coil winding window opening.

All magnetic materials are characterized by their ability to accommodate the magnetic flux density, B, induced by the magnetic force field (AT, Ampere *Turn) permeating their space. This ability is known as the material's magnetic permeability (μ). A material's magnetic permeability, μ, is the product of the permeability of free space, $\mu_o$, and the material's relative permeability to free space, $\mu_R$. ($\mu=\mu_o*\mu_R$). The permeability of free space, $\mu_o$, has the value $1.26*10^{-6}$ Henries per meter (H/m), while the material's relative permeability, $\mu_R$, is an integer with a range of 1 to greater than a million. Ferrous based materials designed for magnetics have a relative permeability, $\mu_R$, much greater than 50—usually 1,000 to 20,000. Most magnetic materials have non-linear permeabilities increasing on the order of a factor of 10, when their magnetic force field, AT, changes from a low level magnetic excitation ($AT_{Lo}$) to the material's maximum high level magnetic excitation ($AT_{Hi}$), just below the material's maximum magnetic flux density, Bsat.

Some magnetic cores with a dielectric material such as plastic or air have no ferrous enhancement on its magnetic permeability (μ). Also, they do not have the ferrous limitation of magnetic saturation, Bsat. Air and most dielectrics have a relative permeability, $\mu_R$, of approximately 1.

A magnetic material's maximum magnetic flux density, Bsat, is the maximum number of magnetic flux ($\phi_{Mx}$) lines per unit cross sectional area ($A_C$) of magnetic material that the material will support without magnetically saturating. Magnetic force fields, AT, that try to cause the magnetic material's flux density, B, to exceed Bsat will cause the magnetic material to go into magnetic saturation and essentially reduce the magnetic core's relative magnetic permeability, $\mu_R$, to 1, the value of an air core. The magnetic device's maximum operating voltage, $V_{Mx}(f)$, occurs when the operating voltage, V(f), causes the maximum magnetizing current ($I_{Mx}(f)$) to induce into the magnetic device the maximum magnetic flux ($\phi_{Mx}(f)$) which causes the radially distributed magnetic flux density, $B_{Mx}(r)$, to reach Bsat, regardless of where it occurs along the device's radial cross sectional magnetic flux density distribution, $B_{Mx}(r)$.

In the maximum magnetic material radial cross sectional flux density distribution curves, $B_{Mx}(r)$, shown in the Figures, the following assumptions are in place. All conventional radial flux density distribution curves, $B_{Mx}(r)$, are normalized, maximum, and simple Amperian or the summation of normalized, maximum, simple Amperian curves. A normalized flux density distribution curve means that the actual flux density distribution, B(r), is divided by the magnetic material's magnetic saturation flux density, Bsat. Maximum flux density means that the highest flux density value of the flux density distribution, $B_{Mx}(r)$, is Bsat and occurs in conventional magnetic material at its inner most magnetic boundary, the effective radius of the inner diameter, $r_{IDe}$. Amperian may be defined as the radial cross sectional maximum flux density distribution curve, $B_{Mx}(r)$, that follows Ampere's Law and is hyperbolically shaped, radially, from the inner boundary, $r_{IDe}$, to the outer boundary, the effective radius of the outer diameter, $r_{ODe}$, regardless of the core's shape or size. Also, the inner boundary, $r_{IDe}$, completely surrounds the magnetizing current source, $I_M(f)$, inducing the magnetic force field, AT, into the magnetic material.

On the other hand, all power density, (PD), enhanced redistributed flux density curves ($B_{BMx}(r)$) presented herein, are the optimal summation of radially shifted, normalized, maximum, simple Amperian curves, $B_{Mx}(r)$.

When an E-M or PM device's PD is compared, the device is assumed to be operating in the steady state, unless otherwise noted. A device's steady state assumes a steady electrical magnetizing current, $I_M(f)$, for a fixed load after a device has been subjected to the application of a fixed voltage, V(f), at a fixed frequency, f. Operating frequency, f, has the range of zero (0) to infinity (∞). When f equals zero (f=0), the DC or time invariant condition is being considered. Thus, $V_{DC}=V(f)$ when f=0.

The comparative PD of E-M and PM devices in the transient state, occurs when the device's magnetizing current, $I_M(t)$, in the time domain (t) electrically responds to a voltage step function excitation, V(t). The transient state voltage, V(t), of an electro-magnetic device is defined over its actuation time, beginning at start, t=0, to finish time, $t=T_D$.

A circular toroid will be used to generally define the inner and outer boundaries for the radial magnetic operating regions of all magnetic cores—the region is defined from the effective radius of the inner diameter, $r_{IDe}$, to the effective radius of the outer diameter, $r_{ODe}$ The circular toroidal shape's uniform structure lends itself to easy mathematical analysis (using Ampere's Law) from which all magnetic flux distribution curves, herein, have been ideally determined. All maximum normalized flux density distribution curves, $B_{Mx}(r)$, represent maximum operational flux density, $B_{Mx}(f)$, at operational frequency (f). Whether the operating voltage is steady state, V(f), or transient, V(t), the flux density distribution is Amperian. The square core's magnetic flux distribution is a summation of bi-lateral Amperian cross sectional magnetic flux distributions, each being derived from an equivalent circular toroidal shape with the same inductance and material volume of the square core.

A circular toroid exhibits a precise, circular, magnetic core geometry, and as such, the magnetic flux's center for its effective radius of curvature is exactly the geometric center of the toroid. The geometry of a circular toroidal magnetic core precisely lines up with the natural circular geometry of magnetic flux lines generated by the magnetizing current, $I_M(f)$, flowing through the center of the toroid. Consequently, the effective radius of the inside diameter, $r_{IDe}$, equals the geometric radius of the inside diameter ($r_{ID}$). Likewise, the effective radius of the toroid's outer diameter, $r_{ODe}$, equals the geometric radius of its outside diameter, $r_{OD}$. If a device's magnetic core exhibits a uniform and constant flux density distribution, B(r), throughout its circumferential magnetic path length, $l_e$, as shown by any of its flux density distribution curves then, by the inverse of Ampere's Law's, the magnetic core is constructed with a constant radius of curvature.

For non-circular magnetic core construction geometries, such as a square core, magnetic flux density distributions must conform to Ampere's Law at all points along the core's magnetic path length, $l_e$. However, the non-circular shape of the core forces the core's magnetic flux lines to traverse long straight magnetic sections with effectively large radius of curvature ($r_{IDes}$) and traverse corners with effectively much smaller radius of curvature ($r_{IDec}$). ($r_{IDes}>>r_{IDec}$) The square core's straight sections are the dominant regions that determine the non circular device's toroidal shape equivalent effective radius of inner diameter, $r_{IDe}$, and equivalent effective radius of outer diameter, $r_{ODe}$, respectively, by the inner magnetic path length periphery ($l_{ei}$), the outer magnetic path length periphery ($l_{eo}$), and the requirement that the equivalent toroidal physical size and inductance coincide with the square core's physical size and inductance.

The operational description of redistributed magnetic flux density in a magnetic core assumes that the magnetic material used in the core's cross-section from $r_{IDe}$, to $r_{ODe}$ and at any point along its magnetic path length, $l_e$, is ideal and has a constant, uniform, and isotropic relative magnetic permeability, $\mu_R$, which is greater than 100. Flux density distribution curves shown herein are only a function of the core's geometry and ideal operating frequency, f.

The magnetic core's voltage limitation, $V_{Mx}(f)$, is effected by the magnetic flux distribution within the magnetic core. Increased magnetic flux utilization within a given magnetic core material, without magnetic saturation, achieves a higher operating voltage by Faraday's Law and, therefore, higher power density (PD—Watts/volume). Presently, all the magnetic cores in conventional E-M and PM devices are designed to use simple, Amperian, radial (r), magnetic, flux density distribution, B(r), within the core. Consequently, depending on core geometry, from 10% to up to 50% or more of the core is under utilized.

The power electrical transformer was first patented by Gaulard & Gibbs in 1882 and then practically refined by William Stanley in 1886. Since then, optimizing the magnetic design of conventional coil and core electro-magnetic devices, such as transformers, inductors, delay lines, relays, solenoids, motors, and generators, has been limited to conventional electro-magnetic design techniques. Likewise, permanent magnetic device design has followed the trends set by E-M device design. Little has changed in the design of conventional E-M devices other than the introduction of better performing materials and algorithms to speed up the design process.

It is to be understood that both the foregoing general description and the following detailed description are not limiting but are intended to provide further explanation of the novelty claimed. The accompanying drawings, which are incorporated in and constitute part of this specification, are included to illustrate and provide a further understanding of the method and system described herein. Together with the description, the drawings serve to explain the principles of construction and operation.

DESCRIPTION OF THE PREFERRED EMBODIMENT

Figure 1A:
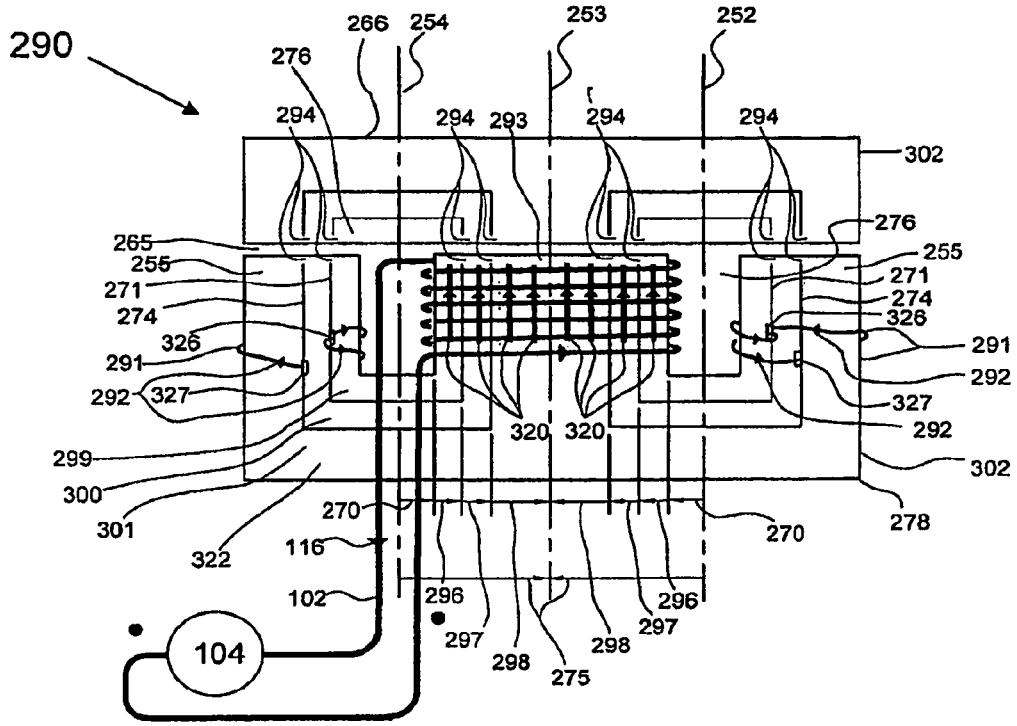
FIG. 1A is a top view of an example low profile, square core inductor that is self biased.

The broad range of magnetic materials, such as grain oriented silicon steel, amorphous metals, ferrites, and powdered iron, are ferrous based. All ferrous based magnetic materials used to build magnetic cores are modifiable by the application of the power density, (PD), enhancement technologies described below. These magnetic materials are considerably non-linear, hysteretic, and parametrically distinct from each other, which makes detailing the descriptions of how each material benefits from power density enhancement needlessly complex. However, normalized flux density distribution will be used to simplify and illustrate the various PD enhancement techniques which demonstrate that the PD enhancement techniques are independent of the magnetic material to which the PD enhancements are applied.

For purposes of the Figures described below, identical element numbers are designated by identical reference numbers as follows. For the devices shown in the following figures, magnetic flux lines circumnavigate their source, their magnetizing current, $I_M(f)$. Consequently, the polar coordinate system (r,θ,z) best describes the spatial geometry of magnetic flux lines with respect to the magnetizing current, $I_M(f)$, at a spatial center 115. The symbol, r, is the radial direction with the magnetizing current, $I_M(f)$, as the center 115. The symbol, θ, is the circumferential direction, encircling the magnetizing current, $I_M(f)$, and usually parallel to the magnetic flux direction. The symbol, z, is the vertical direction, usually parallel to the direction of magnetizing current, $I_M(f)$.

Transformer operation is functionally characterized by the voltages on the primary and secondary windings and the currents in the primary and secondary windings. All the transformers, inductors, or cores for inductors and transformers referenced in the Figures are operated by a time changing voltage 104 of frequency, f, (Vp(f)), applied to a primary or inductor winding 102. An E-M device without a secondary winding and no mechanical actuation is simply an inductor. A secondary voltage 105 (Vs(f)), develops on a secondary winding 103, that is proportional to the turns ratio, N. The turns ratio is the number of turns of secondary winding (Ns) divided by the number of turns of primary winding (Np). N=Ns/Np. The diameter of the secondary wiring 103 may be chosen to accommodate within safety agency thermal limits a maximum secondary current 117 ($I_{Sx}(f)$). The diameter of the primary wiring 102 may be chosen to accommodate, within safety agency thermal limits, a maximum primary current 116 ($I_{Px}(f)$). The primary voltage reference 104, the primary current reference 116 and a primary winding reference 102 reference the primary wiring. The secondary voltage 105, a secondary current reference 117 and the secondary winding reference 103 reference the secondary wiring. The maximum primary current, $I_{Px}(f)$, is the vector summation of the secondary current reflected into the primary, by the reciprocal of the turns ratio, N, and the maximum magnetizing current, $I_{Mx}(f)$. $I_{Px}(f)=I_{Mx}(f)+I_{Sx}(f)/N$.

The maximum magnetizing current, $I_{Mx}(f)$, is the primary current when the primary voltage is maximum, $V_{Mx}(f)$, after the load is removed from the secondary and $I_{Sx}(f)$ is zero. For a low loss primary magnetic winding, the magnetizing current, $I_{Mx}(f)$, is nearly purely inductive, which would phase lag a pure resistive secondary current component, $I_{Sx}(f)$, by 90°. A maximum secondary current defines the primary and secondary wiring diameters, but for practical purposes is not considered in the transformer's magnetic core analysis. Only the magnetizing current, $I_M(f)$, 116, defines the radial, r, time changing flux density distribution, B(f,r), at frequency, f, in the magnetic core.

Terminology that describes spatial direction with respect to specific magnetic flux direction is used without concern for the spatial position of the magnetizing current, $I_M(f)$. The term longitudinal refers to the direction that is parallel to the magnetic flux, $\phi_M$, direction regardless of its spatial position or orientation. Lateral is a directional term indicating normal (perpendicular) to the longitudinal direction. A magnetic core's magnetic path length ($l_e$) is a closed loop that parallels the direction of the magnetizing flux, $\phi_M$. A magnetic device's length ($l_t$) is the difference between a magnetic device's inner boundary, $r_{IDe}$, and outer boundary, $r_{ODe}$.

Figure 3A:
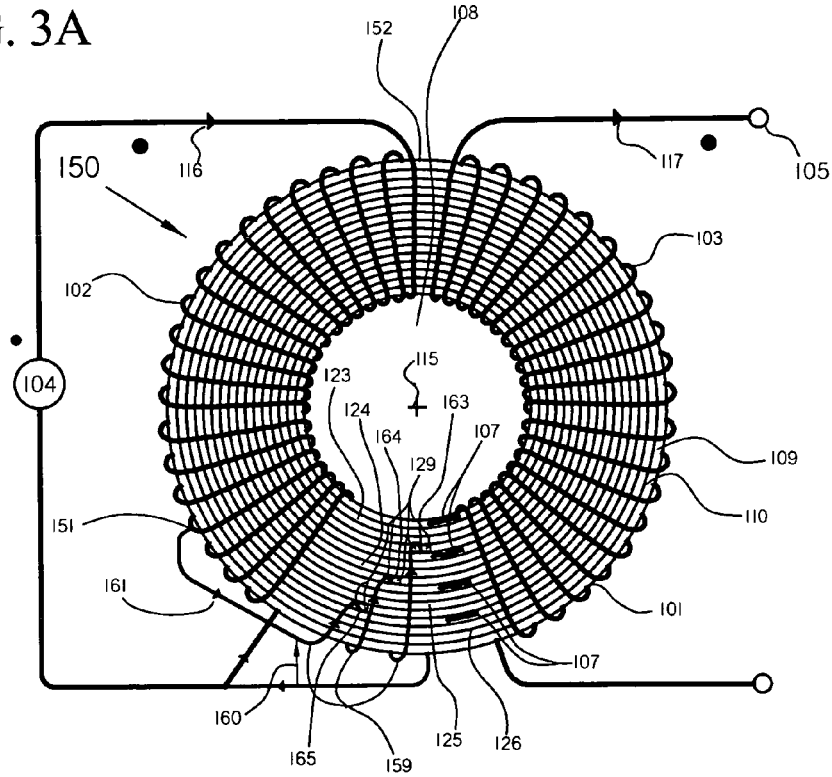
FIG. 3A is a top view of a low profile, toroidal transformer with a primary tap bias.
Figure 3B:
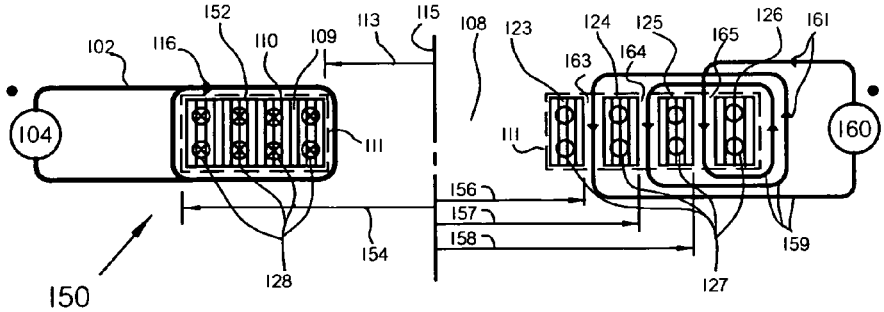
FIG. 3B is a cross-sectional view of the low profile, toroidal transformer of FIG. 3A.

Toroid devices such as a toroidal transformer 150 shown in FIGS. 3A-3B include a window opening 108. Square core devices such as an E-I inductor 290 shown in FIGS. 1A-1B include a window opening 276. Capacitor enhanced magnetic devices such as a tape wrapped toroidal core 450 shown in FIGS. 9A-9B include a window opening 451.

Construction Categories (4)

The construction of a device's core, regardless of the device's application, falls under one of four example core construction categories, or combinations thereof. These categories and their examples include: 1) a laminated core (LaC) such as a low profile E-I inductor 290 shown in FIGS. 1A and 1B, and a high profile E-I inductor 310 shown in FIGS. 2A and 2B; 2) a tape wound core (TWC) such as a low profile toroidal transformer 150 shown in FIGS. 3A and 3B, and a high profile toroidal transformer 100 shown in FIGS. 4A and 4B; 3) a solid block core (SBC) such as a high profile E-I inductor 360 shown in FIGS. 5A and 5B and a planar inductor 941 shown in FIG. 6; and 4) an air or dielectric core (AiC) such as an inductor 940 shown in FIGS. 7A and 7B, and a rail gun 960 shown in FIG. 8.

Laminated cores (LaC) may be used to construct E-I cores devices (a.k.a. "square core") such as transformers, electric motors and generators (both stator and rotor), solenoids and relays. TWC construction may be used to construct circular and square toroidal transformers and inductors. Solid block core (SBC) construction may be used for toroidal or E-I shaped cores and constructed with ferrite based magnetic core material which may be used in high frequency inductors and transformers; electric motors and generators (usually the rotor); and relays. Air or dielectric core (AiC) construction may be used in a "rail gun"; very high frequency (RF) transformers and inductors; and magnetics where extremely high magnetic induction is required without exceeding the magnetic saturation limitation of ferrous core material. The four example magnetic core constructions may all be modified to improve the device's power density by optimally redistributing their core's radial maximum magnetic flux density, $B_{Mx}(r)$.

Selecting Magnetic Core Material for Frequency of Operation

Figure 4A:
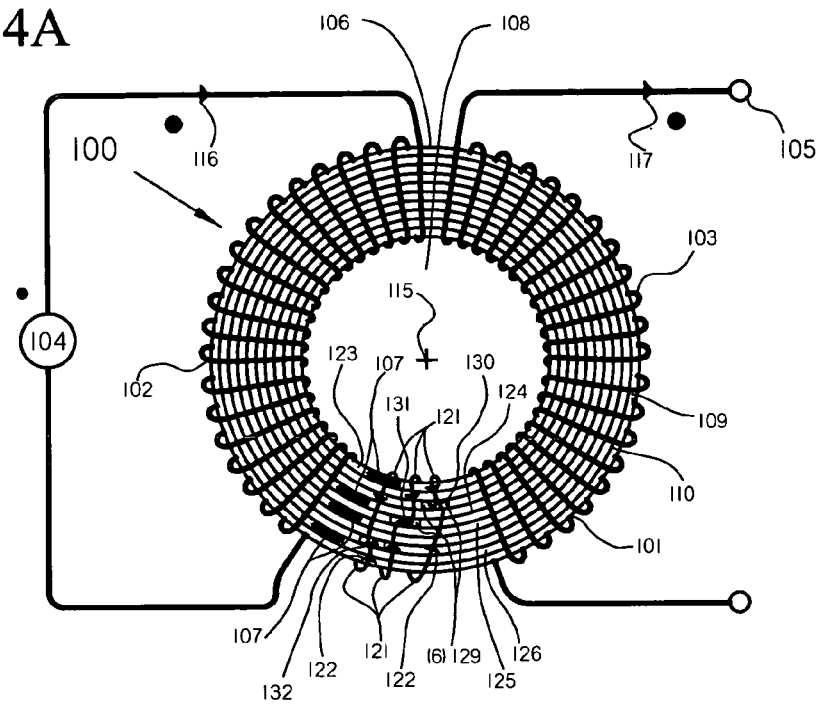
FIG. 4A is a top view of a high profile, toroidal transformer with a self bias.
Figure 4B:
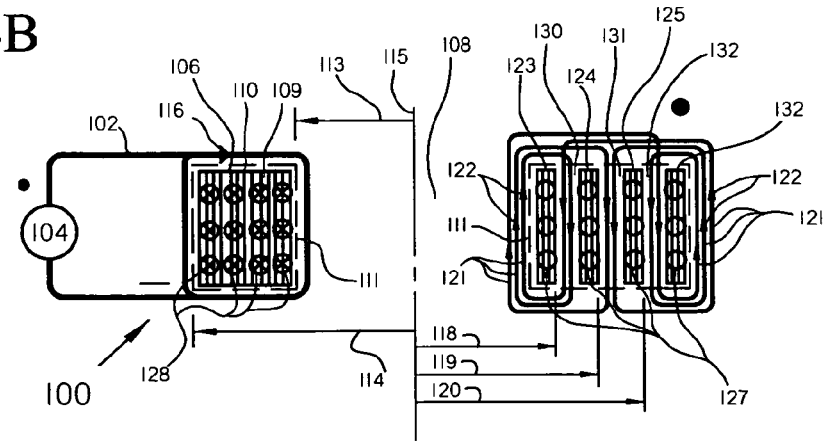
FIG. 4B is a cross-sectional view of the high profile, toroidal transformer of FIG. 4A.

An electromagnetic device's frequency of operation determines the device's best magnetic core selection. The high profile, stacked, laminated, square core, (LaC) construction such as the inductor 310 shown in FIGS. 2A and 2B, and a high profile tape wound toroidal core, TWC construction such as the transformer 100 shown in FIGS. 4A and 4B are the optimal construction shapes for power density when building inductors and transformers. The circular, stacked, laminated core (LaC) is the power frequency core shape that gives the optimal power density for motors and generators. Magnetic cores for relays and solenoids operating at these power frequencies may be constructed by modified square core LaC construction. For electromagnetic devices with operating frequencies greater than 20 kHz, SBC ferrite material is the optimal magnetic material for power density relative to either the TWC, or LaC square core. Air core construction is generally used for operating frequencies greater than 100 MHz. Thus, core selection for power density is determined by the frequency of the operation of the E-M device.

Magnetic Flux Redistribution Techniques (4)

Four novel magnetic core flux density redistribution methods have been developed and are reported herein. The first flux density redistribution method is referred to as the core bias current method, whereby bias current ($I_B(f)$) is injected through the magnetic core by a voltage source of an amplitude and phase with respect to the magnetic driving voltage source, V(f), such that a portion of the maximum operational magnetic flux density, $B_{Mx}(r,f)$, is moved from over utilized areas of the core's cross section to under utilized areas. The bias current method for core modification may be designed to inject bias currents into the core so as to magnetically redistribute flux, longitudinally, along all of the core's magnetic path length, $l_e$, or, locally, along part of the core's magnetic path length, $l_e$, such as the corners or sharp radius of curvature that the magnetic flux must traverse along the core's magnetic path length, $l_e$. Effectively, bias current, $I_B(f)$, through the core is able to redistribute magnetic flux density, $B_{Mx}(r)$, throughout the core, because the magnetic flux generated by the bias current, $I_B(f)$, will oppose the magnetic flux generated by the device's magnetizing current, $I_{Mx}(f)$, at the core's inner periphery, $l_{ei}$, and its magnetic neighborhood, and aid the magnetic flux at the core's outer periphery, $l_{eo}$, and its magnetic neighborhood.

The core bias current method may be implemented by one of two frequency determinate methods. One method redistributes magnetic flux density to increase the magnetic device's PD over a broad range of frequencies. The other method uses dielectric material to form capacitance, distributed either uniformly or discretely along the device's length, $l_t$, through which displacement currents ($I_D(f)$) cause the device to redistribute magnetic flux density at a narrow operational frequency ($f_o$) so as to increase the device's PD.

Constructing magnetic devices with magnetic cores having distributed capacitance (Cn) provides the additional benefit of constructing a novel power transmission line wherein the propagation of a transient voltage, V(t), along the device's transmission line length, $l_t$, requires time delay ($T_D$). The power transmission line also forms a new electromechanical device that develops mechanical forces in its magnetic core from the induced magnetic energy faster than for the same transient operating voltage, V(t), applied to the same core without distributed capacitance.

Another benefit of integrating capacitance with the magnetizing inductance is the creation of a parallel resonant circuit, when operated at resonance frequency ($f_r$) causes the device to electrically appear to the driving circuit like an impedance higher than the simple inductive reactance that it would be without the capacitance. The examples of the core bias current method are a self bias current, low profile, LaC inductor 290 shown in FIGS. 1A and 1B; a tapped bias current, high profile, LaC inductor 310 shown in FIGS. 2A and 2B; a tapped bias current, low profile, TWC transformer 150 shown in FIGS. 3A and 3B, a self bias current, high profile, TWC transformer 100 shown in FIGS. 4A, 4B, and 4C; a capacitance enhanced, displacement bias current, tape wrapped core 450 shown in FIGS. 9A and 9B; a capacitance enhanced, displacement bias current, tape wrapped core 500 shown in FIGS. 10A and 10B; a capacitance enhanced, displacement bias current, tape wrapped core 530 shown in FIGS. 11A and 11B; and a capacitance enhanced, displacement bias current, tape wrapped core 570 shown in FIGS. 12A and 12B.

The second flux density redistribution method is referred to as magnetic core interlacing, whereby the core's cross section is modified by longitudinally sectioning the core, into concentric, magnetically isolated core sections, that are mechanically interlaced. Ideally, the mechanical interlacing of the core material is designed such that the magnetic flux path lengths, $l_e$, of each longitudinal section are equal. If the cross sections of each magnetic section are also equal, then the cross sectional magnetic flux density, $B_{Mx}(r)$, in each magnetic section, has the same shape for simple Amperian maximum magnetizing current, $I_{Mx}(f)$. However, each section is physically, radially, shifted from each other, thereby, radially shifting their maximum magnetic flux density distribution ($B_{Mx}(r-\Delta r)$) which maximizes the total flux density distribution, $B_{Mx}(r)$, in the composite interlaced core. The examples of magnetic core interlacing are SBC or LaC inductor or transformer cores 850 shown in FIG. 13 and core 870 shown in FIGS. 14A and 14B.

The third flux density redistribution method is referred to as the magnetic core corner flux density remediation, whereby flux density pile-up at corners or sharp bends along the longitudinal magnetic flux path, $l_e$, are remedied. Corner bias current is one method to remediate magnetic flux density pile-up at the corners. Another method physically smoothes or radially elongates the longitudinal magnetic slit at sharp radii of curvature along the longitudinal magnetic flux path. Still another method diagonally gaps corner sections, lateral to the magnetic flux direction, to remediate corner flux density saturation. The examples of magnetic core corner flux density remediation by tapped bias current include a LaC inductor 330 shown in FIGS. 15A and 15B, and corner flux density remediation by self bias current in a LaC inductor 350 shown in FIGS. 16A and 16B; and corner flux density remediation by a corner shaping 370 in FIG. 17A; a corner shaping 371 in FIG. 17B; a corner shaping 372 in FIG. 17C; a corner shaping 373 in FIG. 17D; and a corner shaping 374 in FIG. 17E.

The fourth flux density redistribution method is referred to as magnetic flux density redirection, whereby the magnetic core's flux density, $B_{Mx}(r)$, is redirected from a radial direction, r, to a circular direction, θ, around the center of the magnetic core. Flux density redirection converts a spiral winding radial flux density direction, r, to a toroidal winding circumferential flux density direction, θ. The redirection works best to reduce the circuit losses due to skin effect and load current in the winding and thereby allows the device to carry a higher current for a given size, at a safe operating temperature, and thus have a higher PD. The examples of magnetic flux density redirection are an AiC 600 shown in FIGS. 18A and 18B, and an AiC 620 shown in FIGS. 19A-19C.

Inductors and Transformers

All EM and PM devices constructed with any of the core construction categories, laminated core, tape wound core, solid block core or air/dielectric cores may improve their power density by one or more of the four aforementioned core modification techniques to redistribute their magnetic core's flux density. Inductors and transformers benefit from all four core modifications Introduction to Magnetic Flux Redistribution All Electro-magnetic (E-M) devices and permanent magnetic (PM) devices may have their radial maximum flux density, $B_{Mx}(r)$, optimally redistributed in their magnetic cores. In E-M cores, the optimal redistribution of flux density increases the core's power density. In PM cores, the core's magnetization is increased by redistributing the core's radial magnetic flux density, B(r). Improving the power density in an E-M device's core corresponds directly to improving the power density in the E-M device. Similarly, in PM devices improving the magnetization of the core improves the magnetization of the device. Magnetization corresponds to the power density of the device. Thus optimally redistributing flux density, B(r), in E-M and PM cores increases the power density of all the devices using these modified cores.

Magnetic Principles of Redistributed Mag. Flux Density

Up until now a magnetic device's best maximum cross sectional magnetic flux density, $B_{Mx}(r)$, has only been allowed to assume a simple Amperian curve between its boundaries, the effective inner diameter radius, $r_{IDe}$, and the effective outer diameter radius, $r_{ODe}$. The Amperian curve peaks at the effective radius of the inner diameter, $r_{IDe}$, to Bsat ($B(r_{IDe})$=Bsat) and hyperbolically tapers away to the effective radius of the outer diameter, $r_{ODe}$. These conventional Amperian curves represent the best maximum magnetic flux density distribution, $B_{Mx}(r)$, for their respective transformers and are illustrated herein for circular toroidal transformers.

Figure 20:
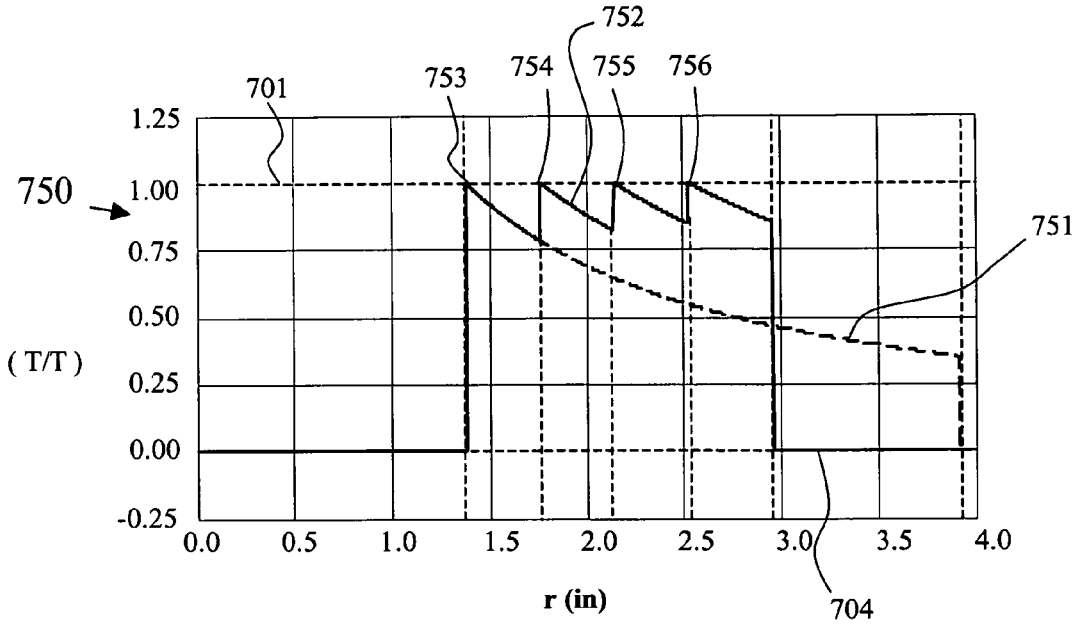
FIG. 20 is a graph comparing a flux density distribution curve for the low profile, transformer of FIGS. 3A-3B to the curve of a known transformer without magnetic flux density redistribution with the same maximum flux.
Figure 21:
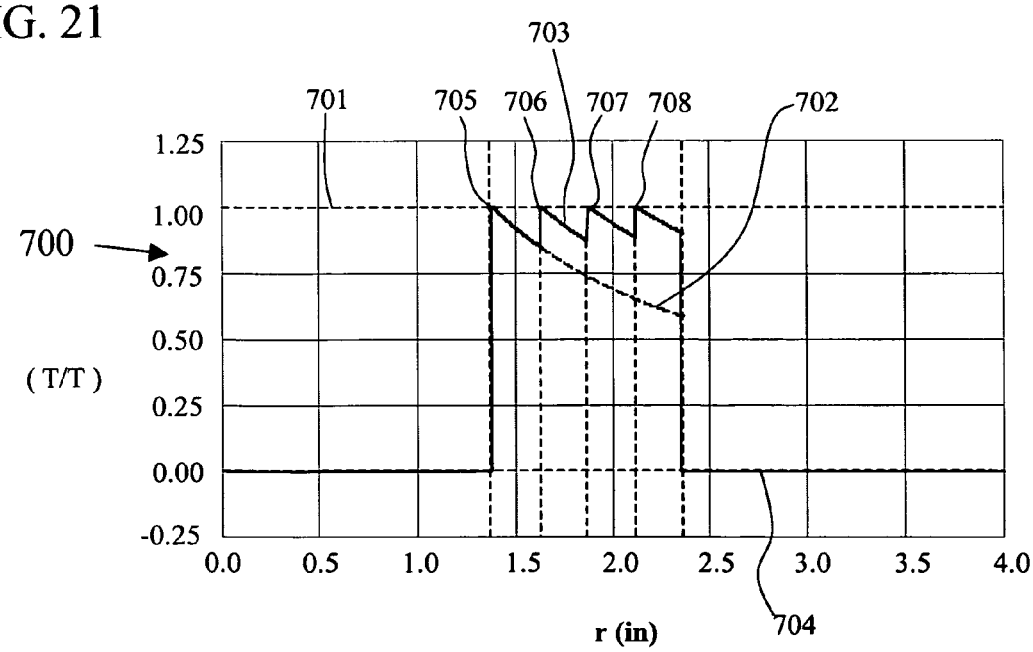
FIG. 21 is a graph comparing a normalized flux density distribution curve of the transformer of FIGS. 4A-4C to a curve for a same sized known transformer.

FIG. 20 shows a graph 750 having an Amperian curve 751 plotted on a vertical axis representing Teslas per Tesla (T/T) and a horizontal axis representing the radius of a core in inches. The Amperian curve 751 represents a known low profile TWC transformer with a $r_{IDe}$ of 1.37 inches and a $r_{Ode}$ of 3.91 inches. FIG. 21 shows a similar graph 700 plotting normalized flux distribution against radius having an Amperian curve 702 that represents the $B_{Mx}(r)$ for a known high profile TWC transformer operating without the benefit of a self bias current.

Magnetic flux redistribution methods work by radially dispersing the magnetic flux that develops under the peak of the magnetic core's Amperian distribution curve, $B_{Mx}(r)$. The magnetic flux is dispersed to cross sections of the magnetic core that are under utilized so that the core's cross sectional net flux is constant and Faraday's Law is satisfied for the same operating voltage, V(f). A higher maximum operating voltage, $V_{Mx}(f)$, is then needed to reach the core's magnetic operational limit, Bsat, at any radial point along the maximum flux density distribution curve, $B_{Mx}(r)$, thereby increasing the device's PD.

The purpose of magnetic flux density redistribution is to reshape the Amperian flux density distribution curve, $B_{Mx}(r)$ of a device to more fully utilize the flux density region between the Amperian curve, $B_{Mx}(r)$, and a flat line curve, Bsat, 701 radially bounded between $r_{IDe}$ and $r_{ODe}$, above a zero flux density reference line 704 as shown in FIG. 20. For example, this region can be seen in the graph 750 of FIG. 20 which shows the Amperian flux density distribution curve 751 for a low profile toroidal transformer bounded by its $r_{IDe}$ of 1.37 inches on the left and $r_{Ode}$ of 3.91 inches on its right. Also in graph 750, a curve 752 is plotted for a low profile, core bias current enabled, toroidal transformer 150 shown in FIGS. 3A and 3B which supports the maximum voltage, $V_{Mx}(f)$, and maximum load current, $I_{lx}(f)$, identical to the transformer represented by the curve 751. However, the core bias current in transformer 150 enables a volume of half that of the known transformer associated with the curve 751. Since both transformers support the same power level, but the transformer 150 has half the volume, the transformer 150 has a power density twice that of the known transformer.

Bias Current Magnetics

The first method for redistributing magnetic flux density from over-utilized magnetic core areas to under utilized magnetic core areas is referred to as bias current magnetics. Bias current magnetics applies, through an appropriately modified magnetic core, a maximum bias current, $I_{Bx}(f)$, from a voltage source, $V_B(f)$, that flows through the core appropriately phase and frequency synchronized with the device's maximum magnetizing current, $I_{Mx}(f)$, of such a magnitude, polarity, core direction and core location, so as to usefully redistribute the magnetic flux density within the core. The maximum bias current, $I_{Bx}(f)$, generates a magnetic flux density within the core that counters the flux density generated by the maximum magnetizing current, $I_{Mx}(f)$, in the over utilized area of the core, and aids the flux density generated by the maximum magnetizing current, $I_{Mx}(f)$, in the under utilized area of the core.

The core's main magnetic force field, ($AT_M(f)$) in a magnetic core is generated by the magnetizing current, $I_M(f)$, flowing in the winding window at less than the radius of the effective inner diameter, $r_{IDe}$, and extends to the core's radius of the effective outer diameter, $r_{ODe}$. When the magnetizing current, $I_{Mx}(f)$, is maximum, its magnetic force field, $AT_{Mx}(f)$ is at a maximum. The bias current, $I_B(f)$, is injected through the core at radius ($r_1$) where the core's magnetic permeability, μ, is anisotropic—maximum in the circumferential, θ, direction, but minimum in the radial direction. (i.e. $\mu_{R\theta} >> \mu_{Rr}$). If the permeability in the radial direction, $\mu_{Rr}$, was equal to the permeability in the circumferential direction, $\mu_{R\theta}$, then most of the magnetic flux induced by the bias current, $I_B(f)$, would encircle the bias current and would not usefully interfere with the magnetic flux caused by the magnetizing current, $I_M(f)$.

The injection of maximum bias current, $I_{Bx}(f)$, at radial position, $r_1$, which is greater than $r_{IDe}$ but less than $r_{ODe}$, generates a magnetic force field ($AT_1(f)$) at the radius, $r_1$, which extends to the radius of the effective outer diameter, $r_{ODe}$. Because the maximum bias current, $I_{Bx}(f)$, is flowing in the same direction with the same phase as the maximum magnetizing current, $I_{Mx}(f)$, the magnetic core material between radius $r_1$ and $r_{ODe}$ contains the magnetic force field ($AT_2(f)$) which is the summation of the maximum magnetic force field $AT_1(f)$, caused by the maximum bias current, $I_{Bx}(f)$, and the maximum magnetic force field ($AT_{Mx}(f)$), caused by the maximum magnetizing current, $I_{Mx}(f)$.

The maximum magnetic force field, $AT_1(f)$, caused by the maximum bias current, $I_{Bx}(f)$, increases the magnetic force field, $AT_2(f)$, between $r_1$ and $r_{ODe}$, and, by transformer action to satisfy Faraday's Law for a constant magnetizing voltage, V(f), decreases the magnetic force field, $AT_{Mx}(f)$, between $r_{IDe}$ and $r_{ODe}$ to $AT_{BMx}(f)$. The magnetic force field $AT_2(f)$ readjusts to the summation of $AT_{BMx}(f)$ and $AT_1(f)$. The maximum bias current, $I_{Bx}(f)$, is chosen so that the resulting maximum flux density distribution curve, $B_{BMx}(r)$, is Bsat at the radial positions $r_{IDe}$ and $r_1$. ($B_{BMx}(r_{IDe})=B_{BMx}(r_1)=Bsat$).

Ideally, the maximum bias current, $I_{BMx}(f)$, interfering constructively with the magnetizing current, $I_{Mx}(f)$, generates a sawtooth shaped, optimally flat, maximum, flux density distribution curve, $B_{BMx}(r)$ which is the summation of Amperian curves started, respectively, at radial positions $r_{IDe}$ and $r_1$. As succeeding bias currents are generated through the core's interior at higher radial positions, they will likewise affect the overall magnetic force field distribution, $AT_{Mx}$, initiated by the magnetizing current, $I_{Mx}(f)$.

Figure 1B:
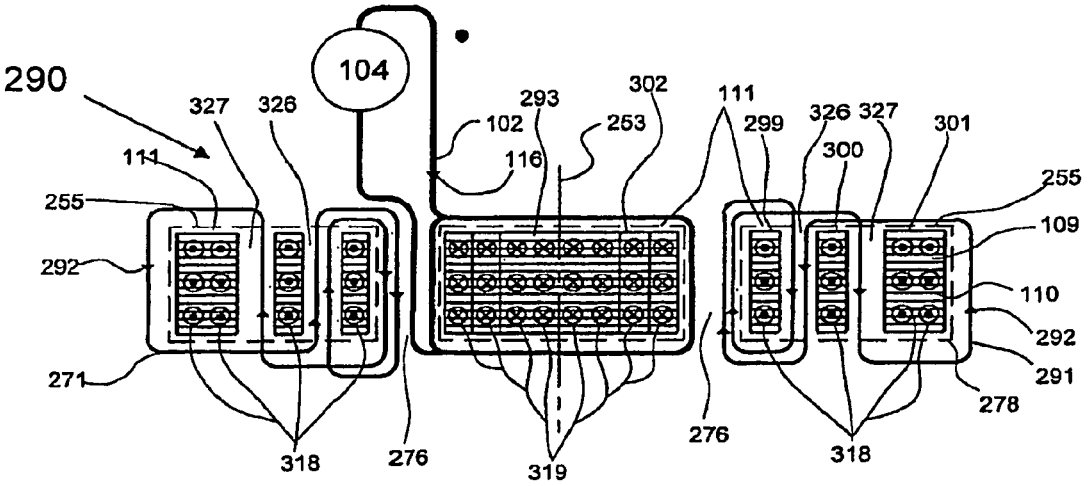
FIG. 1B is a cross sectional view of the low profile, square core inductor in FIG. 1A.
Figure 2A:
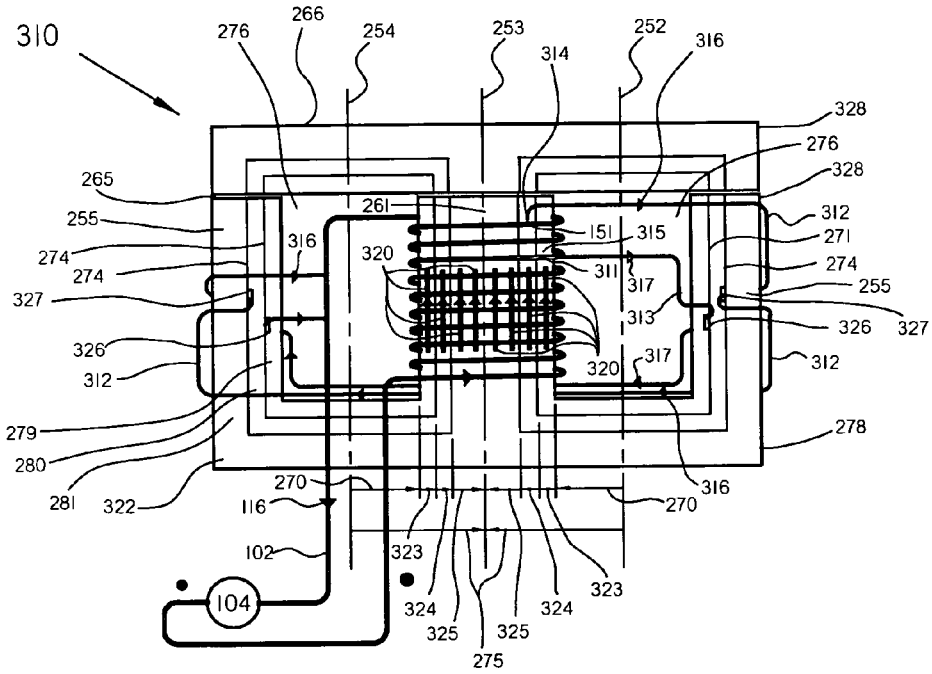
FIG. 2A is a top view of a high profile, square core inductor having a primary tap bias.
Figure 2B:
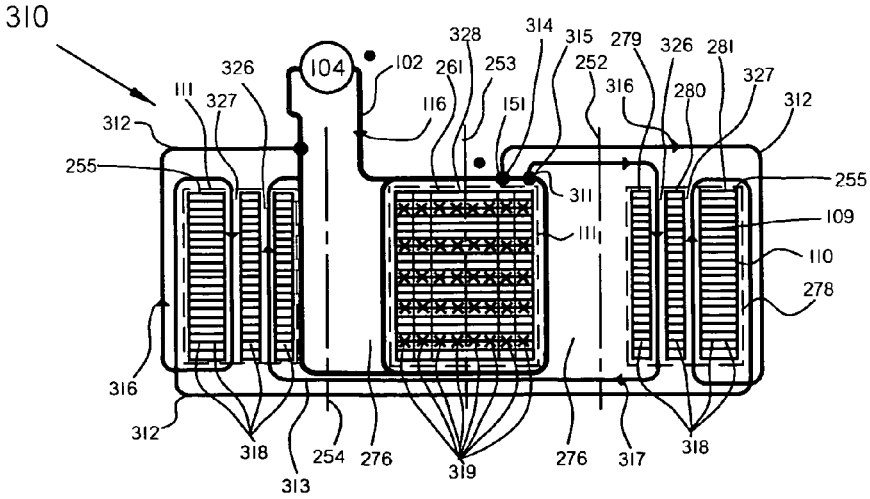
FIG. 2B is a cross sectional view of the high profile, square core inductor of FIG. 2A.
Figure 4C:
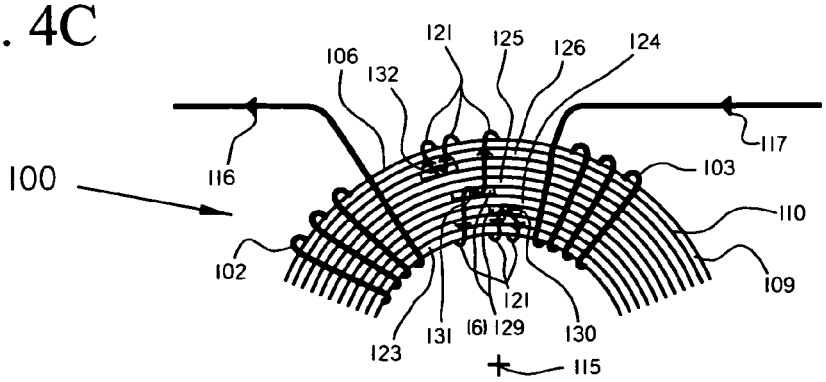
FIG. 4C is a bottom view of the high profile, toroidal transformer of FIG. 4A.

The benefit to operating an electromagnetic device with a bias current, $I_B(f)$, injected into its core interior is that a second maximum operating voltage, $V_{Mx2}(f)$, higher than the original maximum operating voltage, $V_{Mx}(f)$, may be sustained by the device before any part of the core's cross sectional magnetic flux density distribution curve, $B_{BMx}(r)$ reaches Bsat. This may be readily be seen by examining the sawtooth, maximum, flux density distribution curves, $B_{BMx}(r)$, generated by maximum bias current, $I_{Bx}(f)$. The $B_{BMx}(r)$ curves are shown for various devices. A $B_{BMx}(r)$ curve 713 for a low profile LaC device 290 in FIGS. 1A-1B is shown in a graph 710 of FIG. 22. A $B_{BMx}(r)$ curve 738 for a high profile LaC device 310 in FIGS. 2A-2B is shown in a graph 735 in FIG. 23. A $B_{BMx}(r)$ curve 752 for a low profile TWC device 150 shown in FIGS. 3A-3B is shown in the graph 750 in FIG. 20. A $B_{BMx}(r)$ curve 703 for a high profile TWC device 100 in FIGS. 4A-4C is shown in the graph 700 in FIG. 21. Each of the maximum, flux density distribution curves, $B_{BMx}(r)$, occupies more of the flux density region between maximum flux density distribution, $B_{Mx}(r)$ and the Bsat curve 701, than their respective devices without bias current would allow. The curves, $B_{Mx}(r)$, for comparable devices without bias current, are the dashed curves shown together with the $B_{BMx}(r)$ curves in FIGS. 20-23. Assuming that the maximum load current, $I_{Lx}(f)$, at $V_{Mx2}(f)$, is the same as before the injection of $I_B(f)$, thereby requiring no change in the winding window opening and, consequently, no change in the device's volume then the electro magnetic device is operating at a higher power level for the same volume of magnetizing material, thus, increasing the power density.

Alternatively the volume of the electro-magnetic device with a maximum bias current, $I_{Bx}(f)$, injected into its core may be reduced, whereby $V_{Mx2}(f)=V_{Mx}(f)$ and the maximum load current, $I_{Lx}(f)$, and winding window opening stays the same. This is done by reducing the $r_{ODe}$ for the circular toroid or the $r_{ODe}$ for the E-I core's toroidal equivalence while keeping the winding window opening, $r_{IDe}$, the same size. The PD improvement demonstrated in the graph 750 of FIG. 20, by the transformer 150 over the known transformer defined by the curve 751 demonstrates how the cross section of a device may have its $r_{ODe}$ reduced and still support the same maximum voltage, $V_{Mx}(f)$. ($V_{Mx}(f)=V_{Mx2}(f)$) Various device core modifications may utilize any combinations of these two PD improvement schemes.

Corner bias currents, $I_{CB}(f)$, redistribute magnetic flux density, B(r), locally, in magnetically compressed areas such as sharp bends or corners. Magnetic devices constructed with LaC or E-I SBC have the sharpest corners and are candidates for corner bias current remediation of their excessive, maximum, corner flux density ($B_{CMx}(r)$). The corner maximum flux density distribution, $B_{CMx}(r)$ of these devices tend to exceed Bsat in the radial region between the physical interior corner radius ($r_i$) of 0.032 shown in FIG. 33 and the effective radius of corner diameter, $r_{CDe}$, of 0.86 inches. At radial positions greater than $r_{CDe}$, up to a radial of 1.5 inches the corner magnetic flux density distribution is a simple Amperian distribution. Maximum corner bias current, $I_{CBx}(f)$, generates a corner magnetic flux density ($B_{CBx}(r)$) that interferes with the excessive corner magnetic flux density, $B_{CMx}(r)$, pile-up caused by the maximum magnetizing current, $I_{Mx}(f)$, at magnetic areas with low radius of curvature. Corner magnetic flux distribution ($B_{BCMx}(r)$) requires appropriate interference between the corner maximum magnetic flux density, $B_{CMx}(r)$, generated by magnetizing current, $I_{Mx}(f)$, and the corner compensating maximum magnetic flux density, $B_{CBx}(r)$, generated by maximum corner bias current, $I_{CBx}(f)$.

Maximum corner bias current, $I_{CBx}(f)$, generates corner maximum magnetic flux density, $B_{CBx}(r)$, that interferes with the corner magnetic flux density, $B_{CMx}(r)$, generated by the magnetizing current, $I_{Mx}(f)$, when the magnetic material around the corner bias current passage way is isotropic such that the permeability, $\mu_{\Theta B}$, in the circumferential direction, $\theta_B$, around the corner bias current, $I_{CB}(f)$, is the same as the permeability, $\mu_{rB}$, in the radial direction, $r_B$, around the bias current, $I_{CB}(f)$. The permeability, $\mu_{zB}$, in the z direction, $z_B$, around the bias current is arbitrary.

Both types of bias currents, longitudinal and corner, are derived from either a fixed or variable bias voltage source, $V_B(f)$, synchronized and proportional to the magnetizing voltage, V(f). Alternatively, either a fixed or variable bias current source, $I_B(f)$, synchronized and proportional to the magnetizing current, $I_M(f)$, may be used.

Anisotropic permeability is intrinsic to the tape wound toroidal core, TWC. The radially distributed tape wound layers are magnetically isolated from each other by the wound air gap and insulative layer coating between adjacent layers. In some instances, extra gapping or insulation between adjacent winding layers may be required. Thus, for the tape wound toroidal core: $\mu_{R\Theta}>>\mu_{Rr}$. Flux density distribution in a toroidal core in the "z" direction is negligible; consequently, the requirements for permeability in the vertical or "z" direction ($\mu_{Rz}$) are arbitrary.

Laminated cores which may be used in square core transformers, motors, generators, relays, and solenoids, achieve anisotropic permeability in the laminations by magnetically sectioning the lamination in the direction parallel to the magnetic flux path, $l_e$. Likewise, solid block cores (SBC) used in square core transformers, inductors, motor and generator rotors, relays, and solenoids achieve anisotropic permeability in its SBC by magnetically sectioning the SBC in the direction parallel to the magnetic flux path, $l_e$. The sectioning is known as longitudinal sectioning and fulfills the requirement that the permeability in the circumferential direction (parallel to the flux lines), $\mu_{R\Theta}$, be much greater than the permeability in the radial direction (lateral or normal to the flux lines), $\mu_{Rr}$. ($\mu_{R\Theta}>>\mu_{Rr}$) The sectioning includes notches to accommodate the passage of bias current wiring.

Magnetic Gapping

One method to magnetically isolate longitudinal sections is by applying mechanical slits throughout the lamination's magnetic flux path length, $l_e$. Each longitudinal slit forms a thin air gap ($l_g$) between adjacent magnetic sections, thereby, magnetically isolating laminated core sections in the radial direction while maintaining magnetic continuity throughout the magnetic path, $l_e$, in the longitudinal or θ direction. The air gap, $l_g$, causes the radial flux lines formed by the bias current to experience a significantly reduced effective permeability ($\mu_{eff}$) between the longitudinally slit sections. The effective permeability, $\mu_{eff}$, is given by:

$$\mu_{eff}=(\mu_R*l_{ep})/(l_{ep}+l_g*\mu_R),$$

where the magnetic path length, $l_{ep}$, is the shortest magnetic path length traversed by the flux lines surrounding the bias current—the periphery of the bias current's passage. The air gap between the core sections also provides the optimum radial position for passing the bias current conductors through the core's interior.

The effectiveness of a slit on magnetic permeability may be shown by the following example. For a magnetic lamination with a relative permeability, $\mu_R$, of 15,000, and a longitudinal slit with a spacing of 0.5 mils, the dimensions of the bias current passage are 10 mils by 300 mils which produces the shortest magnetic path length, $l_{ep}$, around the passage perimeter of 620 mils. The effective permeability, $\mu_{eff}$, across the slit, is 1145. Since $\mu_{R\Theta}=15{,}000$, then for the longitudinally slit laminated square core: $\mu_{R\Theta}>>\mu_{Rr}\approx\mu R_z$, which is desirable for implementing bias current magnetics anywhere along the slit's path length.

Mechanical Interlacing Flux Redistribution

Magnetizing flux, $\phi_M(f)$, is radially distributed equally in the core's longitudinally slit cross sections, when each section is mechanically interlaced so that each section's magnetic path length, $l_e$, is equal. The power density is optimally increased when the radial cross sectional areas, $A_C$, of each longitudinally slit core section are also equal. The mechanically interlaced magnetic core is a passive flux redistribution scheme that does not require bias currents to redistribute magnetic flux density, but relies on the mechanical interlacing of equally long magnetic sections to redistribute magnetic flux density.

Displacement Current Parameters

A bias current variation that accomplishes magnetic flux density redistribution in a magnetic core is referred to as displacement current magnetics which uses capacitance distributed along the length, $l_t$, of the magnetic core and in series with the operating magnetizing voltage, $V_M(f_o)$, to develop displacement currents ($I_D(f_o)$) through the core that redistribute the core's magnetic flux density so as to increase the device's PD at optimum operating frequency, $f_o$. The magnetic principles by which displacement current optimally redistributes magnetic flux density, $B_{Mx}(r)$, are similar to the bias current magnetics previously described in with respect to bias current magnetics.

Figure 24:
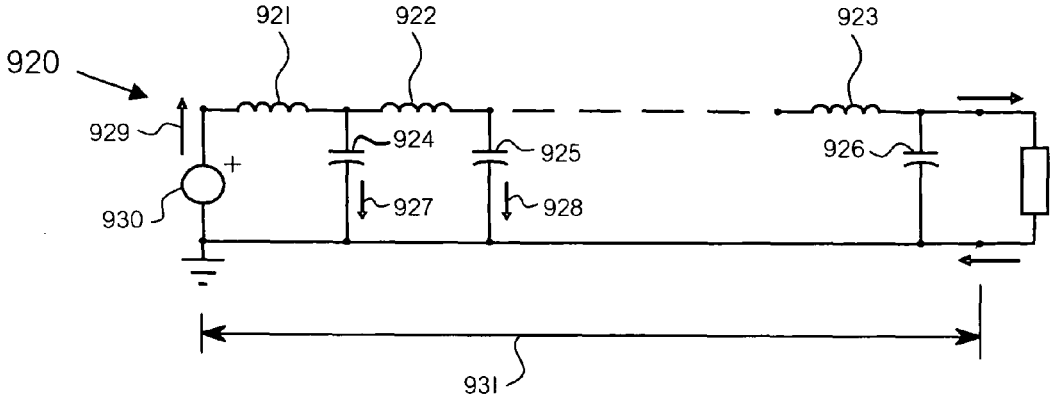
FIG. 24 is a circuit schematic of an equivalent circuit of a transmission line.

The distributed capacitance, Cn, electrically interacts with corresponding distributed sections of inductance (Ln) along the core's line length, $l_r$, thereby creating a transmission line. FIG. 24 shows a circuit 920 which is an electrical schematic representing the discrete circuit implementation of a transmission line. The discrete circuit consists of "n" sections of inductor and capacitor combinations that discretely and electrically represent a transmission line. The circuit 920 has a voltage source 930 that drives a current 929 into an input inductor 921. The circuit 920 includes the first input inductor 921 and a capacitor section 924, a second inductor 922 and a second capacitor section 925, through an nth inductor 923 and an nth capacitor section 926. If the inductor sections such as inductors 921 through 923, and the capacitor sections, such as capacitors 924 through 926, are equal along a length 931 of the transmission line, then the transmission line has a characteristic impedance (Zo) constant throughout a length 931 and a constant electromagnetic velocity of propagation ($v_p$) along the length 931. In terms of the discrete circuit parameters, the characteristic impedance, Zo, and the velocity of propagation, $v_p$, are given by: $zo=\sqrt{Ln1/Cn1}$ and $v_p=1/\sqrt{Ln1*Cn1}$. Considering that the transmission line has the length 931, then its end to end time delay, $T_D$, is given by: $T_D=l_r/V_p$. When the transmission line is operated in its quarter wavelength frequency mode, $f_{0.25\lambda P}$, then: $f_{0.25\lambda}=1/4T_D$. Thus, displacement current magnetics has the dual benefit of creating a transmission line while improving the power density of its magnetic core.

For uniformly constructed circular toroids with uniformly inserted dielectric material both Cn and Ln are functions of the radial position, r, along the toroid's length, $l_r$. That is: $Cn(r) \propto r$, and $Ln(r) \propto 1/r$. The solution to a transmission line constructed with these radially varying parameters is a Bessel function that shows mathematically that the circular toroidal based transmission line can behave like a step up or step down transformer when its load, $Z_L$, matches the circular toroidal transmission line's characteristic output impedance, Zo(r).

The circular toroidal based transmission line behaves like a step up or step down transformer for either transient voltages, V(t), or steady state voltages, $V(f_o)$. The operational frequency ($f_o$) is the optimal frequency within the range of the device's operational quarter wavelength frequency, $f_{0.25\lambda}$.

Displacement Current Magnetics

Displacement current magnetics, hereafter also referred to as capacitance enhanced magnetics, include two enhancements within a magnetic core to increase the steady state power density of a device at its optimum operating frequency, $f_o$. First, capacitance enhanced magnetics reduce the required maximum magnetization current, $I_{Mx}(f_o)$, for the same maximum operating voltage, $V_{Mx}(f_o)$. Second, the displacement currents, $I_D(f_o)$ are used to favorably redistribute the device's magnetic flux density distribution curve, $B_{Mx}(r)$, to increase the device's PD. Capacitance enhanced magnetics provides a device increased power density at an optimum operating frequency ($f_o$). Displacement current magnetics also uses distributed capacitance to form a transmission line. The magnetic core of a displacement current magnetics device develops magnetic forces faster for a maximum transient voltage, $V_{Mx}(t)$ then a non-distributed capacitance device.

Figure 25:
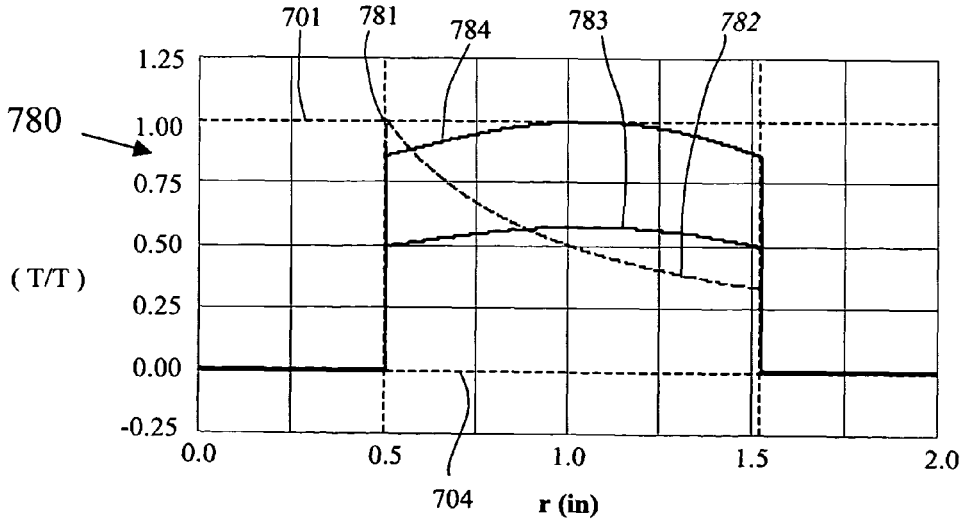
FIG. 25 is a graph showing normalized flux density curves for capacitance enhanced toroidal TWC devices.

FIG. 25 is a graph 780 that shows various flux density distribution curves which comparatively demonstrate the power density improvements obtainable from displacement current magnetics. An Amperian curve 782 is the maximum magnetic flux density distribution of any known circular toroidal magnetic core with an inner diameter radius, $r_{IDe}$ of 0.5 inches and an outer diameter radius, $r_{ODe}$ of 1.5 inches that provides the magnetic construction base for capacitor enhanced magnetic devices such as the external internal capacitance device 450 in FIGS. 9A and 9B; the external capacitance device 500 in FIGS. 10A and 10B; the external capacitance device 530 in FIGS. 11A and 11B; the external capacitance device 570 in FIGS. 12A and 12B; the internal capacitance device 600 in FIGS. 18A and 18B; and the internal capacitance device 620 in FIGS. 19A, 19B, and 19C. The curve 782 is the maximum Amperian flux density distribution, $B_{BMx}(r)$, of any toroid defined by the geometry of $r_{IDe}$ of 0.5 inches, because a flux density peak 781, at $r_{IDe}$ of 0.5 inches equals the Bsat curve 701. When distributed capacitance is appropriately added to the base core and the device is operated at optimum frequency, $f_o$, then the device exhibits a nearly flat line magnetic flux density distribution curve, shown as a curve 783. Comparing the curves 782 for a known toroid core and the curve 783 for the distributed capacitance core shows that the total flux, $\phi_T$, in the core, represented by the area under the curves 782 and 783, remains the same for the same maximum operating voltage, $V_{Mx}(f_o)$, applied to the device in either the absence or presence of the distributed capacitance. A curve 784 is the result of optimizing the power density of the device by reducing the magnetic core's strip width, $w_{Fe}$, such as the strip width 466 in the external capacitance device 450 in FIGS. 9A and 9B. Other examples of optimally minimized magnetic strip widths, $w_{Fe}$, include a strip width, $w_{Fe}$, 506 in the internal capacitance device 500 in FIGS. 10A and 10B; a strip width, $w_{Fe}$, 543 in the external capacitance device 530 in FIGS. 11A and 11B; and the strip width, $w_{Fe}$, 579 in the external capacitance device 570 in FIGS. 12A and 12B.

Displacement current magnetics may be applied to square core shapes as well as toroidal shapes. Both toroidal and square magnetic core shapes with appropriately distributed capacitance and inductance have unique end to end transfer functions, whereby the voltage initiated at one end of the device can be made to either increase or decrease at the other end of the device. For the case of the uniformly wound and distributed circular toroidal inductance and capacitance, a voltage impressed at the radius of inner diameter appears at the device's radius of outer diameter reduced by the device's geometry, similar to a non-isolated step down transformer. Correspondingly the current increases at the outer radius so that the electrical power at the outer radius equals the electrical power applied at the inner radius. Conversely a voltage impressed at the radius of outer diameter appears at the device's radius of inner diameter increased by the device's geometry similar to a non-isolated step up transformer. Correspondingly the current decreases at the inner radius so that the electrical power at the inner radius equals the electrical power applied at the outer radius.

A transmission line with end to end time length, $T_D$, driven by a step function transient voltage, V(t), contains the induced transient electrical energy equally in the line's electric and magnetic fields. In the transient excitation state the line's electric field energy is contained within the line's capacitance and is equal to the magnetic field energy contained in the line's magnetic core. If the volume of the capacitance is small compared to the volume of the magnetics, which is usually the case, then for all practical purposes the transient energy power density in the device has doubled compared to the same size core without the benefit of added capacitance. Consequently, magnetic forces develop faster for an applied step function voltage, V(t), during transient time interval, $T_D$, in an inductor modified with distributed capacitance compared to an unmodified inductor of the same inductance with the same applied step function voltage, V(t), during the same transient time interval, $T_D$.

Figure 26:
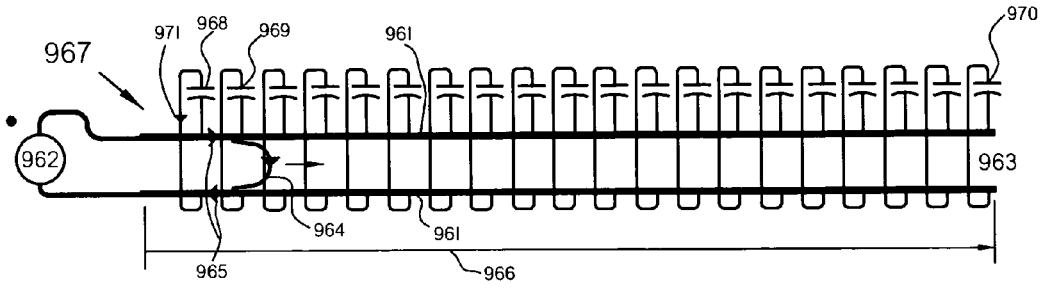
FIG. 26 is a diagram of an example rail gun.

The transient electromechanical benefit exhibited by a transmission line applies to all transmission lines regardless of the transmission line's power level, time length, $T_D$, size, or whether the transmission line's magnetic shape is straight or circular toroidal. The benefit arises because the distributed capacitance usefully increases and redistributes the magnetic flux density within time period, $T_D$. A capacitance enhanced rail gun 967 shown in FIG. 26 is a practical implementation of distributed capacitance that increases the Lorentz force propelling a projectile 964 down a set of muzzle rails 961. Those of ordinary skill in the art will recognize that distributed capacitance in the magnetic cores of electric motors, solenoids, relays, or other like designed electromechanical devices, enable these electromechanical devices to accelerate their mechanisms faster during transition time, $T_D$, while benefiting from increased power density in the steady state when operated at the device's optimum frequency, $f_o$.

Redirected Magnetic Flux Density A core modification method to improve a device's PD redirects the magnetic flux density. The magnetic flux density is redirected by changing the device's winding orientation. For example, a spiral wound air core 940 shown in FIGS. 7A and 7B increases its PD by being rewound as a radial wound toroidal AiC device. Similarly, planar core transformers and inductors, such as the device 941 in FIG. 6, may increase power density by being reconfigured as a toroidal device with radial windings instead. Consequently, the magnetic flux density direction is redirected from radial, r, to circumferential, θ, and simplifies the magnetics'geometry by using toroidal disks instead of planar pot cores. The radial conductors on the disk are wide and short, thereby lowering the resistive losses in the winding. The result is a more efficient packaging of the electromagnetic device and consequently better electrical performance. Redirected magnetic flux density is most useful to improve the PD of planar magnetics and very high frequency air cores. The internal capacitance enhanced device 600 in FIGS. 18A and 18B and the internal capacitance enhanced device 620 in FIGS. 19A, 19B and 19C are the an example construction for high frequency redirected magnetic flux density. Lower frequency of operation capacitance enhanced devices such as the device 450 in FIGS. 9A and 9B; the device 500 in FIGS. 10A and 10B; the device 530 in FIGS. 11A and 11B; and the device 570 in FIGS. 12A and 12B; are alternate redirected magnetic flux density constructions.

Redistributed Magnetic Devices

A magnetic device's Amperian flux density shape may be redistributed so as to increase the power density, without effecting the core's overall size and shape, by core bias current, core interlacing, and core corner smoothing. Flux density redirection may also be used but requires changing the shape of the core. Sectioning the magnetic core longitudinally along its magnetic path length, $l_e$, so that each sub-divided cross section is uniformly wide and magnetically isolated from each other, facilitates either bias current, interlacing, or smoothing to favorably redistribute the core's magnetic flux density to improve power density.

All magnetic devices are constructed with a magnetic core—more specifically an electro-magnetic(E-M) or permanent magnet (PM) core, or combinations thereof. As explained above, the core's construction may be one of four core construction categories or combinations including a Tape Wound core (TWC); a Laminated core (LaC); a solid block core (SBC) or an air or dielectric core (AiC). All four magnetic core constructions may be modified to improve power density by optimally redistributing radial magnetic flux density (B(r)) in the core.

The following transformer or inductor or magnetic cores for transformer and inductor devices illustrate the ability to redistribute magnetic flux density within their magnetic cores, regardless of magnetic core construction, to improve the power density of the devices. Those of ordinary skill in the art will understand that the core modifications herein may be applied to other E-M or PM devices such as electric motors, electric generators, solenoids, relays, delay lines, and rail guns.

Magnetic flux density redistribution is first described for core bias currents in a TWC. The magnetic flux density redistribution will then be described using core bias currents in the LaC along the straight sections and corner sections. A description follows of passive magnetic flux density redistribution in the mechanically interlaced magnetic core. Next capacitance is distributed within the core in a series of different distribution constructions so that the capacitor's displacement currents create a frequency selective core bias current that favorably redistributes magnetic flux density. Finally, capacitance enhanced magnetics is discussed to favorably redirect magnetic flux density in magnetic cores.

Tape Wound Core (TWC)

The magnetic tape wound core (TWC) was developed to overcome the permeability loss due to the magnetic gap in a square core. An example circular magnetic tape wound core is shown as a toroidal transformer 150 in FIGS. 3A-3B. The TWC is typically constructed by a continuously winding fixed width, $w_{Fe}$, magnetic ferrous foil 109 having a thickness typically from 0.6 mils to 14 mils, around a circular inner hub thereby forming a circular toroidal core. A square toroidal core is constructed by winding the foil around a square hub. The circular inner hub forms a toroid winding window 108 with an effective inner diameter radius, $r_{IDe}$, 113 inches which is the open inner diameter area of the toroidal core after the winding hub is removed. The magnetic foil 109 is continuously tape wound around the inner hub until the winding reaches the prescribed effective outer diameter radius, $r_{ODe}$. The winding window 108 is sized to pass the primary windings 102 and secondary windings 103. The TWC transformers have a primary input voltage 104, which is electrically connected to the primary windings 102 and a secondary output voltage 105 which is electrically developed at the secondary windings 103. "Tape winding" strains the magnetic foil and, consequently, causes the foil's magnetic permeability to decrease by as much as 50% or more. The permeability can be restored by heat treating (annealing) the tape wound core.

The magnetic foil 109 is conductive and is coated with a very thin insulative material 101 that inhibits layer to layer eddy currents in the tape wound core. The thin insulative material 101 along with the layer to layer air gap magnetically isolates adjacent concentric magnetic foil layers thereby intrinsically contributing to a longitudinal magnetic isolation which is formed by an interface layer spacing 110 required for magnetic flux redistribution caused by core bias currents. The longitudinal magnetic isolation is the interface layer spacing between adjacent magnetic layers. The interface layer spacing 110 is the summation of the thickness of the insulative coating 101 and the effective air gap between the adjacent magnetic layers.

After the TWC is annealed, a thin insulator layer 111 is applied to cover the surface of the core to prevent the core's primary winding 102 and the secondary winding, 103 from abrading and electrically shorting to the conductive core. The primary and secondary windings 102 and 103 are usually applied by a "shuttle" winding machine. After the wires of the primary and secondary windings 102 and 103, are applied, an optional thin insulation layer similar to insulator layer 111 may be wrapped around all the finished magnet wire winding.

The TWC has a closed shape that initially allowed only hand winding of the magnetic coils. Later, machines were designed to apply the windings. Special coil winding machines, called shuttle winders, were designed and built to automatically put high current magnetic wire windings on the closed toroidal cores. Without the need for lateral sectioning, as required by the lamination core, LaC, this core construction realizes the magnetic material's full magnetic permeability (μ). The toroidal TWC core is used as an alternate to square core construction of transformers and inductors.

A superior shape for conventionally designed TWC magnetics which maximally utilizes core material, is the high profile shape, where the magnetic foil's width, $w_{Fe}$, is set at a practical maximum to accommodate the coil winding machines. The high profile TWC shape utilizes more of the magnetic material's core for the same device power rating, relative to a low profile conventionally designed TWC of the same device power rating. Thus, an example high profile shaped TWC transformer 100 shown in FIGS. 4A, 4B and 4C is a magnetically efficient toroidal shape.

The high profile shaped TWC transformer 100 in FIGS. 4A, 4B and 4C, using the techniques described herein allows easier packaging in low profile environments such as multiple closely stacked printed circuit boards or laptop computers while maintaining the efficient magnetic utilization of the high profile TWC in the low profile shape.

Toroid, Tape Wound Core (TWC) with Core Bias Current

Tape wound core magnetics may be used to construct transformers, inductors and special solenoids and relays. These cores may be continuously wound and either left uncut, or laterally cut across the core so as to decrease the core's effective magnetic permeability, $\mu_{eff}$, and thereby increase the maximum magnetizing current, $I_{Mx}(f)$, required for core saturation. For either core cut construction, core bias currents may be used to favorably redistribute its magnetic flux density.

The features and benefits of core bias currents may be applied for the high profile and low profile TWC shapes. Known conventional TWCs use the high profile shape because the Amperian magnetic flux density distribution becomes flatter as the height of the profile increases. But as the conventional Amperian magnetic flux density becomes flatter with increasing core height or slit width, the core becomes more difficult to construct and undesirable to package with low profile components. In contrast, the low profile transformer has the best packaging silhouette but the most inefficient use of magnetic material. Redistributed magnetic flux density allows use of high profile power density for the low profile TWC constructed toroidal transformers.

Toroid, High Profile Tape Wound Core with Self Bias Current

The transformer 100 in FIGS. 4A, 4B and 4C includes a high profile, modified, TWC 106. The TWC 106 includes a core self bias current that allows the core 106 to operate at the maximum flux density distribution as shown by the $B_{BMx}(r)$ curve 703 in FIG. 21. Referring to FIG. 4B, the TWC 106 is defined by a height, $w_{Fe}$ an effective radius of inner diameter, $r_{IDe}$, 113 and an effective radius of outer diameter, $r_{ODe}$, 114. The curve 703 supports about 25% more voltage, $V_{Mx}(f)$, at the same maximum load current, $I_{Lx}(f)$, compared to the core 106 operating without core bias current. The maximum flux density, $B_{Mx}(f)$, that the core 106 can operate at without core bias current is shown by the curve 702 in FIG. 21. The power density improvement of the core 106 in the transformer 100 with core bias current over the same transformer operating without bias current is the percent areal difference between the curves 703 and 702 in FIG. 21 between $r_{IDe}$, 113 at 1.37 inches and the $r_{Ode}$ 114 at 2.36 inches.

A self bias current wiring circuit 121 carries a self bias current 122 through the core 106 by three passages 130, 131 and 132 at equally spaced radii 118, 119 and 120. The radii 118, 119 and 120 are each located at the nearest convenient TWC layer interface 110 between the $r_{IDe}$ 113 and the $r_{ODe}$ 114. The passages 130, 131 and 132 each accommodate two bias current wires of the bias current wiring 121. The three bias current passages 130, 131 and 132 divide the cross section width of the core 106 into four equal magnetic cross sections 123, 124, 125, and 126. The self bias wiring scheme is in the right half of the core 106 as shown in cross-section in FIG. 4B.

FIG. 4C shows a bottom view of the self bias wiring scheme 121 used in the transformer 100. The self bias current wiring 121 is wound such that the voltage induced by the time changing magnetic flux in the core 106 into the self bias current wiring 121 around the under utilized sections of core sections 125 and 126 is equal to the voltage induced into the self bias current wiring 121 around over utilized core sections 123 and 124, when the flux density is equally distributed. The voltages oppose each other but null when the voltages generate a self bias current 122. The self bias current 122 develops to support the redistributed magnetic flux density when the primary voltage 104 is applied to the primary wiring 102. The primary voltage 104 is derived from a very low impedance voltage source.

The self bias current wiring 121 winds through the four equally wide magnetic cross sections 123, 124, 125 and 126. Starting at the interior radius $r_{IDe}$ 113, the winding 121 goes up and around the section 123, through the passage 130, and returns to the interior, winding window 108 at the radius $r_{IDe}$ 113, then continues up through the interior radius 113, and around the sections 123 and 124, down through the passage 131, returning again to the interior radius 113. The wiring 121 continues to proceed up through the interior radius 113 and around the sections 123, 124, and 125, down through the passage 132 and returns to the exterior radius, $r_{ODe}$, 114. The wiring 121 continues up through the exterior radius 114, around the section 126, then down through the passage 132, after which it returns to the exterior radius 114. The winding 121 proceeds up the exterior radius 114, around the sections 125 and 126, down through the passage 131 and returns to the exterior radius 114. The winding 121 continues to proceed up the exterior radius 114 around the sections 124, 125 and 126, down through the passage 130 where it connects to the start of the bias current winding 121 returning to the interior radius, $r_{IDe}$ 113, thereby completing the winding circuit 121 for the self bias current 122.

The maximum core bias current flux density distribution, $B_{BMx}(r)$ of the transformer 100 is shown by the curve 703 in FIG. 21. The radii 118, 119 and 120, are equally spaced between $r_{IDe}$ 113 and the $r_{ODe}$ 114, so that the curve 703 has a peak flux density points 705 at the radius 113; a peak flux density point 706 at the radius 118; a peak flux density point 707 at the radius 119; and a peak flux density point 708 at the radius 120. The peak flux density points 705-708 are all equal to Bsat, and touch the horizontal dashed line 701, representing Bsat. The peak flux density points 705, 706, 707 and 708 are shown as flux vector arrows 107 in FIG. 4A.

Magnetic permeability, μ, in practical magnetic material is very non-linear, but maximizes when the magnetic material's maximum operating magnetic flux density distribution, $BM_M$ (r) is at or near the maximum value, $B_{Mx}$(r). Maximum core bias current flux density distribution, $B_{BMx}$(r), operates a core's maximum flux density distribution at or near the peak value of magnetic permeability, μ. The bias current flux density distribution, $B_{BMx}$(r) shown by the curve 703 in FIG. 21 for the core 106 is an example of optimally using a magnetic core at its peak magnetic permeability, μ.

The maximum flux density distribution is shown by the flux vector arrows 107 in the magnetic sections 123, 124, 125 and 126 in FIG. 4A. In FIG. 4B, the flux vectors are all of equal magnitude, Bsat, and are identified as a set of vector tails 128 and a set of vector points 127 in the magnetic sections 123, 124, 125 and 126. The maximum operational magnetic flux distribution, $B_{Mx}$(f,r), is generated by the maximum magnetizing current 116 flowing to the right in the primary wiring 102. In FIG. 4A the magnetic flux vectors are shown, by the "right hand rule" as directed clockwise of equal width and length, symbolizing equal maximum magnetic flux density in each magnetic section throughout the core. By the "right hand" rule, the flux vectors 128 are directed into the page on the left side of the center line 115 and the flux vectors 127 are directed out of the page on the right side of the center line 115. In FIG. 4B, the peak magnitude of the magnetic flux density in each magnetic section 123-126 is Bsat and is coarsely indicated by the cross section of three flux lines, flux vector points 127 and the flux vector tails 128 in the magnetic sections 123, 124, 125 and 126.

Toroid, Low Profile Tape Wound Core with Tapped Bias Current

The low profile toroidal transformer 150 shown in FIGS. 3A and 3B demonstrates improved PD, about double over a known toroidal transformer, by utilizing a tapped bias current 161 through a tapped bias current wiring 159 through a core 152. A transformer core that supports the same maximum voltage, $V_{Mx}$(f), and maximum load current, $I_{Lx}$(f), at the same profile height as a height $W_{Fe}$ of the transformer 150 requires its $r_{IDe}$ to be the same as the $r_{IDe}$ 113 of the transformer 150 but the core $r_{ODe}$ of the known transformer would have to be much bigger than the $r_{ODe}$ 154 of the transformer 150.

The graph 750 in FIG. 20 comparatively shows the flux density distribution curve 752 for the toroid transformer 150 in FIGS. 3A-3B with three core passages using the bias current 161, against the flux density distribution curve 751 for a known toroidal transformer with the same core height as the core height $w_{Fe}$, of the transformer 150 without any bias current, but requires a larger $r_{Ode}$, to support the same $V_{Mx}$(f). The area under the curve 752 is equal to the area under the curve 751, which, by Faraday's Law, enables both transformers to support the same $V_{Mx}$(f) for the same core height, $w_{Fe}$.

A tapped bias current wiring 159 is passed through a TWC 152 used by the transformer 150. The tapped bias current wiring 159 starts at an appropriate tap 151 and continues along the primary winding 102, which provides a bias voltage 160 ($V_B$(f)) that drives the tapped bias current 161 in the bias current wiring 159. The current wiring is threaded through a passage 163, set at a radius 156; a passage 164 set at a radius 157; and a passage 165, set at a radius 158. The three bias current passages 163, 164 and 165 are located, respectively, at radii 156, 157 and 158, and divide the cross section width of the core 152 into four equal magnetic cross sections 123, 124, 125, and 126. The bias current wiring 159 returns to the low side of the primary voltage 104.

The maximum flux density distribution, $B_{BMx}$(r), is shown by the curve 752 in FIG. 20. The radii 156, 157 and 158 are set equally spaced between the $r_{IDe}$ 113 and the $r_{ODe}$ 154 so that a sawtooth peak flux density point 753 at the radius 113; a flux density point 754 at the radius 156; a flux density point 755 at the radius 157; and a flux density point 756 at the radius 158 are all equal to Bsat, and touch the horizontal dashed line 701, representing Bsat.

The curve 752 shows the bias current flux density distribution, $B_{BMx}$(r) in FIG. 20 for the core 152 of the transformer 150. The flux density distribution is an example of optimally using a magnetic core at its peak magnetic permeability, μ.

The pictorial representation of the maximum flux density distribution is shown in the low profile modified TWC 152 in FIG. 3A by the flux vector arrows 107 in the magnetic sections 123, 124, 125 and 126. In FIG. 3B, the flux vectors are all of equal magnitude, Bsat, and are identified as the vector tails 128 and the vector points 127 in the magnetic sections 123, 124, 125 and 126. The maximum operational magnetic flux distribution, $B_{Mx}$(f,r) is generated by the maximum magnetizing current 116 flowing to the right in the primary wiring 102. In FIG. 3A, the magnetic flux vectors are shown by the "right hand rule", as directed clockwise of equal width and length, symbolizing equal maximum magnetic flux density in each magnetic section throughout the core. By the "right hand" rule, the flux vectors 128 are directed into the page on the left side of the center line 115 and the flux vectors 127 are directed out of the page on the right side of the center line 115. In FIG. 3B, the peak magnitude of the magnetic flux density in each magnetic section is Bsat and is coarsely indicated by the cross section of the two flux lines in the magnetic sections 123, 124, 125 and 126.

The preceding examples illustrate the PD improvements in high profile and low profile TWCs when their cores are provided with core bias currents—either self bias or tapped bias currents. Specifically, the low profile, tapped bias current TWC transformer 150, safely supports the same voltage and current, (120 VAC at 4 Amps, 60 Hz in this example) as a high profile TWC transformer without bias current. The transformer 150 without core bias current would only safely support 85 VAC at 4 Amps, 60 Hz in this example.

Core bias currents in low profile transformer cores more fully utilize the device's magnetics and thereby require less magnetic material to construct the core. The lower the TWC profile, the higher the percentage of obtainable core PD improvement, which illustrates how core bias currents may enhance the efficient design of low profile magnetic parts. Consequently, core bias currents allow a package designer to readily design low profile parts without bulk and weight considerations required by a conventional low profile design.

The more passages that a tape wound core's cross section can accommodate, the more power density improvement that the design can realize. However, additional passages after three or four passages result in percentage improvements of 3% or less per added passage, depending on core geometry. The passages 163, 164 and 165 are formed by the insertion of spacer pins 129 during the tape winding process. The thickness of the spacer pins 129 and thus the passages 163, 164 and 165 allows the bias current magnet wire 159 to easily, but snugly, pass through the core 152. The cross section of the bias current wire 159 may be of a different shape such as round, square, or thin ribbon, as required. The passages for tapped bias magnetics and self bias magnetics may be used interchangeably with the same core modifications as long as the passage widths accommodate the worst case bias current wiring width requirements.

Figure 27:
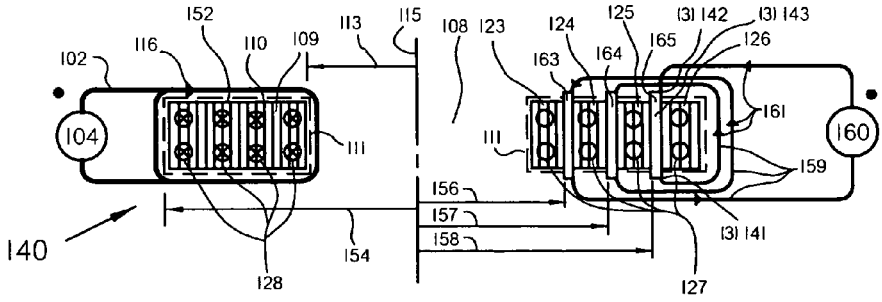
FIG. 27 is a cross-sectional view of a low profile, toroidal transformer with a primary tap bias current.

An alternate tapped bias current wiring design to the tapped bias current wiring shown in transformer 150 in FIGS. 3A and 3B is shown in a cross-sectional view of a transformer 140 in FIG. 27. The alternate wiring uses the conductive tape winding core material 109 which forms as the passages 163, 164, and 165, extended at the radial points 156, 157 and 158 to accommodate a set of top electrical contacts 142 and a set of bottom electrical contacts 141 that pass the bias current 161 through the core 152. The bias current wiring 159 is attached to the electrical contacts 142 and 141 as shown in FIG. 27. Other than the extension of the conductive foil at the radial points 156, 157 and 158, the core 152 of transformer 140 is the same size and material as the core 152 of the transformer 150 in FIGS. 3A-3B. Similar to the transformer 150, the radial points 156, 157 and 158 divide the cross section of the TWC 152 into four sections 123, 124, 125 and 126. The flux density distribution vectors 128 and 127 in FIG. 27 are distributed across the core 152 the same as flux vectors 128 and 127 in FIG. 3B. The radial spacing in the core 152 of the transformer 140 is the same as that used for the bias current passages 163, 164 and 165 in the transformer core 152 of the transformer 150 in FIG. 3B.

This alternate bias current scheme shown in the transformer 140 takes advantage of the relative conductive geometry of the core's foil. The conductivity between the top and bottom connections 142 and 141 is much higher than the conductivity between adjacent through the core tape winding foils 109 because the contact resistance between adjacent layers is very high and the geometry of the resistance along the tape winding path is also very high relative to the resistance between the top and bottom connections 142 and 141. Consequently, most of the bias current flows through the core 152 between the top and bottom connections 142 and 141, vertically through the tape winding foil 109 rather than horizontally between adjacent tape winding foil layers 109 thereby maintaining the flux density redistribution effect of the tapped bias current 161 in the tapped bias current wiring 159.

Another alternative bias current wiring design uses either insulated or uninsulated copper strips 143 shown in the transformer 140 without spacer pins, co-wound as bias current conductors inserted at the bias current passages 163, 164, and 165 located at the appropriate radii 156, 157 and 158 within the TWC 152. While the cross section of the toroidal core modified for core bias current is shown divided into equal sections for best power distribution in FIGS. 3A and 3B, different radial distributions of the core's bias current passages may be considered. Besides being used for optimizing power density distribution, the radial spacing could be considered for some other core characteristic such as "soft magnetic saturation," whereby the core eases into magnetic saturation.

Ultra Low Profile Toroidal Inductor with Self Bias Current

Figure 28A:
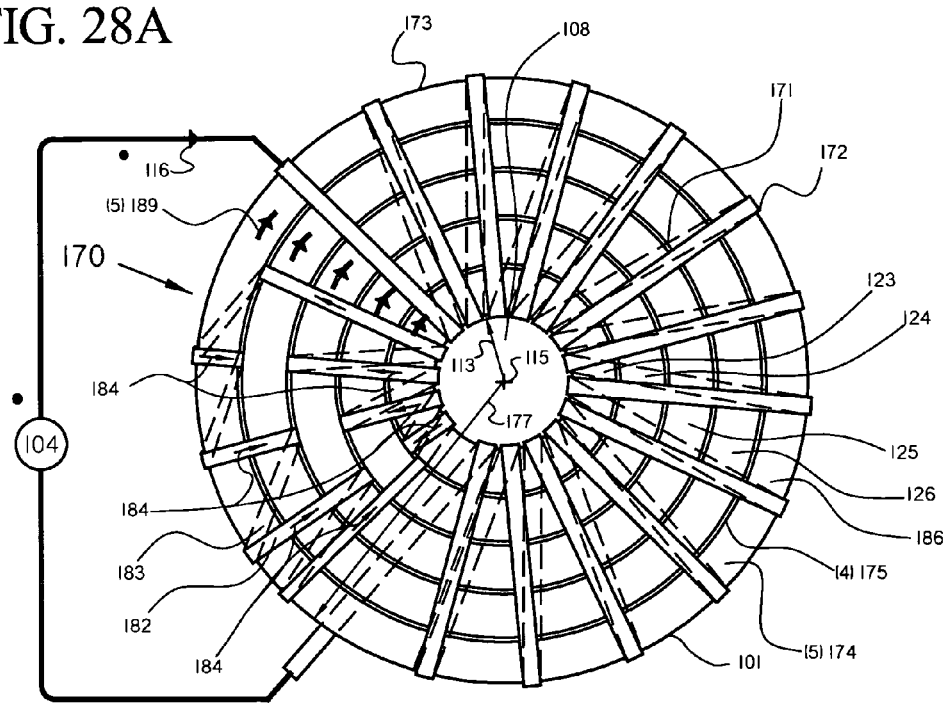
FIG. 28A is a top view of an ultra low profile, flat foil core, toroidal inductor.
Figure 28B:
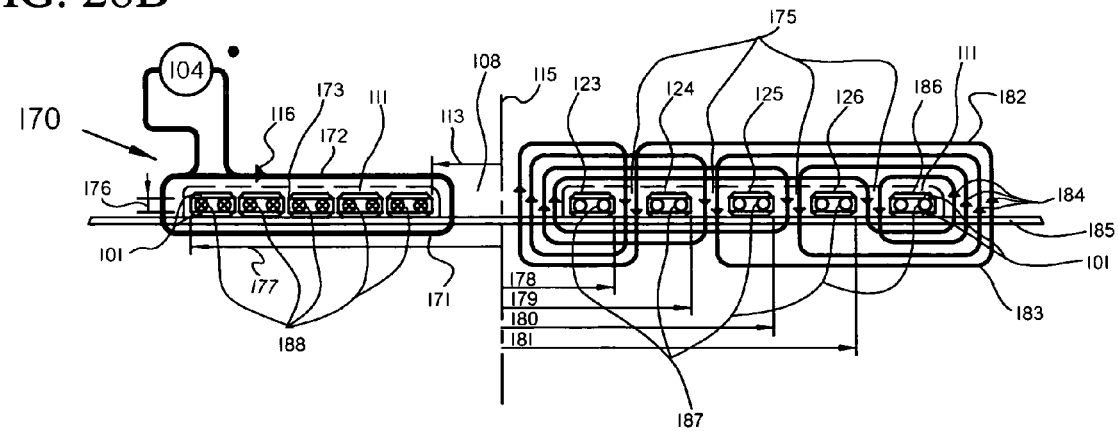
FIG. 28B is cross-sectional view of the toroidal inductor of FIG. 28A.

An ultra low profile inductor 170 is shown in FIGS. 28A and 28B is constructed with a very thin core height, $w_{Fe}$, 176 but has a required cross sectional area, $A_C$, with a very large $r_{ODe}$ relative to the $r_{IDe}$. The core height 176 is a thin lamination layer, LaC, which may be inlaid in printed circuit boards or in a device's molded housing. The ultra low profile inductor 170 may be used for toroidal transformer or inductor cores as well as low profile square core transformers and unique motor, generator, relay or solenoid constructions.

The conventional ultra low profile inductor has a magnetic core that consists of either a single thin magnetic foil, LaC, or a thin deposition of magnetic material such as Manganese Zinc (MnZn) and Nickel Zinc (NiZn) ferrite on a substrate. In general, the magnetic material in conventional electromagnetic cores is not fully utilized. As the radius of the outer diameter, $r_{ODe}$, increases with respect to the radius of the inner diameter, $r_{IDe}$, the under-utilization of the magnetic core increases. Consequently, conventional low profile designs, and in particular conventional ultra low profile designs, have been avoided. Bias current magnetics improves the magnetic utilization of the magnetic core increasing the PD by a factor of two or better over a conventional ultra low profile transformer core design.

The ultra-low profile toroidal inductor 170 uses self bias current magnetics to optimize the magnetic flux distribution in the thin magnetic foil core 173. The toroidal inductor 170 includes an inductor winding 172 and 171 and a self bias current winding 182 and 183. FIG. 28A shows the top view of the inductor winding 172 as a solid line and the bottom view of the winding 171 as a dashed hidden line. FIG. 28A also shows the top view of the self bias current winding 182 as a solid line and the bottom view of the self bias current winding 183 as a dashed hidden line. The core 173 is radially sectioned into five equally wide concentric magnetic foil rings 109. Each ring 109 is identified from the inner radius $r_{IDe}$ 113 outward as foil rings 123, 124, 125, 126 and 186, located between the inner radius and the outer radius, $r_{ODe}$ 177. The foil rings 123, 124, 125, 126 and 186 are physically separated and magnetically isolated from each other, by four interface gaps 175, at radial points 178, 179, 180 and 181 so that the magnetic permeability, μ, spatial components can fulfill the bias current requirement $\mu_{R\theta} \approx \mu_{Rz} >> \mu_{Rr}$, or, $\mu_{R\theta} >> \mu_{Rz} \approx \mu_{Rr}$.

The thin magnetic core 173 may be deposited or placed either in one layer of a multi-layer printed circuit board (PCB) or deposited in one layer of integrated circuit (IC) strata. The bottom of the thin magnetic core 173 is layered upon an insulation material 185 upon which PCB or IC interconnect conductors may be placed or deposited for the primary wiring 172 and 171 and the bias current wiring 182 and 183. A self bias current 184 flows through the bias current wiring 182 and 183 on the top and bottom of the inductor 170. The self bias wiring 182 and 183 is threaded around each of the concentric foil rings 123, 124, 125, 126 and 186 each having bias current wiring passages located at radii 178, 179, 180 and 181 as shown in the right half of FIG. 28B.

Ultra low profile designs using thin magnetic foil offer the packaging flexibility to fold the core in halves or quarters, or more, to reduce the required mounting surface area. The foil rings, 123, 124, 125, 126 and 186 may have one connecting strip mechanically holding them in position without effecting the modified flux density distribution. Ultra low profile ferrite depositions may also be used on surfaces with complex shapes.

The PD improvement caused by redistributed magnetic flux density increases as the height, or magnetic strip width, $w_{Fe}$, decreases. The core 173 may be reduced to a single magnetic foil or the thinnest magnetic core deposition. Bias current magnetics then optimizes the magnetic utilization of the core.

A self bias current, $I_{Bx}(f)$, 184 interacts with the magnetizing current, $I_{Mx}(f)$, 116 so that five peak flux density vectors 189 in the cross section of the core 173 are of equal width and hence, equal in magnitude, Bsat, and directed by the "right hand" rule applied to the magnetizing current generated in the primary winding 172 and 171. In FIG. 28B, the cross section of the sectional flux vectors 189 are, by the "right hand" rule, directed into the page, the tails, on the left side of the center line 115, and then directed out of the page, the points, on the right side of center line. In each magnetic section defined by the foil rings 123, 124, 125, 126 and 186 the peak flux density, Bsat, is pictured by the cross section of magnetic flux tails 188 and magnetic flux points 187.

Figure 29:
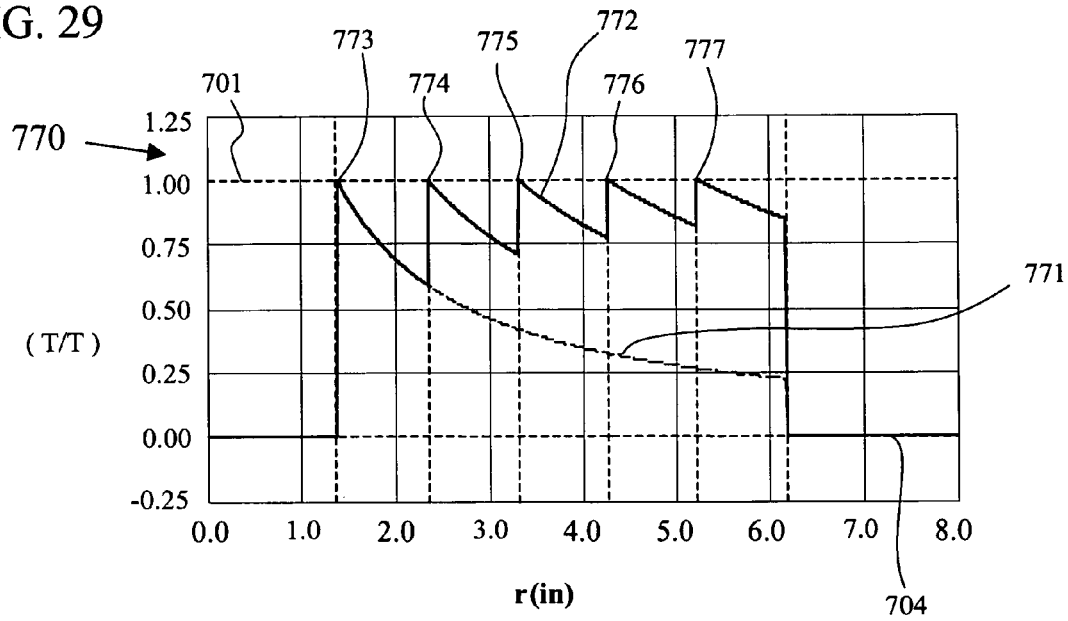
FIG. 29 is a graph comparing a normalized flux density curve for the ultra low profile, self bias, toroid inductor of FIGS. 28A and 28B to a curve for a known ultra low profile toroid inductor without magnetic flux density redistribution.

FIG. 29 is a graph 770 of flux density distribution which includes a curve 771 which represents the flux density distribution of the inductor 170 without self bias current. A curve 772 shows the redistributed flux density, $B_{BMx}(r)$, caused by the self bias current 184. The radii set equally spaced at 2.33 inches, 3.29 inches, 4.25 inches and 5.21 inches between the $r_{IDe}$ 113 at 1.37 inches and the $r_{ODe}$, 177 of 6.17 inches. The curve 772 is a sawtooth shape with a peak flux density point 773 at a radius 1.37 inches, a peak flux density point 774 at a radius of 2.33 inches, a peak flux density point 775 at a radius of 3.29 inches, a peak flux density point 776 at a radius of 4.25 inches and a peak flux density point 777 at a radius of 5.21 inches. The peak flux density points 773-777 are all equal to Bsat, and touch the horizontal dashed line 701, representing Bsat. The area difference between the curves 771 and 772 represents the PD improvement caused by the self bias current 184. In this example, the area difference between the curves 771 and 772 is 105%.

The bias current flux density distribution, $B_{BMx}(r)$, curve 772 for the core 173 is an example of optimally using a magnetic core at its peak magnetic permeability, μ. Consequently, a non-linear magnetic permeability, μ, may increase the practical value of the power density improvement beyond 105%.

Square Core, Lamination Core (LaC) with Core Bias Current

Lamination core (LaC) magnetics may be used to construct transformers, inductors, stators and rotors in electric motors and generators, solenoids, and relays. These cores may consist of stacked precut flat magnetic sheets usually shaped into "E" and "I" sections, for inductors and transformers, that allow easy assembly of their magnetic coils, pre-wound on bobbins, onto magnetic sections—usually the center leg of the "E." The "E" and "I" sections come together during assembly to close the magnetic path, but leave a gap at the interface of the "E" and "I" section that decreases the core's effective magnetic permeability, $\mu_{eff}$, and thereby increases the maximum magnetizing current, $I_{Mx}(f)$, required for core saturation.

Square core magnetics provides two opportunities to use redistributed magnetic flux density to improve power density. The first opportunity comes from redistributing the flux density in straight sections using core bias currents, similar to the techniques employed for the toroid transformer. The second opportunity redistributes the flux density at the corners of the core. Although the flux redistribution of the straight sections usefully effects the corner distribution, the corner redistribution may be independently adjusted to increase PD without effecting the flux density distribution in the straight sections. All flux density redistribution techniques are designed to increase the power density in the devices.

The following sections first describe the lamination and the lamination modifications for magnetic flux redistribution. The modified lamination sections are stacked to form laminated cores for high profile and low profile square core transformer shapes that have their magnetic flux density profiles modified, respectively, by tapped bias current and self bias current.

Square Core Transformer Construction

Figure 30A:
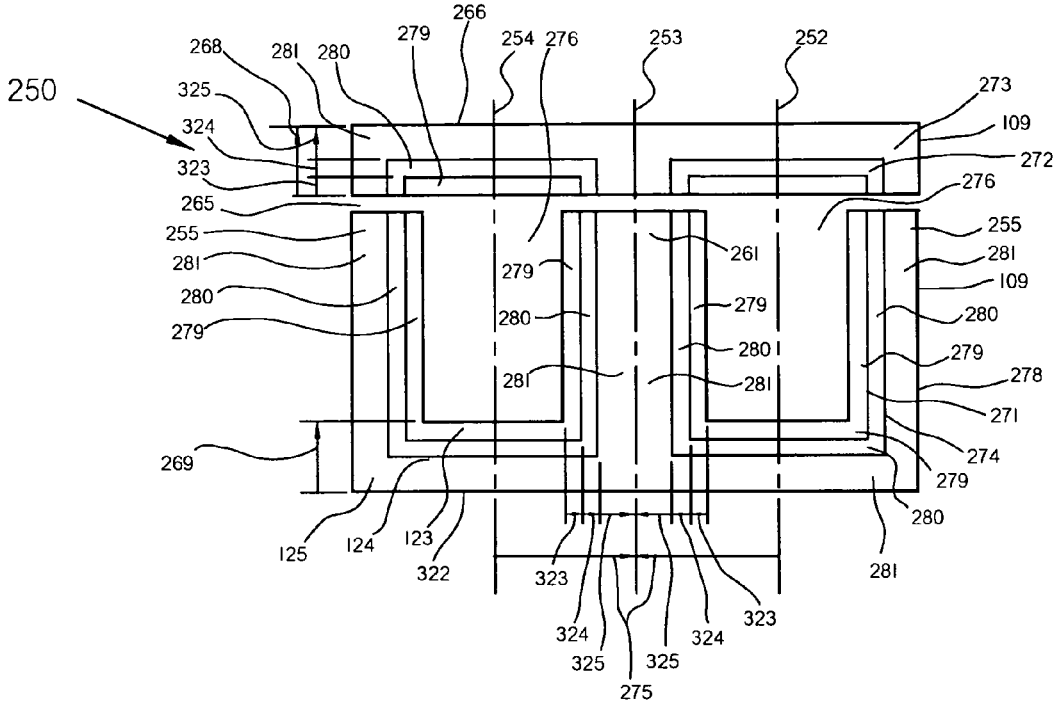
FIG. 30A is a top view of an "E" & "I" lamination with longitudinal slits.
Figure 30B:
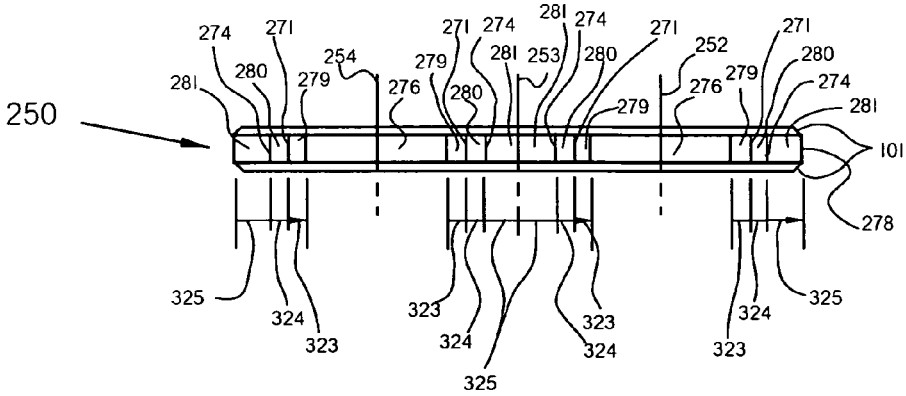
FIG. 30B is a cross-sectional view of the "E" & "I" lamination of FIG. 30A.

The core modifications used to redistribute magnetic flux density, B(r), by core bias current, $I_B(f)$, are shown for a low profile square core inductor 290 in FIGS. 1A and 1B and a high profile square core inductor 310 in FIGS. 2A and 2B. In both FIGS. 1A-1B and 2A-2B identical parts have identical reference numbers. FIGS. 30A and 30B show an "E-I" lamination section 250 constructed with magnetic material which includes an "I" shaped part 266 and an "E" shaped part 278. The "E" part 278 includes a spine 322, outer legs 255 and a center leg 261. The outer legs 255 have a width which is the same as a width of the "I" part 266 and a width of the spine 269. The overall length of the "E-I" section 250 and the length of the legs 255 and 261 varies with the finished device requirements. The width of the center leg 261 is typically twice the width of the outer legs 255 and is equally divided by a center line 253. The winding window opening 276 has a length and a width that is equally divided by centerlines 252 and 254. The thickness of the lamination section 250 in this example can vary from 0.5 mils to 25 mils or greater. Both the "E" and "I" parts 266 and 278 are coated with an insulative layer 101 that inhibits heat producing eddy currents from forming in adjacent stacked lamination pieces. The coplanar stacking and closure of the "E" and "I" parts 266 and 278 form a gap 265 between the parts 266 and 278.

The lamination section 250 includes two longitudinal cut slits 271 and 274 which radially subdivide the lamination section 250 into three sections 279, 280 and 281 of equal width. The width of section 281 is twice the width of either section 279 or 280.

The modified lamination section 250 may be either butt stacked or overlap stacked until the stack reaches a required magnetic height for the core 302 used in the low profile, redistributed flux density inductor 290 in FIGS. 1A and 1B, or the required magnetic height for the core 328 used in the high profile, redistributed flux density inductor 310 in FIGS. 2A and 2B. The lamination longitudinal slitting 271 and 274 as shown in FIG. 2A completely severs the sections which then requires an auxiliary handling system for the pieces. Alternatively, the slitting process may leave each section with one magnetic material connection with adjacent sections that keeps the lamination integrity for handling the lamination pieces. The slitting process may also leave each section with two or more magnetic material connections with adjacent sections, such as the section 294 in the inductor 290 that keeps the handling integrity of the lamination pieces. A double material keeper may also be used at other points along the slits 271 and 274.

The inductor wire winding 102 is usually pre-wound by a winding machine on a nonconductive bobbin. The "E" shaped lamination sections 278 are inserted and stacked in the center of the bobbin to complete the assembly. A core winding window opening 276 is formed by the closure of the "E" shaped sections 278 and the "I" shaped sections 266 and limits the total cross sectional area, $A_C$, of the inductor winding 102 that may be used in the winding window 276 contained by the outside width and length. After the inductor winding 102 is applied, a thin insulative layer 111 may be wrapped around all the finished magnet wire winding.

It is to be understood that one longitudinal slit may be used in place of the double slits 271 and 274 on the lamination section 250 described above. Similar to the criteria for the number of passages in the toroid transformer core, the more slits in the laminations, the better the power density improvement. However, a simpler one slit, two wire, bias current modification may sufficiently redistribute magnetic flux density for some applications.

Square Core, High Profile Laminated Core, LaC, with Tapped Bias Current

FIGS. 2A-2B show a high profile inductor 310 having a laminated core 328 having a tapped bias current wiring 312 carrying a tapped bias current 316. The tapped bias current wiring 312 is a single conductor winding through a notched passage 327 located along a longitudinal slit 274 spaced from a center line 252 or 254 of dual winding windows 276. A tapped bias current wiring 313 carries a tapped bias current 317 through the core 328 by a single conductor through a notched passage 326 located along the longitudinal slit 271, spaced from the center lines 252 and 254 of the dual winding windows 276. The slit 274 longitudinally bisects the outer legs 255 and spline 322 of the "E" section 278 as well as the "I" section 266. The slit 271 longitudinally bisects the inner half of the outer legs 255 and spline 322 of the "E" section 278 and the "I" section 266.

The tapped bias wiring scheme is shown in the right half of FIG. 2B. The tapped bias current wiring 312 starts at an appropriately selected tap 151 along the primary winding 102 which provides a bias voltage 314 to drive the tapped bias current 316 through the tapped bias current wiring circuit 312. The tapped bias current wiring 314 starts at a tap 311 along the primary winding 102 which provides a bias voltage 315 to drive the tapped bias current 317 through the tapped bias current wiring 313.

Figure 23:
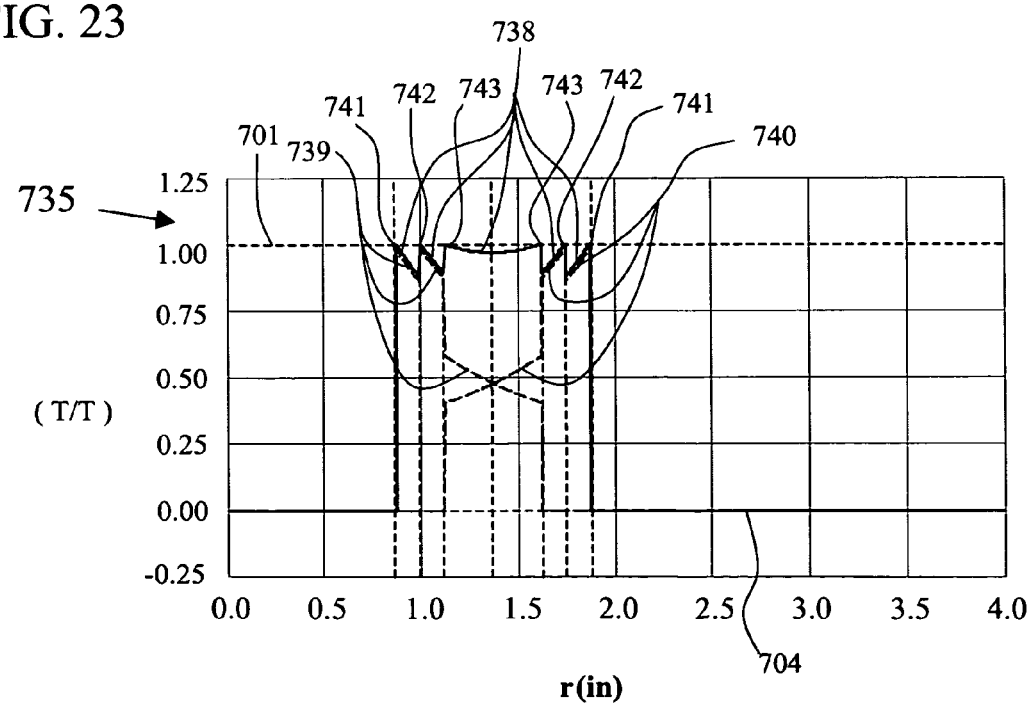
FIG. 23 is a graph showing a normalized flux density distribution curve of the inductor of FIGS. 2A and 2B.

The current flux density distribution, $B_{BMx}(r)$, of the core 328 in FIGS. 2A and 2B is shown as a curve 738 of a graph 735 in FIG. 23. The graph 735 uses toroidal equivalent radial distribution for its abscissa. A first abscissa point at 0.86 inches is a toroidal equivalent of the radius of equivalent inner diameter, $r_{IDe}$ of the core 328. A second abscissa point at 1.36 inches is a toroidal equivalent of the radius of equivalent outer diameter, $r_{ODe}$. Abscissa spacings between the abscissa points at 0.86 inches and at 1.36 inches correspond to the spacings 323, 324 (0.13 inches in this example) and 325 (0.25 inches in this example) in the inductor 310 in FIG. 2A. The curve 738 is a sawtooth shape having a peak flux density point 741 at a radius of 0.86 inches; a peak flux density point 742 at a radius of 0.99 inches; and a peak flux density point 743 at a radius of 1.11 inches. The peak flux density points 741-743 are all equal to Bsat, and touch the horizontal dashed line 701, representing Bsat, showing optimal distribution.

The curve 738 in FIG. 23 is the summation of a curve 739 and a curve 740. The curve 739 is the maximum flux density imposed in the center leg 261 of high profile E-I inductor 310 in FIGS. 2A and 2B by the magnetizing current, $I_{Mx}(f)$, flowing in the winding window 276 to the left of the center leg 261. The curve 740 is the maximum flux density imposed in the center leg 261 by magnetizing current flowing in the winding window 276 to the right of the center leg 261. Bias current flux density distribution used in the inductor 310 is an example of optimally using a magnetic core at its peak magnetic permeability, μ.

Square Core, Low Profile Laminated Core, with Self Bias Current

The low profile transformer 290 has a laminated core 302 having a self bias current wiring 291 passing a self bias current 292 through the core 302. The self bias current wiring 291 includes one conductor through a notched passage 327 located along a longitudinal slit 271 and two conductors through a notched passage 326 located along the longitudinal slit 271. The slit 274 is spaced from the center line 252 of the left winding window 276 and the center line 254 of the right winding window 276. The slit 274 is spaced beyond the spacing for the slit 271. The slit 274 longitudinally bisects the outer legs 255 and spline of the "E" section 278 and the "I" section 266. The slit 271 longitudinally bisects the inner half of the outer legs 255 and spline 322 of the "E" section 278 and the "I" section 266.

The two longitudinal slits 271 and 274 uniformly divide all the cross-sectional widths of the core 302 into three magnetic cross sections 299, 300 and 301. The width of magnetic section 299 equals the width of magnetic section 300. The width of magnetic section 301 is twice the width of magnetic sections 299 or 300. The self bias wiring scheme is shown in the right half of the core 302 shown in FIG. 1B.

The self bias current wiring 291 is wound such that the voltage induced by the time changing magnetic flux of the core 302 into the self bias current wiring 291 around the under utilized section of the core 302 (section 301) is equal to the voltage induced into the self bias current wiring 291 around the over utilized sections of the core 302 (section 299) when the flux density is equally distributed. The voltages oppose each other but null when the voltages generate the self bias current 292. The self bias current 292 develops to support the redistributed magnetic flux density of the core 302 when the primary voltage 104 is applied to the primary wiring 102. The primary voltage 104 is derived from a very low impedance voltage source.

The self bias current wiring 291 is wound through the three magnetic cross sections 299, 300 and 301. Starting at an interior spacing 270, the winding 291 goes up and around the sections 299 and 300, then down through a passage 327, and returns to an exterior spacing 275. The winding 291 then goes up and around the top of the sections 301 and 300, then down through the passage 326, back to the spacing 270, up and around the section 299, then down through the passage 326, and back to the spacing 270, connecting with the start of the self bias current winding 291. The passages for tapped bias magnetics and self bias magnetics may be used interchangeably with the same core modifications as long as the passage widths accommodate the worst case bias current wiring width requirements.

Figure 22:
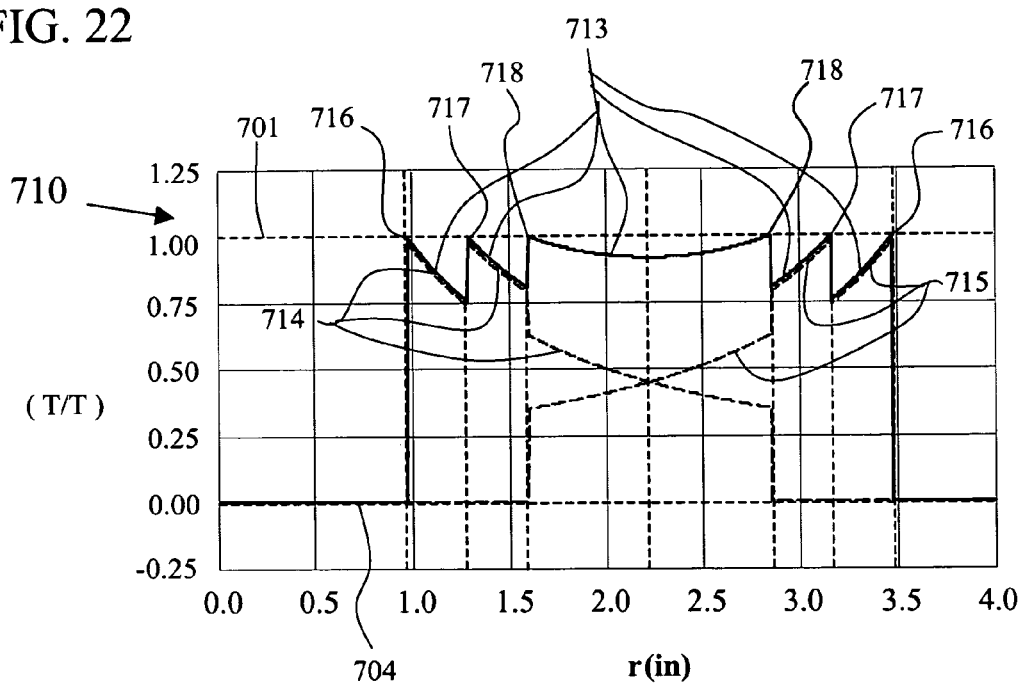
FIG. 22 is a graph that shows a normalized flux distribution curve 713 of the inductor 290 of FIGS. 1A and 1B.

FIG. 22 is a graph 710 with a curve 713 representing the low profile maximum core bias current flux density distribution of the core 302 in FIGS. 1A-1B. The graph 710 includes a first abscissa point at a radius of 0.97 inches that symmetrically reappears on the right side of a second abscissa point at a radius of 2.22 inches. The first abscissa point of the core 302 at a radius of 0.97 inches is the toroidal equivalent of the radius of equivalent inner diameter, $r_{IDe}$. The abscissa point at a radius of 2.22 inches is a toroidal equivalent radius of the equivalent outer diameter, $r_{ODe}$. Abscissa spacings between the abscissa points correspond to transformer spacings 296, 297 (0.31 inches in this example) and 298 (0.63 inches in this example) in the core 302. The curve 713 is a sawtooth shape having a peak flux density point 716 at a radius of 0.97 inches; a peak flux density point 717 at a radius of 1.28 inches; and a peak flux density point 718 at a radius of 1.59 inches. The flux density points 716-718 are all equal to Bsat, and touch the horizontal dashed line 701, representing Bsat, and, consequently, are optimally distributed.

The curve 713 is the summation of curves 714 and 715. The curve 714 is the maximum flux density imposed in the center leg 293 by the magnetizing current, $I_{Mx}(f)$, flowing in the winding window 276 to the left of the center leg 293. The curve 715 is the maximum flux density imposed in the center leg 293 by magnetizing current flowing in the winding window 276, to the right of the center leg 293. Bias current flux density distribution, shown by the curve 713 for the core 302 in FIGS. 1A and 1B, is an example of optimally using a magnetic core at its peak magnetic permeability, μ.

The pictorial representation of the maximum flux density redistribution in bias current enhanced magnetic cores is shown by flux vector arrows 320 in the magnetic sections 279, 280 and 281 in the high profile inductor 310 in FIG. 2A and the low profile inductor 290 in FIG. 1A. Peak flux vector tails 319 and vector points 318 represent Bsat in respective magnetic cross sections 279, 280 and 281 in FIG. 2B and the magnetic cross sections 299, 300 and 301 in FIG. 1B. The maximum operational magnetic flux distribution, $B_{Mx}(f,r)$, is generated by the maximum magnetizing current 116 flowing to the right in the primary wiring 102. In FIGS. 2A and 1A, the magnetic flux vectors are shown, by the "right hand rule" as directed vertically upward through the center legs 261 and 293. The vectors are equal width and length, symbolizing equal maximum magnetic flux density, Bsat, in each magnetic section throughout the core. By the "right hand" rule, the flux vectors 319 are directed into the page in the center leg 261 of the high profile inductor 310 and the center leg 293 of the inductor 290. The flux vectors 318 are directed out of the page in the outer legs 255 in both inductors 290 and 310. The peak magnitude of the magnetic flux density in each magnetic section 279, 279 and 281 of the core 328 in FIG. 2B is Bsat and is coarsely indicated by the five flux lines in the magnetic sections 279, 280 and 281. The peak magnitude of the magnetic flux density in each magnetic section 299, 300 and 301 in the low profile core 302 in FIG. 1B is Bsat and is coarsely indicated by the three flux lines in the magnetic sections 299, 300 and 301.

The preceding examples illustrate the PD improvements in high profile and low profile laminated cores when using core bias currents—either tapped bias or self bias currents. The lower the profile, the higher the percentage of obtainable core PD improvement. The use of core bias currents may thus allow for low profile magnetic parts. Core bias current in low profile transformer cores fully utilizes the device magnetics and thereby requires less magnetic material to construct the core than without core bias current. Consequently, core bias current allows low profile parts without the previous concern of bulk and weight that the conventional low profile design would have required.

Mechanical Interlacing Flux Redistribution

Figure 31A:
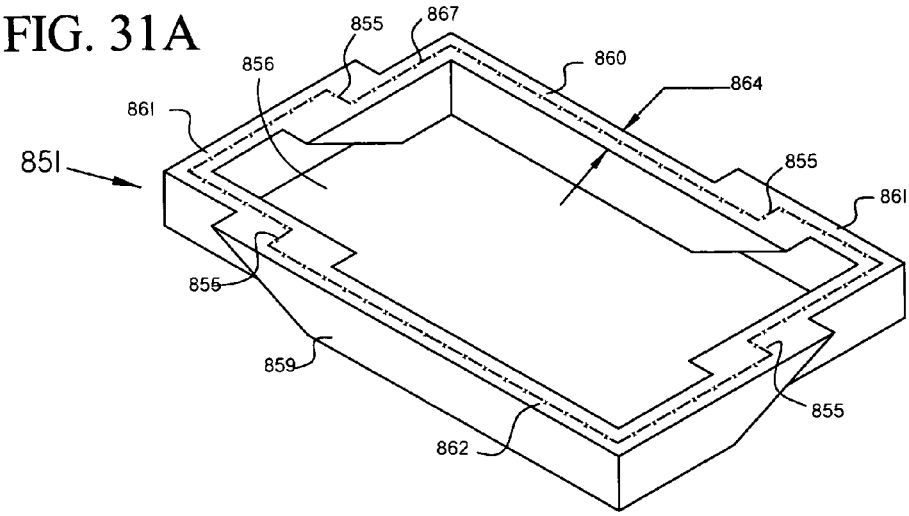
FIG. 31A is an isometric view of an interlace sub-section.
Figure 31B:
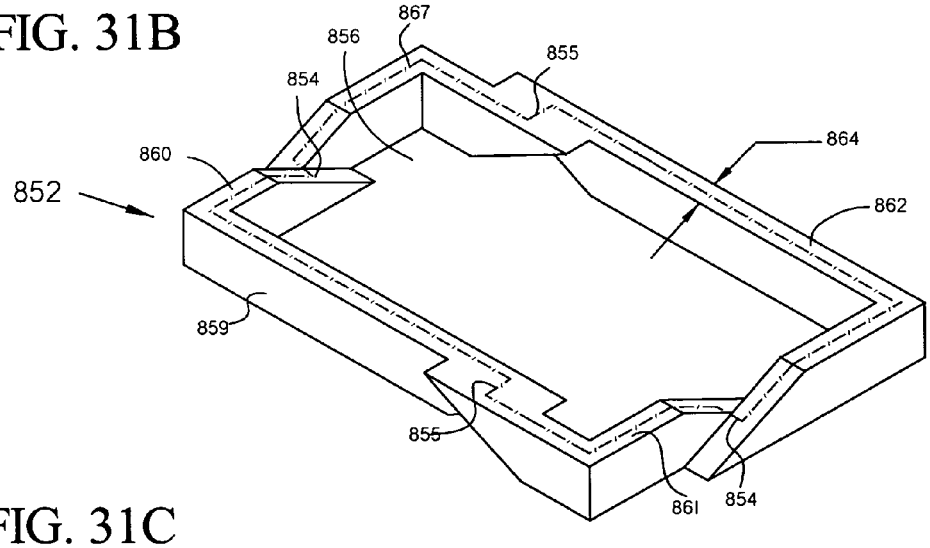
FIG. 31B is an isometric view of another interlace sub-section.
Figure 31C:
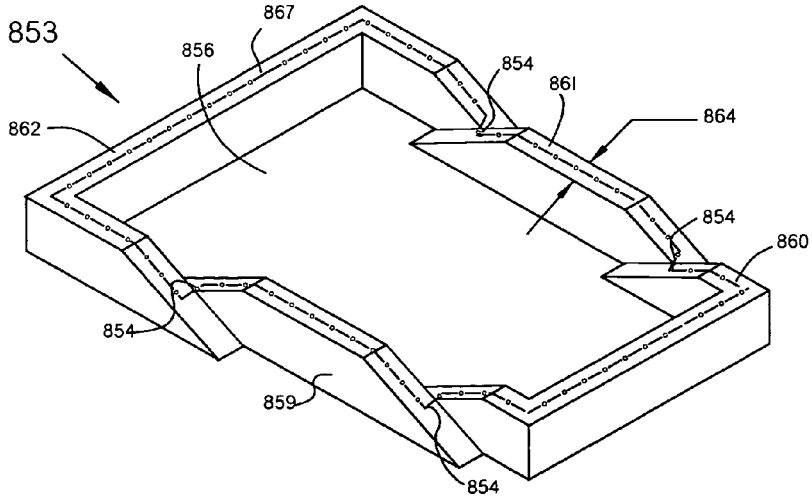
FIG. 31C is an isometric view of another interlace sub-section.

An alternate, passive, flux redistribution scheme is mechanical interlacing. An example of mechanical interlacing is shown in a magnetic core assembly 850 in FIG. 13. The magnetic core assembly 850 consists of the interlace assembling of three magnetic sub-cores, 851, 852 and 853 which are fabricated from a magnetic material 859. FIG. 31A illustrates a perspective view of the sub-core 851. FIG. 31B illustrates a perspective view of the sub-core 852 and FIG. 31C illustrates a perspective view of the sub-core 853. Each sub-core 851, 852 and 853 when interlaced assembled are magnetically isolated from each other by virtue of their gap. The core assembly 850 is radially sub-divided into three sections, a radial section 860, a radial section 861 and a radial section 862. A portion of the sub-core 851 contributes to the radial section 860; another portion of the sub-core 851 contributes to the radial section 861 and the rest of the sub-core 851 contributes to the radial section 862. Likewise, a portion of the sub-core 852 contributes to each of the sections 860, 861 and 862. Similarly, a portion of the sub-core 853 contributes to each of the sections 860, 861 and 862. Each sub-core 851, 852 and 853 has a constant width and constant height and therefore the cross sectional areas, Ac, are constant along magnetic path lengths 867.

In each sub-core 851, 852 and 853, each radial section 860, 861 and 862 connects to an adjacent radial section by a magnetically continuous top crossover 855 or a bottom crossover 854. The purpose of the crossovers 854 and 855 is to construct sub-cores with magnetic path lengths 867 that are equal, but physically separate and magnetically distinct. Each sub-core 851, 852 and 853 has maximum relative magnetic permeability, $\mu_R$, along the magnetic path lengths 867 but negligible relative magnetic permeability between adjacent sections unless it is a top or bottom crossover 855 or 854. For convenient handling, the sub-cores 851, 852 and 853 may magnetically connect to each other at only one connection point without interfering with their respective magnetic flux paths. Two connection points may be used, if the first connection point magnetically saturates before the applied voltage reaches its maximum, $V_{Mx}(f)$.

The core assembly 850 may be constructed by laying down the base sub-core 853 and then placing the sub-core 852 into the sub-core 853. The sub-core 851 is then placed into the sub-core 852. The assembly forms the interlaced core 850 in an exact rectangle with an outer length and width and a uniform height. A winding window opening 856 is an exact rectangle with an inner length and inner width. The width of the core 850 is the difference between the outer edge and the inner edge of the window 856 and is three times the width of the sub-core 851 and is constant around the winding window 856.

While the core assembly 850 is implemented via a solid block core from ferrite molding, pressing, and firing procedures, a stackable, thin lamination may also be fabricated from interlaced sub-cores.

Figure 13:
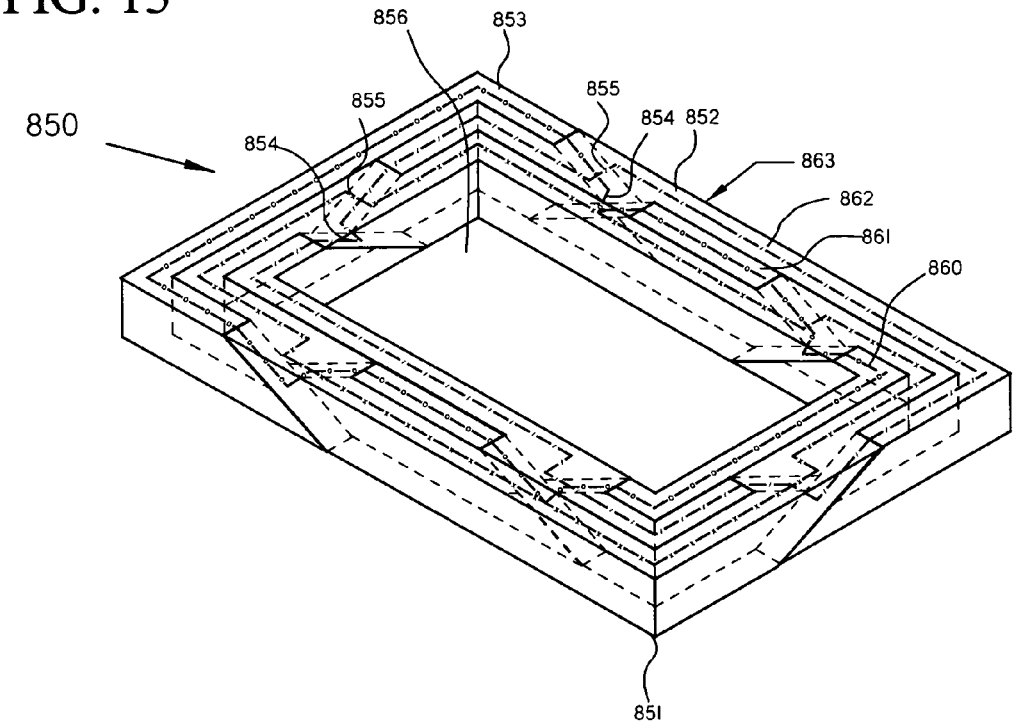
FIG. 13 is an isometric view of a three section interlaced, square core.
Figure 32:
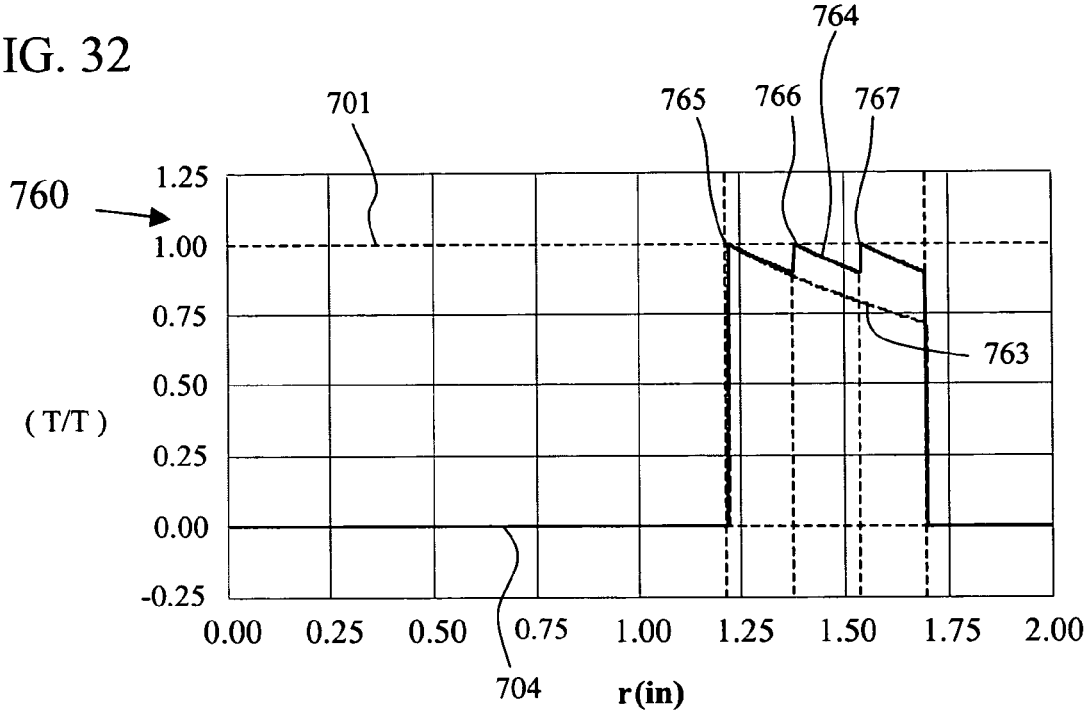
FIG. 32 is a graph comparing a normalized flux density curve for the interlaced square core of FIG. 13 to the curve of a known square core without interlaced flux density redistribution.

FIG. 32 is a graph 760 having a curve 764 which represents the maximum interlaced flux density distribution, $B_{Mx}(r)$, of the interlaced core assembly 850 in FIG. 13. The graph 760 compares the flux density of non-interlaced and interlaced core sections of the same outer and inner dimensions. A curve 763 is the flux density distribution of a non-interlaced SBC or LaC. The curve 764 is the flux density distribution of the interlaced SBC or LaC with the same outer and inner dimensions.

FIG. 32 is a graph 760 with a curve 764 representing the maximum interlaced flux density distribution, $B_{Mx}(r)$, of the interlaced core 850 in FIG. 13. The graph 760 includes a first abscissa point at 1.21 inches of the core 850, which is a toroidal equivalent radius of inner diameter, $r_{IDe}$. A second abscissa point at 1.69 inches of the core 850 is a toroidal equivalent radius of outer diameter, $r_{Ode}$ . As shown in FIG. 32, the flux density distribution in the section 860 of the core 850 is the Amperian distribution between radius 1.21 inches and radius 1.37 inches with peak flux density point 765 corresponding to the radius 1.21 inches. The difference between the radii is 0.16 inches and is the width of the inner sub-core, which could be either sub-core 851, 852 or 853, depending on where the flux density cross section is taken along the magnetic path length of core 850. The flux density distribution in the section 861 of the core 850 is the Amperian distribution between the radius of 1.37 inches and the radius of 1.53 inches with a peak flux density point 766 corresponding to the radius of 1.37 inches. The difference between the radii is 0.16 inches and is the width of the middle sub-core, which could be either sub-core 851, 852 or 853, depending on where the flux density cross section is taken along the magnetic path length of core 850. The flux density distribution in the section 862 of the core 850 is the Amperian distribution between the radius of 1.53 inches and the radius of 1.69 inches with a peak flux density point 767 corresponding to the radius 1.53 inches. The difference between the radii is 0.16 inches and is the width of the outer sub-core, which could be either sub-core 851, 852 or 853, depending on where the flux density cross section is taken along the magnetic path length of core 850. The peak flux density points 765, 766 and 767 are equal to Bsat represented by the line 701. The shapes of each sectional flux density distribution curve are equal to each other and are radially summed to comprise the entire flux density distribution curve 764. This is because each core sub section 860, 861 and 862 has the same magnetic path length 867 and the same cross sectional area, $A_C$.

The maximum operating voltage for curve 763 is $V_{Mx1}(f)$. The maximum operating voltage for the curve 764 is $V_{Mx2}(f)$. The operating voltage, $V_{Mx2}(f)$, is greater than operating voltage, $V_{Mx1}(f)$, by the total flux contained between the curve 764 and the curve 763 which is 12.3% in this example. The core interlaced flux density distribution, $B_{Mx}(r)$ curve 764 for the core 850 is an example of optimally using a magnetic core at its peak magnetic permeability, μ, compared to a simple non interlaced square core with operational maximum flux density distribution, $B_{Mx}(r)$, curve 763. Consequently, a magnetic core's non-linear magnetic permeability, μ, increases the practical value of the power density of a core such as the core beyond 12.3%.

Figure 14A:
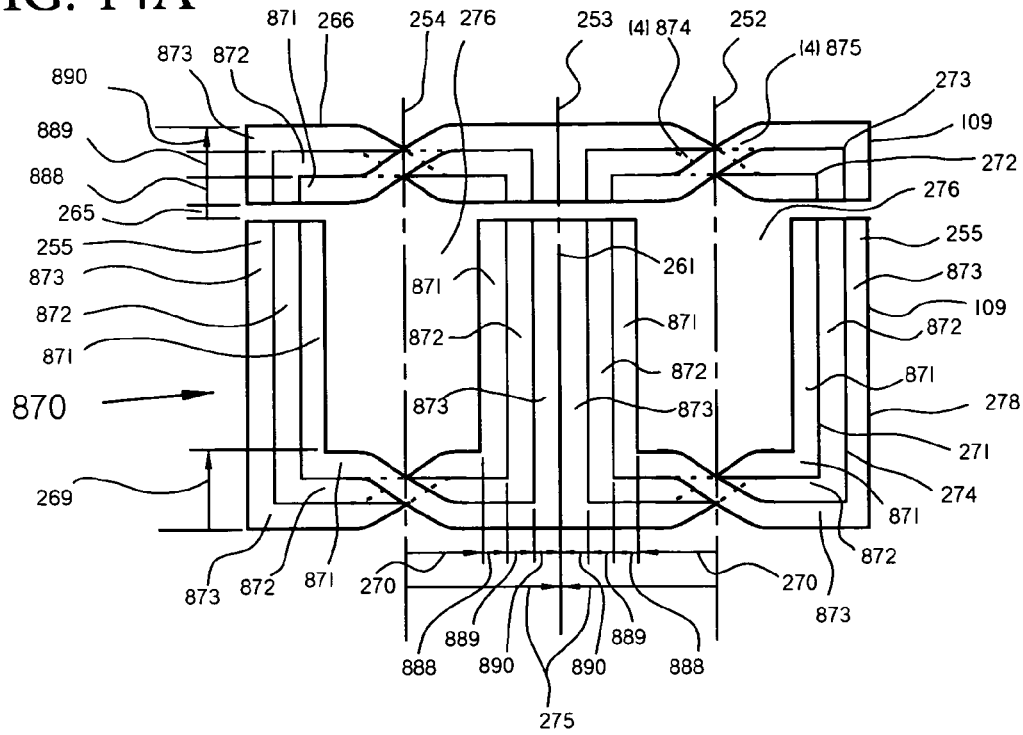
FIG. 14A is a top view of a laminated core interlace.
Figure 14B:
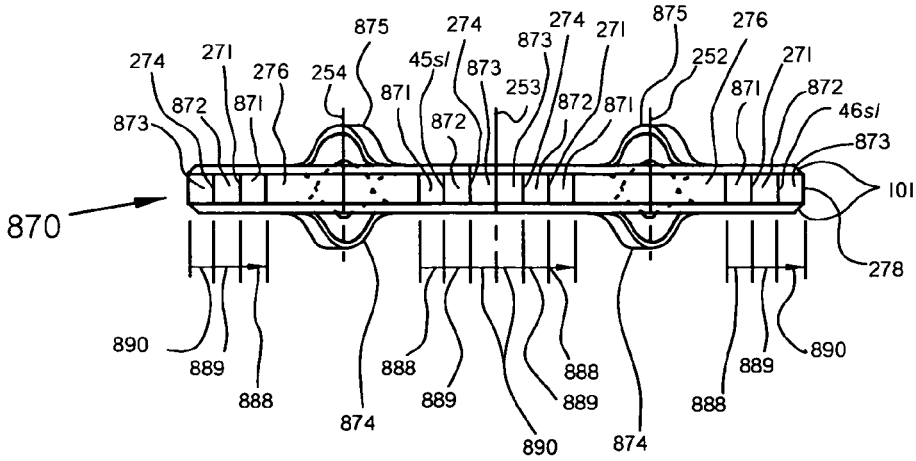
FIG. 14B is a cross-sectional view of the laminated core interlace of FIG. 14A.

An alternate, passive, mechanical interlaced flux redistribution scheme is demonstrated by a core assembly 870 shown in FIGS. 14A and 14B. The core assembly 870 includes the mechanical crossover of three longitudinal laminated E-I sections 871, 872 and 873. The sections 871, 872 and 873 are physically and magnetically isolated from each other along their magnetic path lengths. If needed, the sections 871, 872 and 873 may magnetically connect with each other at only one connection point without magnetic interference. The sections 871 and 873 cross over the section 872 at a top bridge 875 and a bottom bridge 874 shown in FIG. 14B. The other parts of the core assembly 870 are the same as those of the core 250 of FIGS. 30A and 30B and thus have identical element numbers.

The flux density distribution curve for the interlace technique shown in the core assembly 870 is similar to the curve 764 in FIG. 32. Each magnetic section 871, 872 and 873 has respective radial widths 888, 889 and 890 which are equal widths, and approximately the same magnetic path lengths, $l_e$. The magnetic path lengths of the sections 871 and 873 will be slightly longer than the path length for section 872 due to the bridging. The thickness of each section 871, 872 and 873 is constant along the magnetic path length. Consequently the sections 871, 872 and 873, each have similar saw tooth flux density distribution curves that are radially shifted and summed as represented by the curve 764 in FIG. 32.

The bridging technique shown by the core assembly 870 may be used to construct interlaced magnetics in PCBs and ICs by magnetic material deposition. The bridges 874 and 875 may be formed by depositing magnetic material over base magnetic sections such as section 872. Longitudinal slitting may be accomplished by photo lithographic etching. Deposition and etching techniques may be used to adjust the widths and thicknesses of the sections 871, 872 and 873 so as to customize uniform cross sectional area, AC, along the longitudinal magnetic path length, $l_e$.

Square Core Inductor Corner Bias Current Corner Magnetics' Limitations

Figure 15A:
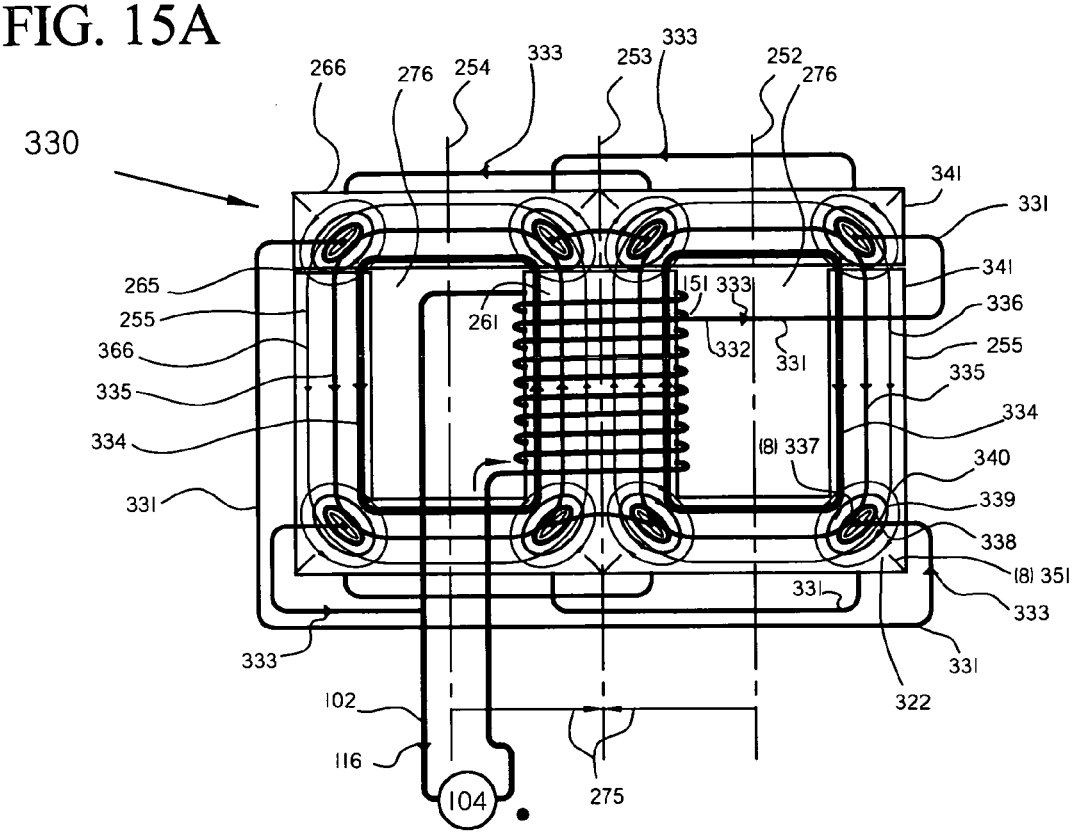
FIG. 15A is a top view of a square core inductor having mid-core corner bias current with a primary tap bias.
Figure 15B:
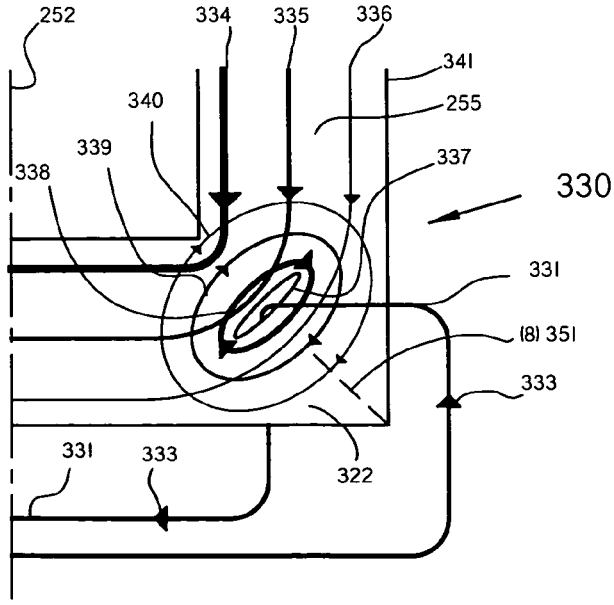
FIG. 15B is a detailed top view of one of the corners of the square core inductor of FIG. 15A.
Figure 16A:
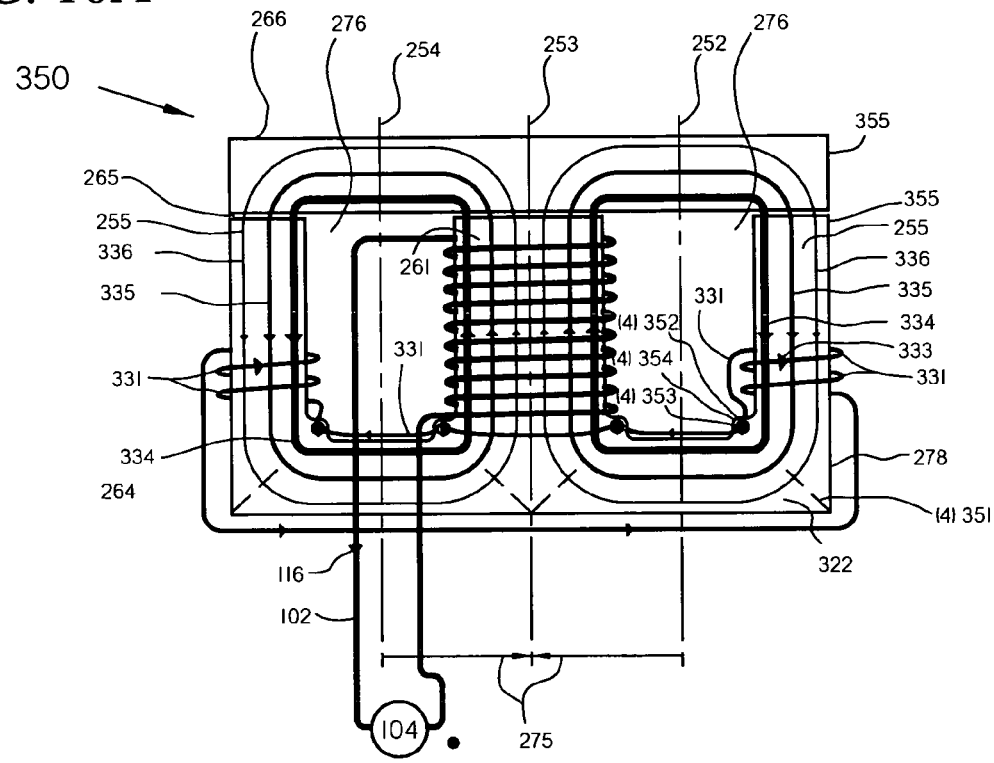
FIG. 16A is a top view of a square core inductor showing an interior core corner bias current with self bias.
Figure 16B:
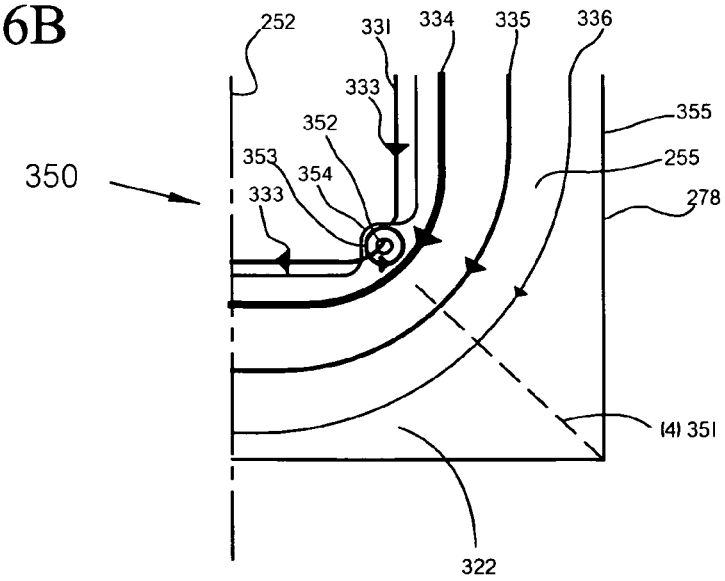
FIG. 16B is a detailed top view of a corner of the square core inductor of FIG. 16A.

Magnetic flux lines traversing sharp bends or corners, as found in a square core laminated core inductor 330 shown in FIGS. 15A and 15B and a square core laminated core inductor 350 shown in FIGS. 16A and 16B may create locally induced magnetic air gaps at those points along their magnetic path where the radius of curvature is very small, such as the corners. The magnetically induced gaps are created at operating voltages less than the maximum voltage, $V_{Mx}(f)$, because Ampere's Law dictates that magnetic flux lines want to 'bunch up' (pile up) or increase their flux density when their radius of curvature diminishes until the flux density bunching reaches its magnetic limit, Bsat. The diminished radius of curvature at the corners, compared to the radius of curvature in the straight sections causes the corner diagonals 351 of the cores 330 and 350 to saturate and form air gaps before the operating voltage reaches its maximum, $V_{Mx}(f)$. As the operating voltage, $V_M(f)$, is increased, corner saturation represented by a cross hatched section 727 under a curve 726 in a graph 720 begins to occur at the interior or smallest radius of corner curvature, $r_i$, at a radius of 0.032 inches in graph 720 and progresses inward into the magnetic material along the corner diagonals 351 in FIGS. 15A & 15B and 16A & 16B. The magnetic saturation stops at the radial point, $r_{CDe}$, at 0.86 inches that supports the Amperian maximum magnetic flux density, $B_{Mx}(f)$, for the maximum operating voltage, $V_{Mx}(f)$. The Amperian corner maximum flux density distribution ($B_{MxC}(r)$) begins at the inner diagonal radial point, $r_{CDe}$, where a maximum flux density is equal to Bsat, line 701 ($B_{MxC}$(0.086 inches)=Bsat, line 701) and hyperbolically decays to an outer diagonal radius of 1.5 inches. The consequence to the device is a reduced maximum operating voltage, $V_{Mx}(f)$, compared to a magnetic device without sharp radius of curvature, which thereby lessens the device's relative PD.

The flux density distribution, $B_{MxC}(r)$, shown by the curve 726 is a dynamic event that only occurs at the peak of the magnetizing current, $I_{Mx}(f)$. Corner saturation gradually increases, following the magnetizing current, $I_M(f)$, waveform until the $I_M(f)$ reaches its maximum, $I_{Mx}(f)$, which is represented by the maximum corner flux density distribution, $B_{MxC}(r)$ curve 726. At all times while there is available unused magnetic material at any point in the transformer's corner diagonals 351 as shown by the cross section 726 and the magnetic flux density profile of the straight section, $B_{Mx}(r)$, approximates the magnetic density profile of the corner section, $B_{MxC}(r)$.

Corner Bias Current Configurations

Any E-M or PM device with a magnetic core whose magnetic flux path, $l_e$, traverses sharp bends or corners is susceptible to magnetic flux compression at the sharp bends or corners, thereby reducing the device's best PD. The corner bias current scheme shown for the square core inductor 330 in FIG. 15A is shown in detail in FIG. 15B. The corner scheme in FIG. 15B improves the PD of the square core inductor and other devices with sharp bends or corners such as transformers, electric motors, generators, relays and solenoids.

The power density in a square core device may be improved by usefully redistributing the flux density at the inside corners to relieve magnetic flux density pile-up and premature magnetic flux density saturation at the corners. FIG. 15A is a top view of the square core inductor 330 which includes a stack of lamination sections 250 as shown in FIGS. 30A and 30B without longitudinal slits. The lamination section 250 contain eight corner diagonal slits 337 that align when stacked to form a passage for either tapped or self bias current wiring. For example, FIG. 15A shows a tapped bias current wiring 331 carrying a bias current 333 through the corner diagonal slits 337.

A tapped bias current flows through the diagonal slits 337 to form an Amperian series of opposing magnetic flux vectors 338, 339 and 340 to a series of incident Amperian magnetizing flux vectors 334, 335 and 336 which are generated in the core 341 by the magnetizing current, $I_{Mx}(f)$. However, on the outside of the slits 337 the flux density vectors 338, 339 and 340 will aid the magnetizing flux density vectors 334, 335, and 336 in the under utilized magnetic material. Consequently, the net magnetizing flux, $\phi_{Mx}(f)$, will traverse the corner, but is shifted radially inward along the corner diagonal 351.

Figure 33:
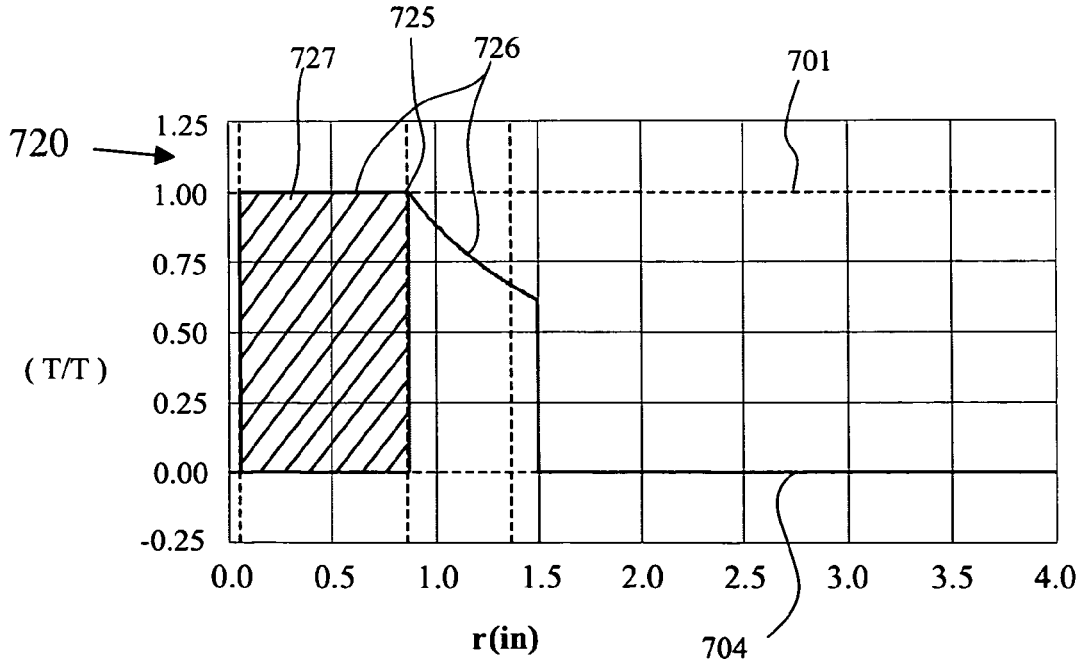
FIG. 33 is a graph of a normalized flux density curve along the corner diagonals of the inductors of FIGS. 15A-15B and FIGS. 16A-16B.

FIG. 33 shows a graph 720 with a curve 726 showing the maximum corner flux distribution, $B_{MxC}(r)$, for magnetizing current, $I_{Mx}(f)$, along the corner diagonals 351 without the benefit of corner bias current. The magnetic core material from the inner corner radius, $r_i$, of 0.032 inches to the inner radius $r_{CDe}$, of 0.86 inches is magnetically saturated at the peak of the magnetizing current, $I_{Mx}(f)$, and unavailable to support magnetizing flux, $\phi_{Mx}(f)$. The saturated region is represented by the cross hatching are 727 under the curve 726. The radius 724 of 1.36 inches is the effective radius of the outside diameter, $r_{ODe}$, of the magnetic flux passing through the straight sections of inductor 330 in FIG. 15A. The effective corner outer diameter radius of 1.50 inches is the radial cut off point along the corner diagonal 351 beyond which the magnetic material is unavailable for magnetic flux passage. The radius of 1.50 inches is always greater than radius of 1.36 inches. The area under the curve 726 between radial points at 0.86 inches and 1.5 inches must be sufficient to pass maximum magnetizing flux $\phi_{Mx}(f)$ or premature core saturation will occur at the corners and not allow the core to realize its full maximum operating voltage, $V_{Mx}(f)$.

Figure 34:
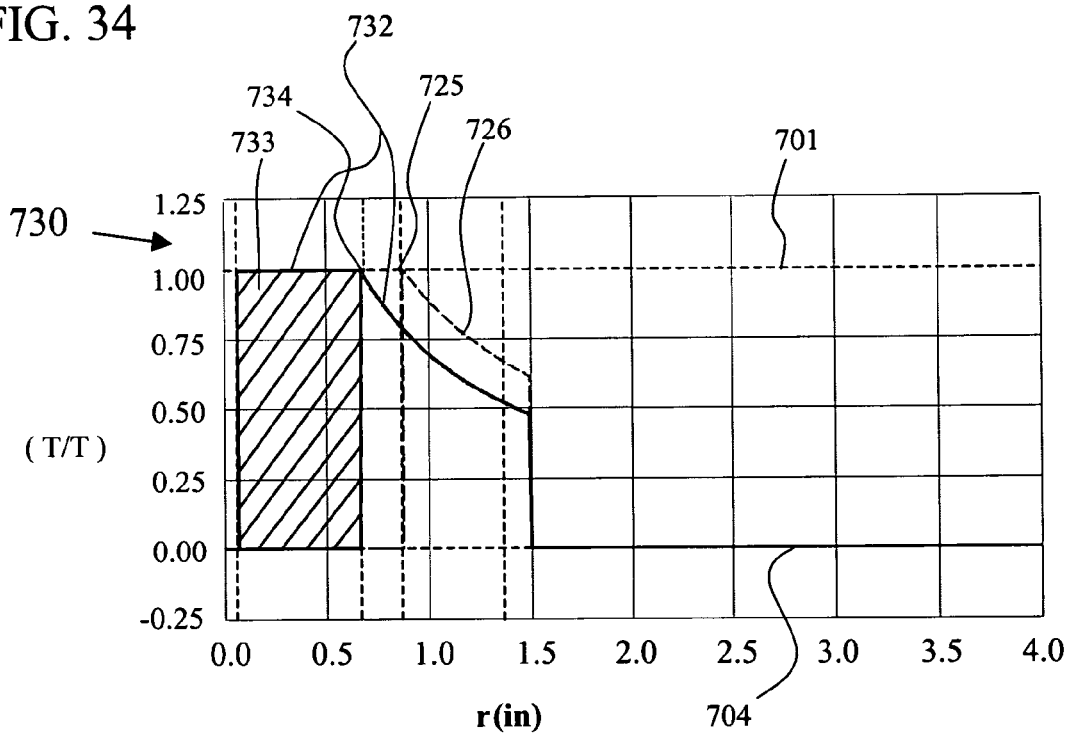
FIG. 34 is a graph of a normalized flux density curve along the corner diagonals of the square core inductors of FIGS. 15A-15B and FIGS. 16A-16B.

When the corner bias current 333 flows through the corner slots 337, the corner diagonal magnetic flux density for the magnetizing current $I_{Mx}(f)$ shifts as shown by the corner bias current influenced corner flux density curve 732 in FIG. 34. FIG. 34 is a graph 730 which compares a dashed curve 726 representing a corner flux density distribution without corner bias current and the curve 732. The corner bias current 333 shifts to the left, along the corner diagonal 351, the effective inner operational magnetic of 0.86 inches in the graph 730, to a radial position 731, thereby shifting to the left, peak flux density point 725 to a peak flux density position 734. The shift decreases the magnetically saturated diagonal cross sectional area 733 and opens up more of the magnetic material's corner diagonal flux density region for passing the maximum magnetizing flux $\phi_{Mx}(f)$ at a higher maximum operating voltage, $V_{Mx}(f)$, which raises the device's PD.

The eight corner diagonals passages 337 are physically separated from each other and consequently, each diagonal passage 337 may have its own bias current to favorably redistribute the magnetic flux density at each corner. Alternatively, if the geometry of each diagonal passage 337 and the magnetic material surrounding each is similar to each other, then a common corner bias current wiring scheme such as the wiring scheme 331 may be used, where each corner diagonal passage 337 is series connected with each other as shown in FIG. 15A. The tapped corner bias current scheme includes the bias current wiring 331 threaded through the corner slits 337 attached to a tap point 151 along the primary wiring 102, generating a bias voltage 332 which drives a bias current 333 through the bias current wiring 331. The bias current wiring 331 series connects each corner slit 337 and, thus, each corner to the flux redistribution corner bias current 333. Alternatively, the corner bias current 333 may be generated by a self bias current scheme with an independent voltage source.

The corner flux density in laminations, or solid block cores, may also be redistributed by an alternate corner bias current passage located on the inside corner of the window opening. The inductor 350 shown in FIG. 16A and the corner detail shown in FIG. 16B demonstrate this alternative corner flux density redistribution technique. The inductor 350 is similar to the inductor 330 in FIGS. 15A and 15B and thus like elements have like reference numbers. However, the inductor 350 includes passages 352 for the corner bias wiring 331 carrying the corner bias current 333 in four interior corner protrusions 354 in a laminated core 355. The protrusions 354 are formed between the spine 322 and the outer legs 255 and both sides of the center leg 261 of the E-shaped section 278. The magnetic flux density vectors 353 surrounding a hole 352 and generated by the corner bias current oppose the flux density vectors which tend to pile-up at the corners, due to the magnetizing current, $I_M(f)$, 116 generated in the primary wiring 102. Similar to the corner bias current scheme of FIGS. 15A and 15B, if the geometry of each corner passage 352 and the magnetic material surrounding each passage is similar to each other, then a common corner bias current wiring scheme 331 may be used, where each corner diagonal passage is series connected with each other as shown in FIG. 16A. The corner bias current may be generated by a self bias current scheme as well as a tapped bias current scheme used by the inductor 350.

Figure 17A:
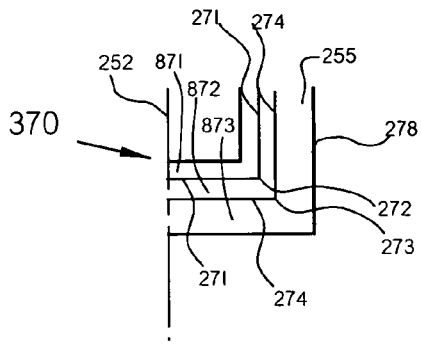
FIG. 17A is a top view of lamination slits as a right angle corner in a core.

FIGS. 17A-17E show five different corner shapes that may be used to mitigate flux density saturation at the corners without resorting to corner bias currents. FIG. 17A shows a corner section 370 which is conventional interior square corners 272 and 273 along the slits 271 and 274 in an E-I core such as the core 302 in FIGS. 1A and 1B and the core 328 in FIGS. 2A and 2B. The corners 272 and 273 have very small radius of curvature and consequently pile up magnetic flux lines at their corners similar to the flux pile up at the inside corner of the window opening 276. However, the flux pile up is mitigated by distributing the magnetic flux over three inside corners instead of one.

Figure 17B:
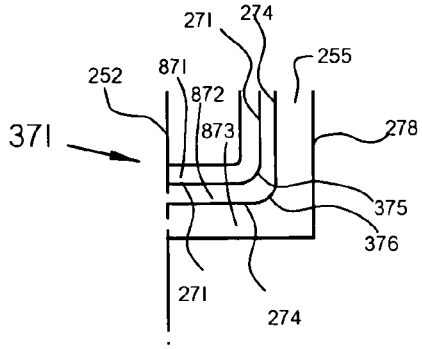
FIG. 17B is a top view of lamination slits as a constant radius corner in a core.
Figure 17C:
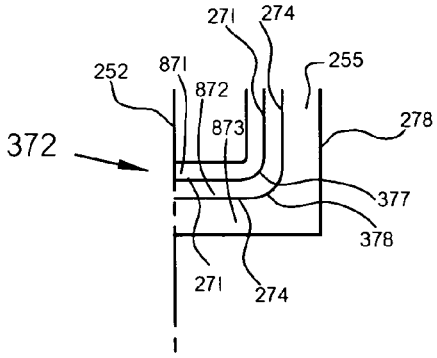
FIG. 17C is a top view of lamination slits as a proportional radius corner in a core.
Figure 17D:
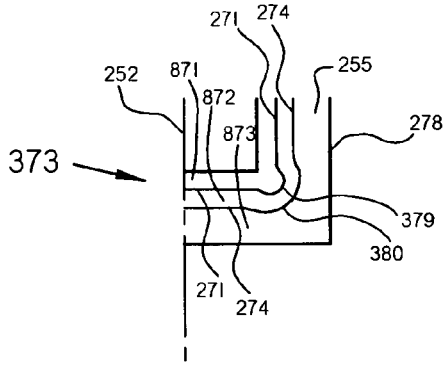
FIG. 17D is a top view of lamination slits as an elongated radius corner in a core.

FIG. 17B shows a section 371 having a fixed short radius of curvature for corners 375 and 376 respectively along the slits 271 and 274. The radius of curvature for the corners 375 and 376 is larger than the radius of curvature for the corners 272 and 273 and, consequently reduce the flux pile up at their corners. FIG. 17C shows a section 372 which has a long or variable radius of curvature for corners 377 and 378 respectively along the slits 271 and 274. The longer varying radius of curvature for the corners 377 and 378 lessen the flux pile up at their corners compared to corners 375 and 376. FIG. 17D shows a section 373 having an elongated radius of curvature for corners 379 and 380 respectively along the slits 271 and 274. The large elongated radius of curvature for the corners 379 and 380 lessens the flux pile up at the corners and more fully utilizes the magnetic material at the corners. Also the elongated corner enables the addition of corner holes for corner bias current modification. Combinations of corner bias current modifications and geometry modifications may be used to minimize flux pile-up in the corners.

Figure 17E:
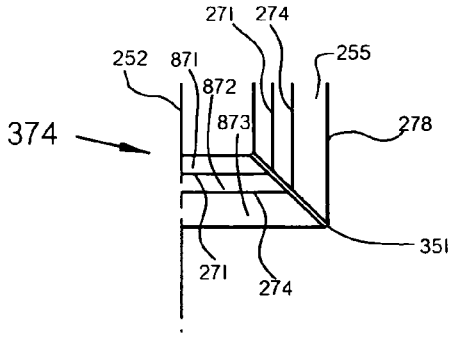
FIG. 17E is a top view of a lateral lamination slit at a corner diagonal of a core.

Diagonal gapping the corners, shown as a corner diagonal slit 351 in a corner section 374 shown in FIG. 17E is normal to the magnetic flux direction and may be used as an alternate to the traditional lateral gapping used to interface the "E" and "I" magnetic material sections. Diagonal gapping keeps the corner magnetic material from saturating at its most vulnerable point, the short radius of curvature at the corner, while allowing a conventional magnetic winding bobbin to be applied to the core. The diagonal cut (corner gap) introduces air as the magnetic medium which has no magnetic saturation limit at the sharp radius of curvature. The flux density at the corner in the gap lacks the magnetic saturation limit which would ordinarily shift the operating magnetic flux density outward along the corner diagonal from the interior of the corner. FIG. 17E shows the minimization or elimination of flux density saturation at the interior of the corner and optimal redistribution of the operating flux density along the corner diagonal.

Construction of Square Core & Toroidal SBC Magnetics

Another major group of magnetic materials that may benefit from redistributed magnetic flux density are the solid block magnetic materials such as sintered ferrites, both Manganese Zinc (MnZn) and Nickel Zinc (NiZn), and sintered powdered iron. The maximum flux density, Bsat, of a solid block core, such as ferrite or powdered iron, is significantly less than Bsat of tape wound toroidal cores consisting of either silicon steel or an amorphous magnetic metal such as Metglas. Ferrite materials and powdered iron may be used as magnetic cores in devices that need to operate at frequencies higher than may be efficiently supported by silicon steel or amorphous magnetic metal. Alternatively, ferrite materials may have their chemistry altered so they can be better used as permanent magnets. Solid block core magnetics are usually used to construct high frequency transformers and inductors; permanent magnetic stators and rotors in electric motors, generators, solenoids and relays.

Solid block ferrite cores are manufactured by molding, pressing and firing ferrite powder. The molding procedure used to fabricate solid block ferrite cores readily lends itself to manufacturing complex solid core geometries. Ferrite solid block cores may be fabricated in different shapes such as round and square toroidal cores, E-I cores, pot cores, U-I cores, and planar cores. The square cores consist of one piece molded "E" and "I" sections that allow easy assembly of their magnetic coils, pre-wound on bobbins, onto their magnetic sections—usually the center leg of the "E." The "E" and "I" sections come together during assembly to close the magnetic path, but leave a gap at their interface that decreases the core's effective magnetic permeability, stei and thereby increase the maximum magnetizing current, $I_{Mx}(f)$, required for core saturation.

E-I SBC magnetics have two opportunities to use redistributed magnetic flux density to improve power density. The first opportunity is redistributing the flux density in the straight sections using core bias currents, similar to the techniques employed for the E-I LaC inductor. The second opportunity is redistributing the flux density at the corners. Although the flux redistribution of the straight section usefully effects the corner distribution, the corner redistribution may be independently adjusted to increase PD without effecting the flux density distribution in the straight sections. All flux density redistribution techniques are designed to increase the power density in the SBC devices.

All of the solid block magnetics cores have maximum magnetic permeability, μ, in all polar coordinate directions. That is: $\mu_{R\theta}\approx\mu_{Rz}\approx\mu_{Rr}$. For all redistributed magnetic flux density designs, the material permeability must have these polar requirements: $\mu_{R\theta}\approx\mu_{Rz}>>\mu_{Rr}$. This permeability requirement is exactly the same as intrinsically found in laminated core, LaC, devices. (Optionally, $\mu_{R\theta}>>\mu_{Rz}\approx\mu_{Rr}$.) Further, an E-I solid block core (SBC) by toroidal equivalence, has the same effective radius of inner diameter, $r_{IDe}$, and the same effective radius of outer diameter, $r_{ODe}$, as a laminated core, (LaC) with the same dimensions. An SBC shape has the same hyperbolic flux density distribution curve as the flux density distribution corresponding to either a toroidal tape wound core, TWC, or an E-I laminated core device. Consequently, the same flux density redistribution techniques described for toroidal TWC and E-I LaC devices also improve the PD of correspondingly shaped SBC devices.

The following sections describe the square core device's construction "building block," the molded "E" and "I" core sections. Then the required core modifications for magnetic flux redistribution are presented. The modified cores are then ready to have their magnetic flux density profiles modified by either tapped bias current, self bias current, or corner bias current or shaping. The features and benefits for magnetic flux redistribution in the square core SBC inductor are described.

SBC Transformer Construction

Figure 5A:
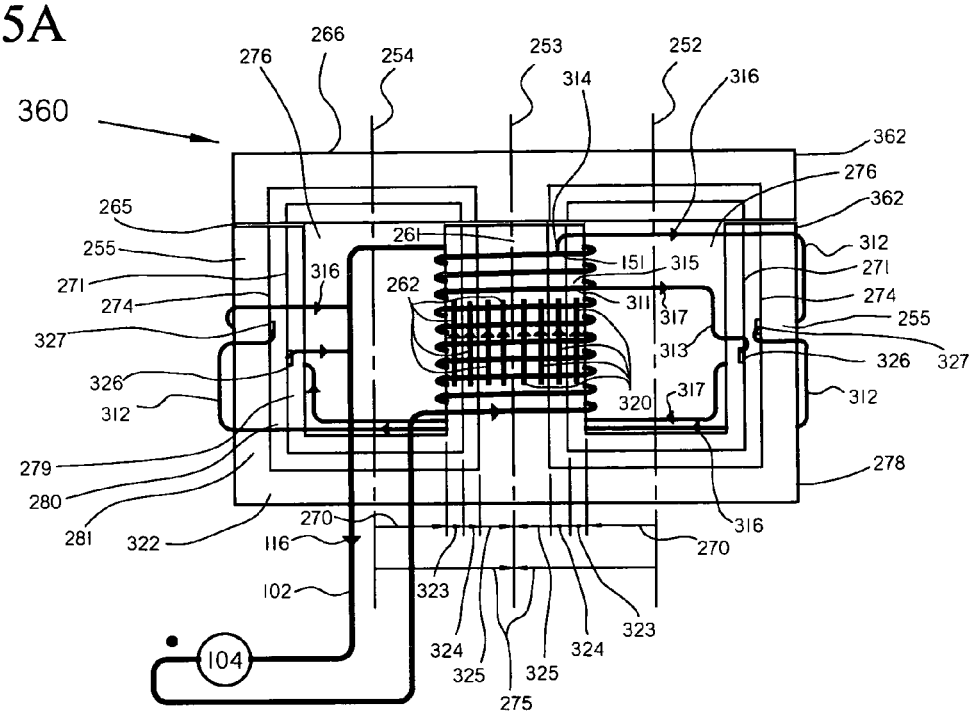
FIG. 5A is a top view of a high profile, solid block, square core inductor with a primary tap bias.
Figure 5B:
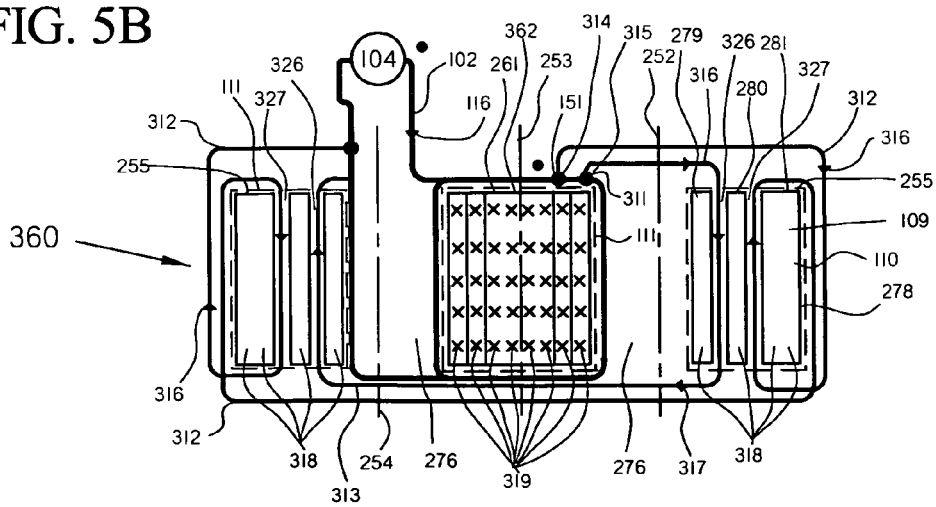
FIG. 5B is a cross-sectional view of the high profile, solid block, square core inductor of FIG. 5A.

The core modifications used to redistribute magnetic flux density, B(r), by core bias current, $I_B(f)$, are shown for a high profile E-I SBC inductor 360 in FIGS. 5A and 5B. The size, dimensions, and wiring used for the SBC inductor 360 are the same as used for the high profile LaC inductor 310 in FIGS. 2A and 2B. Consequently, the same part numbers used for FIGS. 2A and 2B are used to identify similar parts in FIGS. 5A and 5B.

The building blocks of the square core SBC device are the molded solid "E" section 278 and the solid "I" section 266 constructed with SBC magnetic material. The "E" section 278 consists of a spine 322, outer legs 255 and a center leg 261. The width of the outer legs 255 is the same as the width of the "I" section 266 and the width of the spine 322. The length of the E-I sections 278 and 266 and the length of the legs 255 may vary with finished device requirement. The width of the center leg 261 is typically twice the width of the outer legs 255 and is equally divided by a center line 253. The winding window openings 276 have a length and width that is equally divided by the centerlines 252 and 254. Closure of the "E" and "I" sections 278 and 266 form a magnetic core 362 with an interface gap 265 between the sections 278 and 266.

The "E" and "I" core sections 278 and 266 contain longitudinal cut slits 271 and 274 which radially subdivide the "E" and "I" sections 278 and 266 into three solid sub-sections 279, 280 and 281. The widths of the sub-sections 279 and 280 are equal. The width of the sub-section 281 is twice the width of either sub-sections 279 and 280.

The "E" and "I" core sections 278 and 266 are molded to a required magnetic height for the core 362. The "E" and "I" core sectioning as shown in FIG. 5A completely separates the sections 278 and 266 which requires an auxiliary handling system for the sections. Alternatively the sectioning may leave each section 278 and 266 with one magnetic material connection with adjacent sections that keeps the solid core integrity for handling the core sub-sections 279, 280 and 281. Alternatively, the sectioning may leave each section 278 and 266 with two or more magnetic material connections with adjacent sections, such as a connection 294 in FIG. 1A, that keeps the handling integrity of the solid core pieces. A double material keeper section may also be used at other points along the slits 271 and 274.

The inductor wire winding 102 is usually pre-wound by a winding machine on a nonconductive bobbin. The solid core sub-sections 279, 280 and 281 are inserted and stacked in the center of the bobbin to complete the assembly. The core winding window opening 276 is formed by the closure of the "E" section 278 and the "I" section 266 and limits the total cross sectional area, $A_C$, of the inductor winding 102 that may be used in a given winding window contained by the outside width and length. After the inductor winding 102 is applied, a thin insulative layer III may be wrapped around all the finished magnet wire winding.

It is to be understood that one longitudinal slit may be used in place of the double slits on the SBC "E" section 278 and "I" section 266. Similar to the criteria for the number of passages in the toroid TWC transformer, the more passages that are in the SBC, the more power density increases. However, a simpler one slit, two wire, bias current modification may sufficiently redistribute magnetic flux density for certain applications.

Square Core, High Profile Solid Block Core, with Tapped Bias Current

The tapped bias current wiring 312 carries a tapped bias current 316 through the core 362 in FIGS. 5A and 5B by a single conductor through a notched passage 327 located along the longitudinal slit 274, spaced from the center lines 252 or 254 of the winding windows 276. The tapped bias current wiring 313 carries a tapped bias current 317 through the core 362 by a single conductor through a notched passage 326 located along the longitudinal slit 271. The slit 271 is spaced from the center lines 252 or 254 of the winding windows 276. The slit 274 longitudinally bisects the outer legs 255, the spine 322 and the "I" section 266. The slit 271 longitudinally bisects the inner half of the outer legs 255, the spine 322 and the "I" section 266.

The tapped bias wiring scheme is shown in the right half of the core 362 in FIG. 5B. The tapped bias current wiring 312 starts at a tap 151 along the primary winding 102 which provides a bias voltage, $V_B(f)$, 314 to drive the tapped bias current 316 through the tapped bias current wiring circuit 312. The wiring is threaded through the notched passages 327 located along the slit 274.

The tapped bias current wiring 313 starts at a tap 311 along the inductor winding 102 which provides a bias voltage, $V_B(f)$, 315 to drive the tapped bias current 317 through the tapped bias current wiring 313. The wiring 313 is threaded through the notched passages 326 located along the slit 271.

The maximum core bias current flux density distribution, $B_{BMx}(r)$, of the high profile inductor 360 is the same as the maximum core bias current flux density distribution, $B_{BMx}(r)$, for the high profile inductor 310 in FIGS. 2A and 2B and is shown by the curve 738 in FIG. 23.

The bias current flux density distribution, $B_{BMx}(r)$ represented by the curve 738 in FIG. 23 for the core 362 used in the inductor 360 is an example of optimally using a magnetic core at its peak magnetic permeability, μ.

Capacitance Enhanced Magnetic Core Construction

Uniformly distributing capacitance, Cn, along a length, μ, of a magnetic core causes the core's inductance, L, to subdivide into distributed inductances, Ln, and commingle with the distributed capacitance, Cn, so as to form a transmission line. A magnetic core used to construct a transmission line may also optimally redistribute the magnetic flux density from over utilized areas of the core cross section to under utilized areas of the cross section. The redistribution is similar to the magnetic flux density redistribution caused by a large number of frequency sensitive small bias currents flowing through the core. The magnetic flux density redistribution is optimized when the capacitance distribution across the device is optimized and the device is operated at its optimum frequency, $f_o$.

A transmission line where the values of the distributed capacitance, Cn, and the distributed inductance, Ln, are independently adjustable is referred to as a heterogeneous transmission line. A transmission line where the values of the distributed capacitance, Cn, and the distributed inductance, Ln, are dependent on each other is referred to as a homogeneous transmission line. Capacitance enhanced magnetic device 450 shown in FIGS. 9A and 9B; device 500 shown in FIGS. 10A and 10B; device 530 shown in FIGS. 11A and 11B; and device 570 shown in FIGS. 12A and 12B are unique heterogeneous transmission lines used to construct magnetic cores usually used for transformers or inductors. Magnetic devices such as a device 600 shown in FIGS. 18A and 18B; and a device 620 shown in FIGS. 19A-19C are homogeneous transmission lines used to construct magnetic cores usually used for transformers or inductors.

Figure 6:
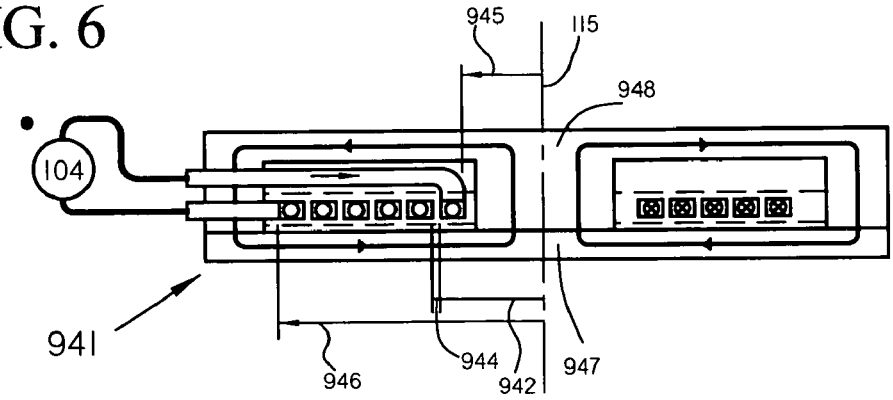
FIG. 6 is a cross-sectional view of a spiral wound inductor having a solid block planar core.
Figure 7A:
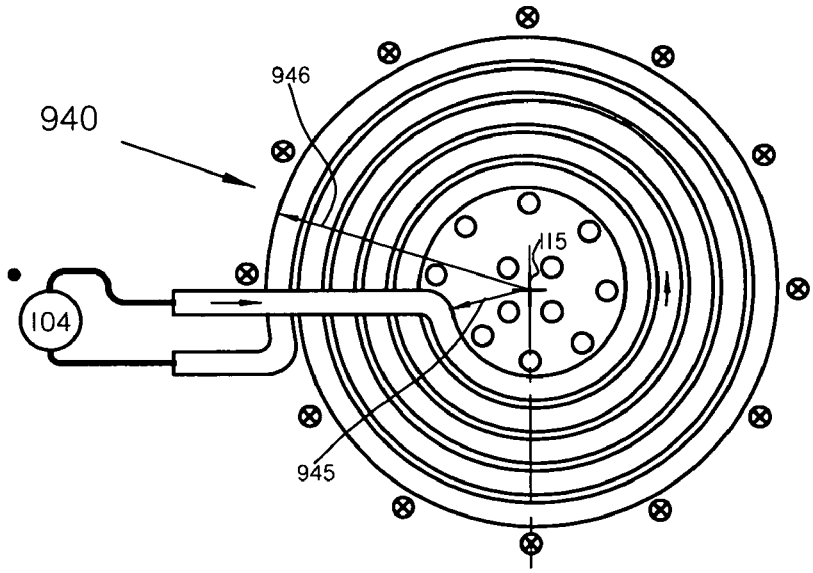
FIG. 7A is a top view of a spiral wound inductor with an air core.
Figure 7B:
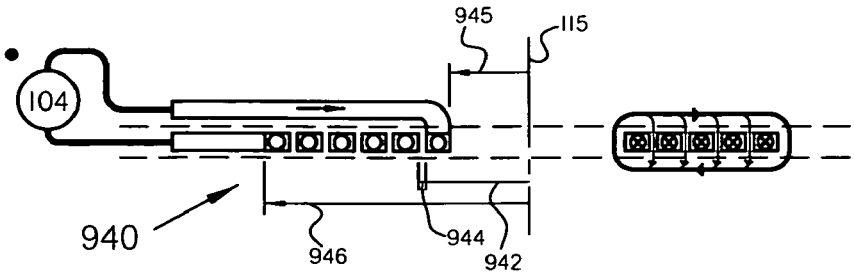
FIG. 7B is a side view of the spiral wound inductor of FIG. 7A.

The devices 450, 500, 530, 570, 600 and 620 may replace spiral wound inductors and transformers such as a device 941 in FIG. 6 and a device 940 in FIGS. 7A and 7B. For high frequency operating devices, the devices 570, 600, and 620 are alternatives to spiral wound magnetics.

The devices 450 and 500 in FIGS. 9A and 9B and FIGS. 10A and 10B respectively are transmission lines which use straight linear conductors such as a top conductor 454 and a bottom conductor 453, electrically connected at input terminals 461 and 462 by wires 452, to an input voltage 456. These transmission lines are terminated at terminals 463 and 464 by a short circuit wire conductor 455 carrying a short circuit termination current 470.

The straight linear conductors 454 and 453 may be replaced with planar disks. If planar disks are used, then the wire conductors 452 and 455 may be used to access or terminate the transmission line as long as an E-M mechanism for quickly gathering or dispersing charges is in place at the connection terminals 461, 462, 463 and 464 used by the conductive disks.

Figure 11A:
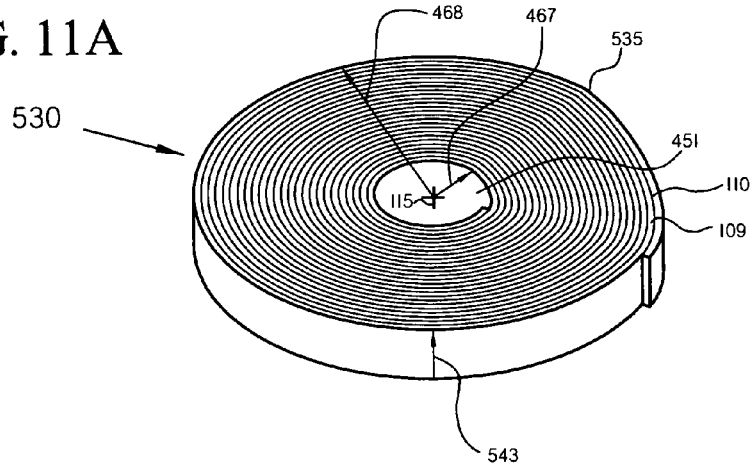
FIG. 11A is an isometric view of a tape wrapped toroid core with pancake distributed capacitance.

A technique for quickly gathering or dispersing charges at the device's connection terminals is to have a slight conductive overhang such as the overhang 531 in FIG. 11A, at the input terminals 461 and 462 and a slight conductive overhang 532 at the output terminals 463 and 464 whereby an air dielectric transmission line is formed at the edge of the planar conductor. The transmission lines 530, 570, 600, and 620 in FIGS. 11B, 12B, 18B and 19C respectively, use conductive planar top disks 534, 572, 602, 628, 630 and 638 and conductive planar bottom disks 533, 571, 601, 627, 629 and 637 for their transmission line conductors between their input and output connection terminals. Each conductive planar disk in FIGS. 11B, 12B, 18B and 19C has the overhang 531 at its input terminals 461 and 462 and an overhang 532 at the output terminals 463 and 464. The overhangs 531 and 532 provide local transmission lines along the conductive edge of the planar disks by which charges can quickly gather or disperse. These edge transmission lines have an air dielectric and a velocity of E-M wave propagation, $v_{pair}$. The transmission line between the input and output conductors has a velocity of E-M wave propagation, $v_{pdev}$, determined by the magnetic and dielectric media between the conductors. Successful gathering and dispersing of charges at the overhangs 531 and 532 requires $v_{pair}$ to be much greater than $v_{pdev}$. Foil wiring best serve the device's electrical connection requirements when $v_{pair} \approx V_{pdev}$.

Figure 9A:
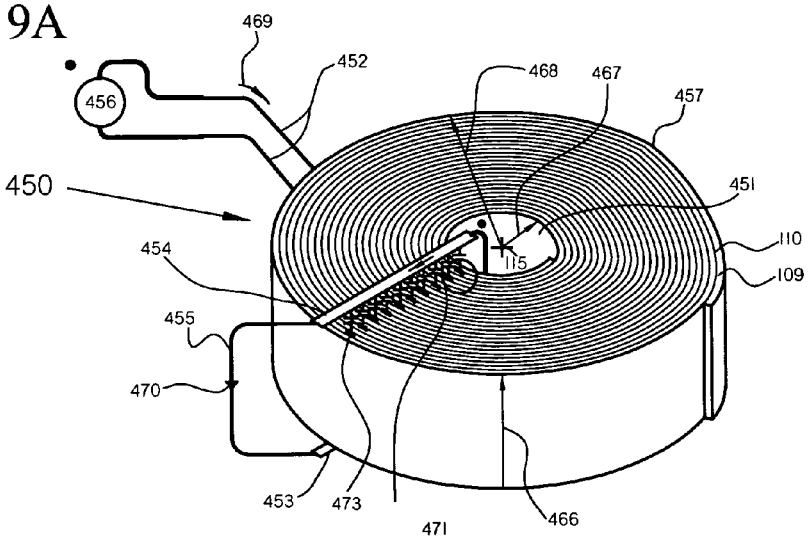
FIG. 9A is an isometric view of a tape wrapped toroid core with an externally distributed capacitance.
Figure 9B:
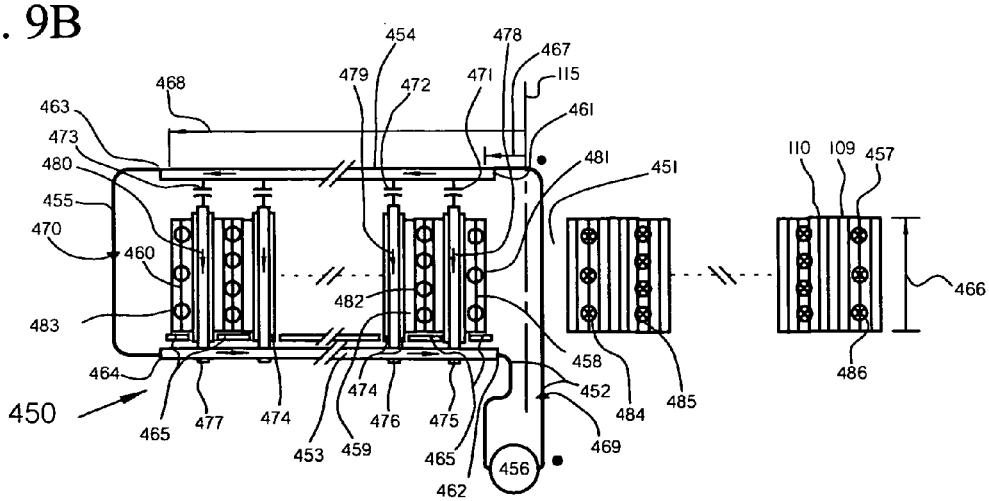
FIG. 9B is a cross-sectional view of the toroid core of FIG. 9A.

A capacitance enhanced magnetic device 450 is shown in FIGS. 9A and 9B. The capacitance enhanced magnetic device 450 includes a tape wound magnetic core 457 constructed to electrically connect a number, n, of discrete, external, capacitors 471, 472, and 473, to through-the-core insulated conductors 475, 476 and 477, appropriately distributed along the radial cross sectional length of the tape wound core 457. The core 457 is constructed of a conductive magnetic tape 109. The cross sectional length, $l_r$, of the TWC 457 is the difference between the radius of the outer diameter, $r_{ODe}$, 468 and the radius of the inner diameter, $r_{IDe}$, 467. This construction requires the magnetic core 457 to be annealed first and then the capacitors 471, 472 and 473 are electrically attached to the conductors 475, 476 and 477. Since most dielectric materials, except mica and ceramic, do not survive the annealing temperatures, using capacitors external to the magnetic core 457 is a preferred capacitance in enhanced magnetics construction.

The number of sections, n, is determined by the number of capacitors required for the design. A series of through-the-core conductors 475, 476, 477 divide the magnetic core 457 into n inductive sections 458, 459, 460 discretely distributed along the radial length, $l_t$, of the core 457. When the n capacitors 471, 472, 473 are electrically connected to the conductors 475, 476, 477 a like number of discrete, sequential, inductive-capacitive filter sections are formed. The filter sections are radially connected by a top and bottom radial conductor 454 and 453 forming a discretely implemented transmission line, which can also be used as the core of a toroidal transformer or inductor.

Referring to FIG. 9B, the core 457 is co-wound with insulated tabbed conductors 475, 476, 477 which are inserted radially, inline, and through the magnetic TWC 457. The conductors 475, 476, 477 are insulated from the conductive magnetic TWC 457 with a thin dielectric 474. The bottom radial conductor 453 is electrically connected to the bottom of all the tabbed conductors 475, 476, 477. The conductive magnetic TWC 457 is insulated from the bottom radial conductor 453 by a thin dielectric 465. The top or tabbed ends of the feed through conductors 475, 476, 477 electrically connect, respectively, to one end of the discrete capacitors 471, 472, 473. The other ends of the discrete capacitors 471, 472, 473 all are electrically connected to the top radial conductor 454. A short circuit termination wire 455 is attached at two transmission line terminals 463 and 464 located at a $r_{ODe}$, 468 of the core 457. The transmission line terminals 461 and 462 are located at a $r_{IDe}$, 467 of the inner diameter and provide the input connection points for a current wire 452 conducting an input current 469 driven by an input voltage 456.

The device 450 has a top wire conductor 454 and bottom wire conductor 453. Alternatively, either or both conductors 453 and 454 could be replaced by conductive disks, plates or wedges.

Figure 10A:
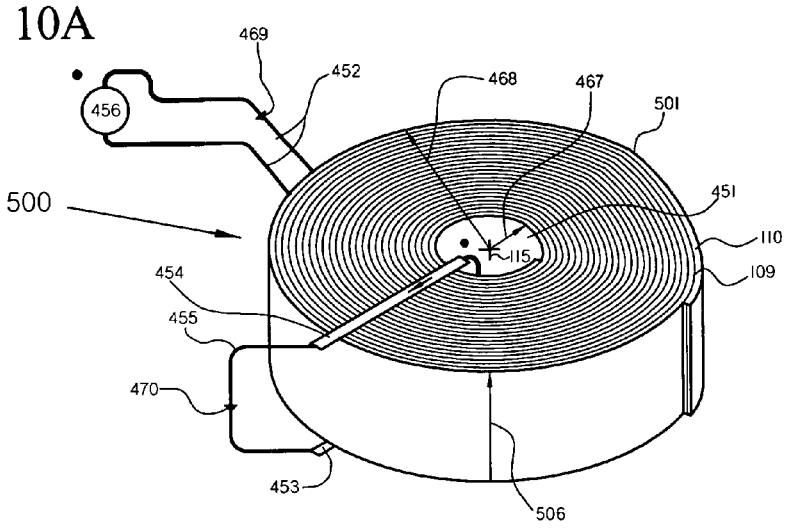
FIG. 10A is an isometric view of a tape wrapped toroid core with an internally distributed capacitance.
Figure 10B:
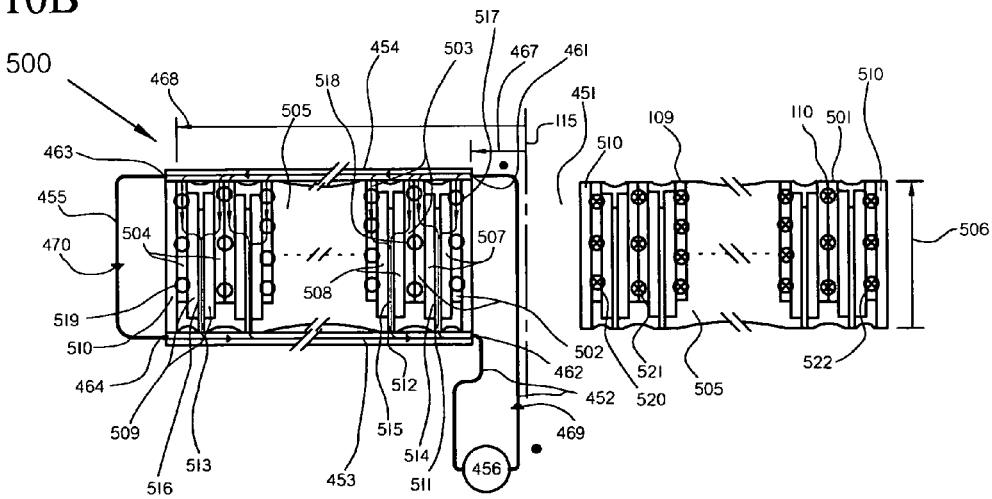
FIG. 10B is a cross-sectional view of the toroid core of FIG. 10A.

Another example capacitance enhanced magnetic device 500 is shown in FIGS. 10A and 10B. The capacitance enhanced magnetic device 500 has an offset co-wound core 501 having a conductive tape wound magnetics 109 co-wound with a copper or aluminum foil which forms multiple electrical contacts 511, 512, 513 and a thin dielectric that forms the device's distributed capacitances (C1-Cn) 507, 508, 509. If the magnetics requires annealing, then the dielectric layer forming the capacitors 507, 508, 509 may be constructed of mica to withstand the annealing temperature.

FIG. 10B is a cross-section of the device 500 showing a repetitive sequential grouping of the multiple magnetics layers 502, 503, 504, the conductor layers 511, 512, 513 and the dielectric layers 507, 508, 509 along the radial cross sectional length, $l_t$, of the tape wound core 501. Each grouping is mechanically referred to as a "wad" which is a discrete inductor-capacitor filter. In a "wad" the magnetics layers 502, 503, 504 form the n discrete inductors, and the discrete capacitor consists of the n thin dielectric layers 507, 508, 509 whose plates are formed with the conductive magnetic layers, and the conductive foils 511, 512, 513. The number, n, of cross-sectional repetitive inductive and capacitive sections is the cross-sectional length, $l_t$, divided by the thickness of one "wad." ($n=l_t$/("wad" thickness). The cross sectional length, $l_t$, shown in FIG. 10B is the difference between the $r_{ODe}$ 468 and the $r_{IDe}$ 467. In the construction shown in FIG. 10B, the thickness of a "wad" is the summation of two layers of magnetic foil in the core 501, two layers of thickness of a dielectric such as the dielectric layer 507 and one layer of a conductor such as the conductor 511. When the inductor-capacitor filter sections are radially connected by an upper and a lower radial conductor 453 and 454, a discretely implemented, n-section, transmission line is formed that has an equivalent circuit 920 of FIG. 24.

The magnetic layers 502, 503, 504 are offset to make electrical contact with the upper radial conductor 454. The dielectric layers 507, 508, 509 have an upper offset to cover the upper end of the conductors 511, 512, 513 to prevent them from shorting to the conductive magnetic layers 502, 503, 504. Likewise, the dielectric layers 507, 508, 509 each have a lower offset which covers the lower end of the conductors 511, 512, 513 to prevent them from shorting to the conductive magnetic layers 502, 503, 504. Before the radial conductors 454 and 453 are attached, the co-wound assembly is vacuum impregnated with a non-conductive potting compound 505 contained by dielectric potting cups 510 to provide mechanical stability for the assembly of the device 500. A short circuit termination wire 455 is attached at a pair of transmission line terminals 463 and 464 located at the $r_{ODe}$ 468. A second pair of transmission line terminals 461 and 462 is located at the $r_{IDe}$ 467 to provide the input connection points for the wires 452 conducting the input current 469 driven by an input voltage 456. Either or both the top wire conductor 454 and the bottom wire conductor 453 may be replaced by conductive disks, plates or wedges.

Figure 11B:
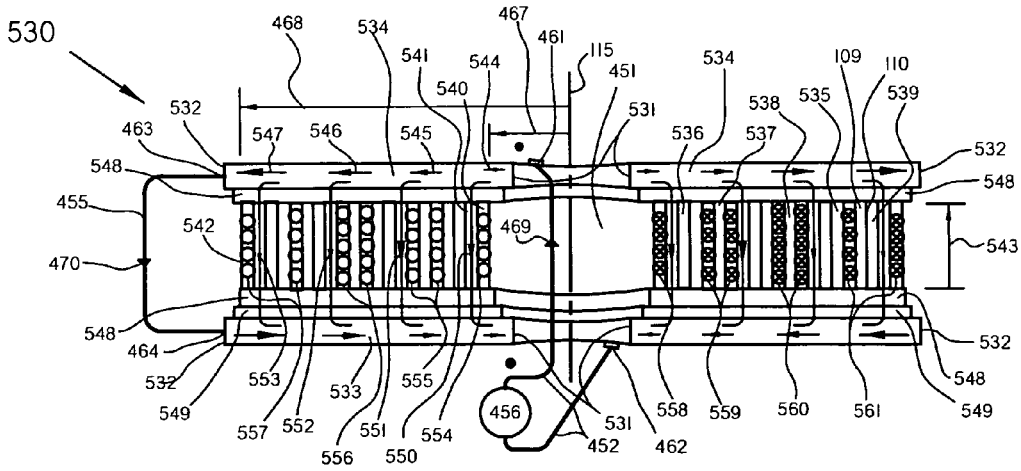
FIG. 11B is a cross-sectional view of the toroid core with pancake distributed capacitance of FIG. 11A.
Figure 12A:
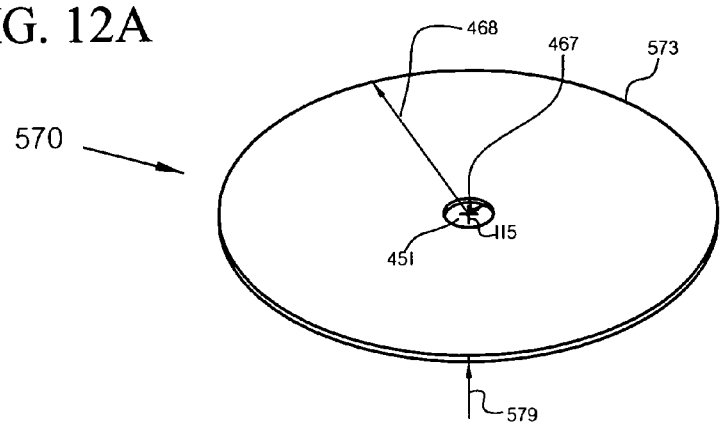
FIG. 12A is an isometric view of a toroid core foil for a pancake distributed capacitance.
Figure 12B:
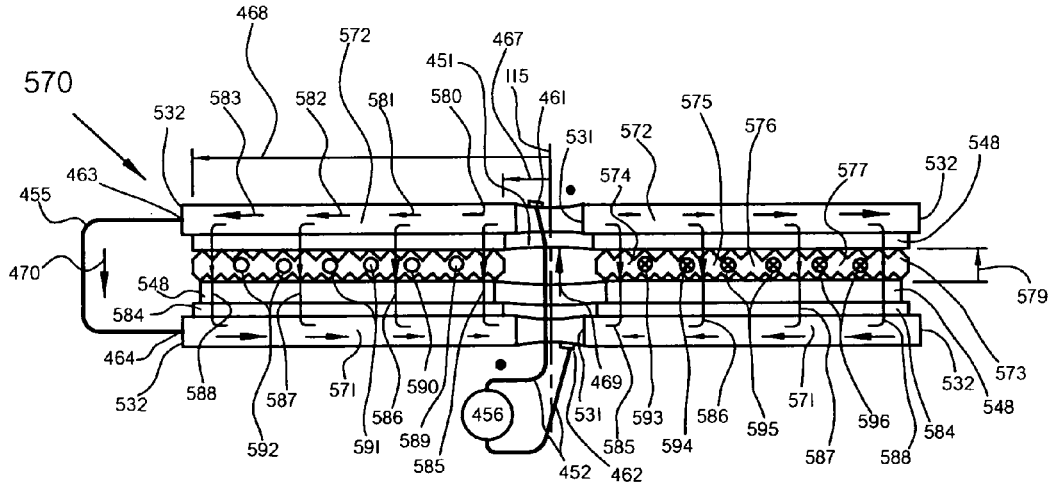
FIG. 12B is a cross-sectional view of the toroid core foil with pancake distributed capacitance of FIG. 12A.

FIG. 11A-11B show another example capacitance enhanced magnetic device 530 which is constructed by layering a conductive tape wound magnetic core 535 with a pancake dielectric 549 and upper and lower conductive disks 534 and 533. An anisotropic conductive interface material 548 electrically connects the magnetic core 535 to the upper conductive disk 534 and electrically connects the lower side of magnetic core 535 to the lower conductive disk 533. The tape wound magnetic core 535 is first annealed, then a low temperature dielectric layer 549 that forms the capacitance is added. An anisotropic conductive interface 548 joins the conductive magnetics 535 with the dielectric layer 549 and the upper and lower conductive disks 534 and 533. The anisotropic conductive interface 548 is maximally conductive in the vertical direction and minimally conductive in the radial direction. Loctite products 3441 or 3447 are anisotropic conductive adhesives that may be used.

FIGS. 12A-12B show another example capacitance enhanced magnetic device 570 that is constructed by layering a conductive magnetic foil disk core 573 with a pancake dielectric 584 and upper and lower conductive disks 572 and 571. An anisotropic conductive interface material 548 electrically connects the foil magnetic core 573 to the upper conductive disk 572 and electrically connects the lower side of magnetic core 573 to the lower conductive disk 571. The magnetic disk core 573 is annealed, then cut to shape or alternatively, cut to shape and then annealed; and then the low temperature dielectric layer 584 that forms the capacitance dielectric is added. Alternatively, more than one thin magnetic foil disk such as the foil disk core 573 may be stacked on each other to form the magnetic core.

The single foil magnetic core 573 is shown in FIG. 12B with its facial surface greatly exaggerated to illustrate the surface roughness of electrically interfacing to the magnetic core 573. A compliant anisotropic conductive interface 548 joins the conductive magnetic disk 573 with the dielectric layer 584 and the upper and lower conductive disks 572 and 571. The anisotropic conductive interface 548 is maximally conductive in the vertical or compressed direction, and minimally conductive in the radial direction.

Figure 18A:
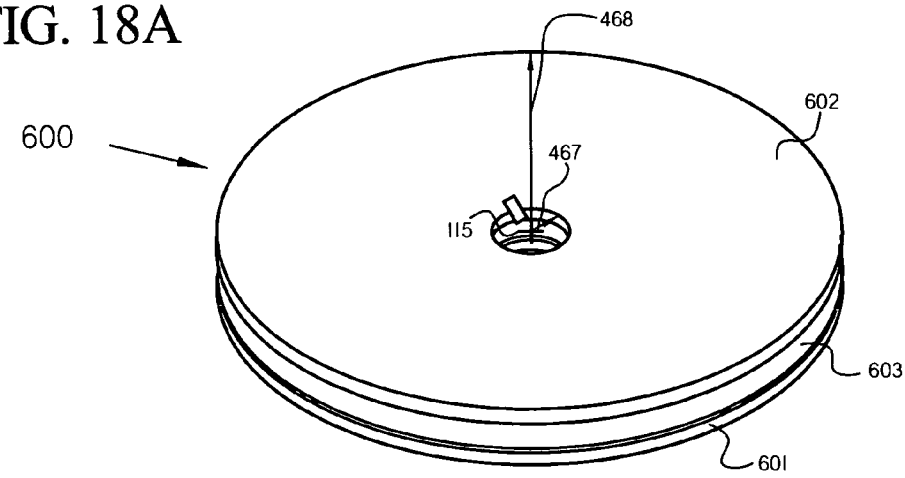
FIG. 18A is an isometric view of a toroidal dielectric core with homogeneously distributed capacitance.
Figure 18B:
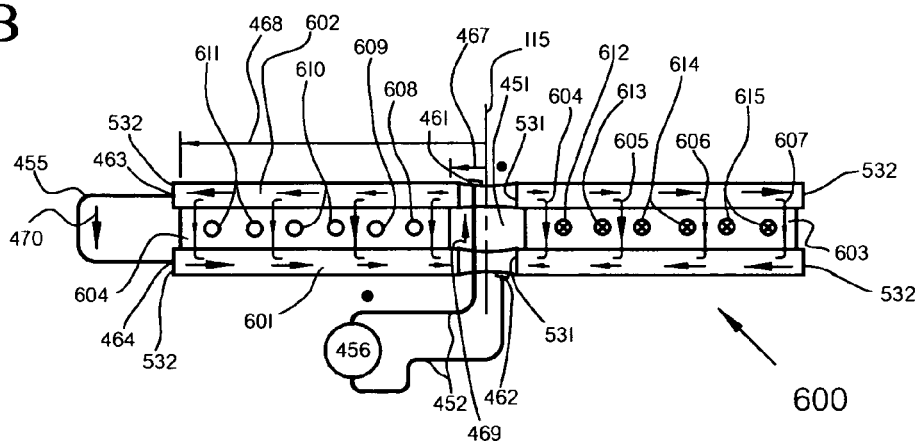
FIG. 18B is cross-section view of the toroidal dielectric core with homogeneously distributed capacitance of FIG. 18A.
Figure 19A:
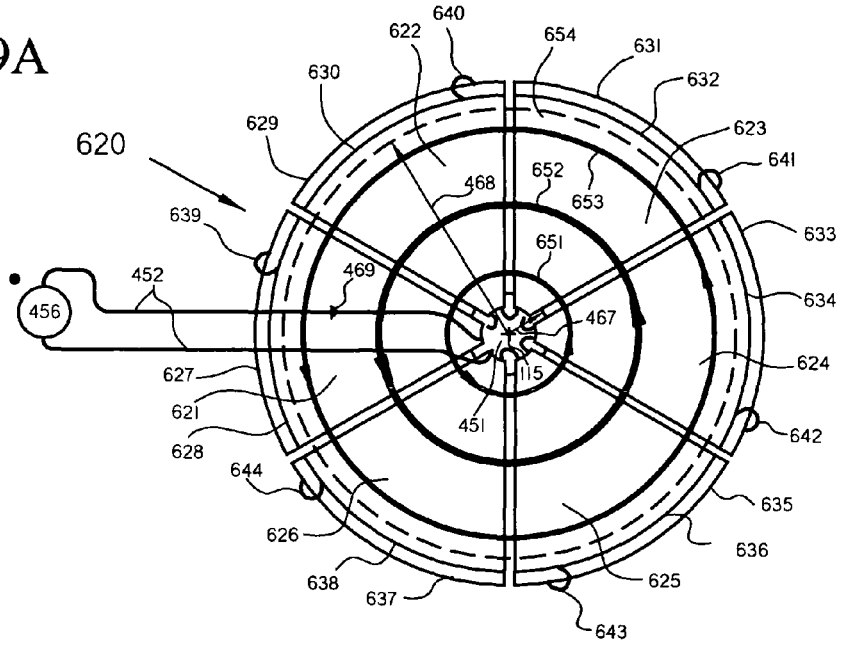
FIG. 19A is a top view of a six segment toroidal dielectric core with homogeneously distributed capacitance.
Figure 19B:
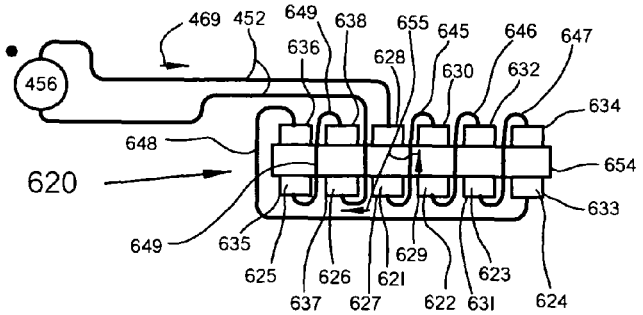
FIG. 19B is a top view of a six segment toroidal dielectric core with homogeneously distributed capacitance showing six interior transmission lines.
Figure 19C:
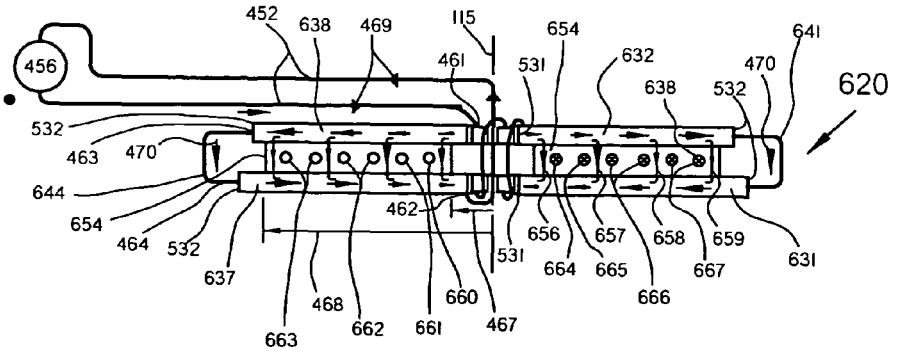
FIG. 19C is a cross-sectional view, through transmission line sections three and six of the six segment toroidal dielectric core with homogeneously distributed capacitance in FIG. 19B.

A capacitance enhanced magnetic device 600 shown in FIGS. 18A-18B includes a dielectric or air core magnetic disk 603 upon which an upper conductive disk 602 and a lower conductive disk 601 are placed. The conductive disks 602 and 601 may be plated, sprayed, or vapor deposited on the dielectric or air core magnetic disk 603. The device 600 is constructed similarly to the device 570 in FIGS. 12A-12B. However, the magnetics and dielectric material in FIGS. 18A-18B are homogeneous instead of the discrete or heterogeneous materials used to construct the device 570. Consequently, the anisotropic interface 548 is not needed. However, the relative permeability, $\mu_r$, of the air core magnetics is one, the lowest possible relative magnetic permeability.

FIGS. 19A, 19B and 19C, are the top, inner periphery, and cross sectional views of a capacitance enhanced magnetic device 620 whose core is homogeneously constructed similar to the device 600 in FIGS. 18A-18B. The surface conductors in the device 620 are electrically divided into six wedge shaped segments 621, 622, 623, 624, 625 and 626. Each wedge shaped segment 621-626 is an independent transmission line electrically interconnected in series with each other. Each transmission line is terminated at the effective radius of outer diameter, $r_{ODe}$, 468 in a short circuit shown respectively as conductors 639, 640, 641, 642, 643 and 644.

FIG. 19B shows a series of connecting wires 645, 646, 647, 648 and 649 interconnecting the segmented sections 621-626 to each other and an input voltage 456. A wire 452 connects the input voltage 456 to the top conducting segment 628 and a wire 645 connects the bottom conducting segment 627 to the adjacent top conducting segment 630. A wire 646 connects the bottom conducting segment 629 to the adjacent top conducting segment 632 and a wire 647 connects the bottom conducting segment 631 to the adjacent top conducting segment 634. A wire 648 connects the bottom conducting segment 633 to the adjacent top conducting segment 636, a wire 649 connects the bottom conducting segment 635 to the adjacent top conducting segment 638, and the wire 452 connects the bottom conducting segment 637 to the input voltage 456.

Capacitance Enhanced Magnetic Core Operation

Adding distributed capacitance, Cn, to a magnetic core may redistribute the magnetic flux density from over utilized areas of the core's cross section to under utilized areas of the core's cross section, thereby improving the magnetic device's power density. The capacitance enhanced devices 450, 500, 530, 570, 600 and 620 have capacitance optimally and radially distributed along their magnetics from the common radius of the inner diameter 467 to the common radius of outer diameter 468. In a circular toroidal core, the magnetic flux density redistribution is optimized when the radial capacitance distribution, Cn(r), is proportional to the radial length, r, ($Cn(r) \propto r$), the device is operated at its optimum frequency, $f_o$, and the radial inductance distribution (Ln(r)), is inversely proportional to the radial length, r, ($Ln(r) \propto 1/r$). Magnetic devices constructed in this manner intrinsically form a power transmission line.

Besides having magnetic flux density optimally redistributed when operated in the steady state, at frequency, $f_o$, a capacitance enhanced magnetic device exhibits a higher steady state operating impedance and faster developing transient magnetic forces. The transient magnetic forces within the capacitance enhanced magnetic device caused by transient voltage, V(t), increase faster than equivalent magnetic devices without distributed capacitance, thereby accelerating the starting operation of electromechanical devices such as electric motors, solenoids, relays and rail guns.

Distributed maximum displacement currents ($I_{Dx}(f_o)$) redistribute the magnetic flux density. Similar to the core bias currents, $I_{Bx}(f)$, the distributed capacitance, Cn(r), maximum displacement currents, $I_{Dx}(f_o)$, appropriately counteract the flux density of the maximum magnetizing current, $I_{Mx}(f_o)$, in areas of the core that have excess flux density and, in turn, generate flux density in areas of the core that benefit from increased flux density. The displacement currents, $I_{Dx}(f_o)$, are frequency dependent and thus the optimum flux density redistribution is frequency dependent having an optimum operating frequency, $f_0$, near but less than the calculated linear quarter wavelength frequency, $f_{0.25\,\lambda P}$.

Displacement currents 478, 479, 480 are shown in the external capacitance device 450 in FIGS. 9A and 9B. Displacement currents 514, 515, 516 are shown in the internal capacitance device 500 of FIGS. 10A and 10B. Displacement currents 550, 551, 552 and 553 are shown in the external capacitance device 530 in FIGS. 11A and 11B. Displacement currents 585, 586, 587 and 588 are shown in the external capacitance device 570 in FIGS. 12A and 12B. Displacement currents 604, 605, 606 and 607 are shown in the homogeneous capacitance device 600 in FIGS. 18A and 18B. Displacement currents 656, 657, 658 and 659 are shown in the homogeneous capacitance device 620 in FIGS. 19A-19C.

The device 450 in FIGS. 9A and 9B is an example to show capacitance enhanced magnetic flux density redistribution by the discretely distributed displacement currents 478, 479 and 480 that flow through each of the external discretely distributed capacitors 471, 472, 473 and generate circumferential magnetic flux lines illustrated in FIG. 9B by points 481, 482, 483 and tails 484, 485, 486. The displacement current, $I_{Dx}(f_o)$, generated flux lines are in phase with the magnetic flux generated by the inductive magnetizing current, $I_{Mx}(f_0)$ 469 thereby redistributing magnetic flux density similar to the bias current described in the section on bias current magnetics. However, with capacitance enhanced magnetics, displacement currents penetrate through the core 457 through nearly infinitesimally distributed points along the toroidal device's radial length, $l_r$. An optimum distribution of capacitance across the radial cross sectional length, $l_r$, whereby the velocity of E-M wave propagation is constant throughout is required to achieve the maximum power density. Because of the optimum operating frequency's proximity to the device's quarter wave frequency, $f_{0.25\lambda P}$, the magnetizing current, $I_M(f_o)$, 469 at the optimum operating frequency, $f_o$, is less than the magnetizing current required for the same inductance, without distributed capacitance, operated at the same voltage and frequency. The reduced magnetizing current, $I_M(f_o)$ of the capacitance enhanced magnetics device further improves the power density of the circular toroidal device as well as does the redistributed magnetic flux density caused by the displacement currents, $I_{Dx}(f_o)$.

The capacitance enhanced magnetic devices 450, 500, 530 and 570 are circular toroidal shaped transmission lines consisting of circular toroidal shaped, high permeability, μ, distributed magnetics that uniquely and independently integrate into their structure toroidal shaped distributed capacitance. The capacitance enhanced magnetic device 600 in FIGS. 18A and 18B and the device 620 in FIGS. 19A-19C are circular toroidal shaped transmission lines consisting of circular toroidal shaped, dielectric or air core permeability, μ, distributed magnetics that uniquely and codependently integrate into their structure toroidal shaped distributed capacitance. In the toroidal transmission line, the distributed capacitance, capacitance per unit radial length, Cn(r), varies directly with the radius of the toroidal shaped transmission line, while the distributed inductance, inductance per unit radial length, Ln(r), varies inversely with the radius. If these circular toroidal transmission lines are operated at their optimum frequency, $f_o$, as 4-terminal transmission lines terminated in their characteristic output impedance, Zo, then the circular toroidal geometry can determine transformer turns ratio, N, instead of winding turns count, thereby simplifying transformer construction. That is, turns ratio, N, defined earlier as, Vp(f)/Vs(f)=N, and $I_{Sx}(f)/I_{Px}(f)=N$, may now be determined by the toroidal transmission line's ratio of radii, radius of inner diameter, $r_{ID}$, divided by radius of outer diameter, $r_{OD}$. N is proportional to $r_{ID}/r_{OD}$. ($N \propto r_{ID}/r_{OD}$)

In the magnetic device 450 in FIGS. 9A and 9B, the input components 921 and 924 of the transmission line equivalent circuit 920 in FIG. 24 are formed in the following manner. The magnetic core for the input distributed inductance 921 is formed by the first two inner layers of the TWC magnetics 458 on the input side of the vertical conductor 475. The conductive current loop required to define the distributed inductance 921 consists of the input voltage 456 connected by the input wires 452 to the top radial wire 454 which connects via the capacitor 471 (capacitor 924) to the vertical conductor 475 which connects to the longitudinal bottom conductor 453 and returns to the input voltage 456 via the input wires 452. The vertical conductor 475 carries the displacement current, $I_{D1}(f)$, 478 through the core 457 similar to the magnetic core bias current described in the toroidal and square core transformers.

The magnetic core for the second input distributed inductance 922 in FIG. 24 is formed by four successive layers of magnetic strips 459 between the vertical conductors 475 and 476 in FIGS. 9A-9B. The conductive current loop required to define the second input distributed inductance 922 consists of the top radial wire 454, which connects via the capacitor 471 to the vertical conductor 475, which connects to the longitudinal bottom conductor 453 which forward connects to the vertical conductor 476, which returns to the top radial conductor 454 by the capacitor 472 (capacitor 925). The vertical conductor 476 carries the displacement current, $I_{D2}(f)$, 479 through the core 457 similar to the magnetic core bias current described in the toroidal and square core transformers. The electrical pattern repeats until the end of the line at the radius of the outer diameter, $r_{ODe}$ 468.

The direction of the flux vectors 481, 482, 483 and 484, 485, 486 is determined by the "right hand" rule for magnetizing current flowing up in the input conductor, and then to the left as longitudinal current in the top conductor 454. The flux vectors 481, 482, 483 and 484, 485, 486 are out of the page on the left side of the center line 115 and into the page on the right side of center line 115.

The curve 782 in FIG. 25 is the flux density distribution, $B_{Mx}(r)$, of the magnetic core 457 without the benefit of distributed capacitance. The displacement currents of the external discrete distributed capacitors 471, 472, 473 set up discrete magnetic force fields, $AT_{Dxn}(f)$, along the radial length, $l_r$, between the radii 467 and 468 in the device 450. Because of the 180° phase shift with respect to the magnetizing current force fields, $AT_{Mx}(f)$, the currents cause the redistribution of magnetic flux density throughout the core 457. The discrete capacitors 471, 472, 473 added to the core 457 change the core's flux density distribution, when operated at optimum frequency, $f_o$, to the curve 783 in FIG. 25 which allows a reduction in the toroidal strip width by 30%, thereby increasing the device's power density by 42%. The maximum flux density distribution for the reduced strip width is the curve 784 in FIG. 25. The non-linearity of the magnetic material, as discussed for TWC and LaC, may increase the power density gain well beyond 42%.

The magnetic device 500 in FIGS. 10A and 10B operates in a similar manner to the device 450 of FIGS. 9A and 9B, except the distributed capacitance is discretely implemented internally within the magnetic core 501. As explained above, the corresponding equivalent inductors 921, 922 and 923 and capacitors 922, 924, and 926 are constructed in "wads" of a section of magnetic material forming the core of the distributed inductance, Ln, and a section of dielectric material, integrated with the magnetics, forming the corresponding distributed capacitance, Cn.

The equivalent of the circuit capacitor 924 in FIG. 24 for the device 500 in FIG. 10B is a parallel combination capacitor formed by the two dielectric layers 507 sandwiched between two common connected conductive plates, the magnetic core material layers 502 and one conductive foil 511. Similarly, the equivalent circuit capacitor 925 is a parallel combination capacitor formed by two dielectric layers 508 sandwiched between two common connected conductive plates, the magnetic core material layer 503 and one conductive foil 512. Multiple discrete capacitors are continuously formed along transmission line 500 until the last capacitor is formed at the end of the line at radius 468 by two dielectric layers 509 sandwiched between the last two common connected conductive plates, the magnetic core material 504 and the conductive foil 513.

The magnetic core for the input distributed inductance 921 is formed by the first two inner layers of the TWC magnetics 502, one layer on the input side of the vertical conductor 511 and the other layer on the output side of the vertical conductor 511. The conductive current loop defining distributed inductance 921 consists of the input voltage 456 connected by the input wires 452 to the top radial wire 454 which connects via the capacitor 924 to vertical conductor 511 which connects to the longitudinal bottom conductor 453 which returns to the input voltage 456 via the input wires 452. The vertical conductor 511 carries the displacement current, $I_{D1}(f)$, 514, formed by two strands of displacement current through both dielectrics 507, which together form the capacitor 924. The displacement current, $I_{D1}(f)$, 514 is similar to the magnetic bias current described in the toroidal and square core transformers. The displacement currents, $I_{Dn}(f)$ generate magnetic flux vector points 517, 518, 519 and 520, 521, 522 which set up discrete magnetic force fields, $AT_{Dn}(f)$, along the radial length of the device that by their 180° phase shift with respect to magnetizing current, $I_M(f)$ aids the redistribution of magnetic flux density throughout the core 501.

The magnetic device 530 in FIGS. 11A and 11B operates similar to the device 450 in FIGS. 9A and 9B and the device 500 in FIGS. 10A and 10B by using the conductive magnetic material layers 540, 541, 542 as the vertical conductors carrying "n" channels of displacement current, $I_{Dn}(f)$, through the core 535, similar to the core bias current, $I_B(f)$, described for the toroidal and square core transformers.

The capacitance enhanced magnetic device 530 is a toroidal transmission line, having distributed capacitances 924, 925 through 926 in FIG. 24 implemented with a pancake dielectric 549 attached to the bottom surface of the magnetic core 535 by the anisotropic vertically conducting interface material 548. Each layer of the TWC magnetic material 535 forms the core of the "nth" section of inductance in the transmission line equivalent circuit 920 in FIG. 24. The anisotropic conductive material 548 channels the displacement current through the "nth" conductive magnetic layer to the corresponding "nth" section of the dielectric in the dielectric layer 549 to form the pairs of distributed inductance 923 and distributed capacitance 926.

The cross section of the transmission line 530 in FIGS. 11A and 11B is subdivided into four sections 536, 537, 538 and 539 that show the relationship between the magnetic currents 544, 545, 546 and 547 and the displacement currents 550, 551, 552 and 553. At an optimum operating frequency, $f_o$, the magnetizing current 550 at the input at the radial position 467 is minimum, while the magnetizing current 553 at the output into a short circuit termination at the radial position 468 is maximum. The displacement currents 550, 551, 552 and 553 generate the magnetic flux vector points 554, 555, 556 and 557 and the magnetic flux vector tails 558, 559, 560 and 561 into the four magnetic cross sections 536, 537, 538, and 539. The displacement currents set up discrete magnetic force fields, $AT_{Dn}(f)$, along the radial length that by their 180° phase shift with respect to magnetizing current, $I_{Mx}(f)$, causes the redistribution of magnetic flux density throughout the core 535. The displacement current 551 located about 40% along the transmission line's length, $l_t$, is maximum, while the displacement current 553 located near the output radial position 468 is minimum. The displacement currents 550 and 552 are mid-valued and complete the displacement current distribution.

The magnetic device 570 in FIGS. 12A and 12B operates in a similar manner to the device 530 in FIGS. 11A and 11B except the device 570 uses the conductive circular magnetic foil to provide vertical displacement current conduction through the core 573 similar to the core bias current, $I_{Bx}(f)$, described for the toroidal and square core transformers. The capacitance enhanced magnetic device 570 is a toroidal transmission line, having distributed capacitances 924, 925 through 926 in FIG. 24 implemented with a pancake dielectric 549 attached to the bottom surface of the magnetic core 573 by the anisotropic vertically conducting interface material 548. The radial distribution of both the dielectric material 549 and the magnetic material 573 are continuously uniform. Consequently, the core for the distributed inductance 923 and the corresponding dielectric for the distributed capacitance 926 are infinitesimally distributed.

The cross section of transmission line 570 is subdivided into four sections 574, 575, 576 and 577 that show the trend of developing magnetic currents 580, 581, 582 and 583 and the displacement currents 585, 586, 587 and 588. At an optimum operating frequency, $f_o$, the magnetizing current 585 at the input at the radial position 467 is minimum, while the magnetizing current 588 at the output into a short circuit termination at the radial position 468 is maximum. The displacement currents 585, 586, 587 and 588 generate magnetic flux vector points 589, 590, 591 and 592; and magnetic flux vector tails, 593, 594, 595 and 596 into the four cross sections 574, 575, 576 and 577. The displacement currents set up discrete magnetic force fields, $AT_{Dn}(f)$, along the radial length of the device that by their 180° phase shift with respect to magnetizing current, $I_M(f)$, aid the redistribution of magnetic flux density throughout the core 573. The displacement current 586 located about 40% along the transmission line's length, $l_t$, is maximum, while the displacement current 588 located near the output radial position 468 is minimum. The displacement currents 585 and 587 are mid-valued and complete the displacement current distribution.

The curve 782 in FIG. 25 is the flux density distribution, $B_{Mx}(r)$, of the magnetic cores of the devices 500, 530 and 570 without the benefit of distributed capacitance. The displacement currents of the discrete internally distributed capacitors 924, 925 through 926 set up discrete magnetic force fields, $AT_{Dxn}(f)$, along the radial length, $l_t$, between radii 467 and 468, that, because of their 180° phase shift with respect to magnetizing current force fields, $AT_{Mx}(f)$, causes the redistribution of magnetic flux density throughout the core. The discrete capacitors, 924, 925 through 926, added to the cores change the flux density distribution, when operated at optimum frequency, $f_o$, to the curve 783 in FIG. 25 allowing a reduction in the toroidal strip width by 30%, thereby increasing the device's power density by 42%. The maximum flux density distribution for the reduced strip width is shown by the curve 784. The non-linearity of the magnetic material, as discussed for a TWC and a LaC, may increase the power density gain well beyond 42%.

The magnetic device 600 shown in FIGS. 18A and 18B operates in a similar manner to the device 570 shown in FIGS. 12A and 12B. The magnetic device 600 includes a non-conductive dielectric core 603 as vertical conductors carrying a displacement current, $I_{Dx}(f)$, through the dielectric core 603 similar to the core bias current, $I_B(f)$, described for the toroidal and square core transformers. The magnetic device 600 is a toroidal transmission line having capacitance homogeneously distributed with the pancake dielectric core 603. The maximum magnetic flux density distribution, $B_{Mx}(r)$, is optimum when operated at optimum frequency, $f_o$. Displacement currents, $I_{Dn}(f)$, 604, 605, 606 and 607 generate magnetic flux vector points 608, 609, 610 and 611; and magnetic flux vector tails 612, 613, 614 and 615 which set up discrete magnetic force fields, $AT_{Dn}(f)$, along the radial length of the device 600 that by their 180° phase shift with respect to the magnetizing current, $I_M(f)$, 469 aids the redistribution of magnetic flux density throughout the dielectric core 603.

The magnetic device 620 shown in FIGS. 19A and 19B operates in a similar manner to the device 600 shown in FIGS. 18A and 18B. The magnetic device 620 has a non-conductive dielectric core 654 which carries a displacement current, $I_D(f)$, through the core 654, similar to the core bias current, $I_B(f)$, described for the toroidal and square core transformers. The device 620 is formed by cutting a device similar to the device 600 in FIGS. 18A and 18B into six electrically isolated, but magnetically interconnected, wedge shaped sections 621, 622, 623, 624, 625 and 626. Each wedge section 621-626 has the same velocity of wave propagation, $v_p$, as the device 600, but each wedge section 621-626 has six times the characteristic impedance, Zo, of the device 600 and presents to the input voltage 650 an impedance thirty six times the characteristic impedance of device 600. The device 620 is a toroidal transmission line, whose distributed capacitance is homogeneously implemented with the pancake dielectric core 654 sandwiched between six wedge shaped, coplanar, top conductors 628, 630, 632, 634, 636 and 638 that physically align with six wedge shaped, coplanar, bottom conductors 627, 629, 631, 633, 635 and 637 on the opposite of the dielectric core 654. The maximum magnetic flux density distribution, $B_{Mx}(r)$, is optimum when operated at optimum frequency, $f_o$. Displacement currents, $I_{Dn}(f)$, 656, 657, 658 and 659 generate magnetic flux vector points 660, 661, 662 and 663 and flux vector tails 664, 665, 666, and 667 which set up discrete magnetic force fields, $AT_{Dn}(f)$, along the radial length of the device that by their 180° phase shift with respect to the magnetizing current, $I_M(f)$, 655 aids the redistribution of magnetic flux density throughout the core 654. The flux density distribution is shown pictorially in FIG. 19A by flux vector arrows, 651, 652 and 653.

Redirected Magnetic Flux Density Devices for Spiral Windings

Solid block core ferrite is formed in low profile modified "pot" cores, a.k.a. as "planar" cores which have a magnetic winding. An example of a low profile modified pot core is a spiral winding 940 shown in FIGS. 7A-7B that is enclosed with SBC "pot" core sections such as a top section 948 and a bottom section 947. The top and bottom sections 948 and 947 form an inductor 941 shown in FIG. 6.

For very high frequency circuits, air core magnetics may be used. One common air core device is the spiral wound inductor 940 shown in FIGS. 7A and 7B. The spiral wound air core 940 has resistive limitations similar to the spiral wound inductor core 941 shown in FIG. 6. The spiral winding 940 has five turns of a spirally wound conductor width each turn spaced between a minimum inner radius 945 and a maximum outer radius 946. A radial spacing 942 is the summation of the minimum inner radius 945 and the spiral conductor width. The spiral winding is long and narrow.

Spiral wound magnetics are used in planar "pot core" transformers and inductors such as the inductor core 941 shown in FIG. 6 and in the air core, AiC, high frequency inductor and transformer winding circuits 940 shown in FIGS. 7A and 7B. The length and narrowness of the winding limits the temperature rise at the maximum current, $I_{Mx}(f)$, that can be safely handled by the design.

The problem of performance limiting parasitic circuits may be addressed by transmission line technology. Stable parasitic components may often be exploited by creative circuit design. The intrinsic nature of transmission line technology contains and regulates its electric and magnetic fields so a stable high performance component may be obtained. Further, replacing the long narrow spiral winding with a shorter, broader, radial winding used in radial planar transmission lines improves the circuit quality, maximizes the device's inductance and helps dissipate the heat formed in the winding.

The spiral winding limitations can be overcome with a radially wound toroidal magnetic core transmission line or a radial wound air core transmission line. The radial winding forms a radially directed transmission line where the radial conductors are the transmission line's parallel conductors. The radial conductors sandwich either the TWC material 535 used in the device 530 shown in FIGS. 11A and 11B or the magnetic foil material 573 used in the device 570 in FIGS. 12A and 12B or a solid block core material as required. The transmission line is completed by capacitance appropriately distributed heterogeneously along the length, $l_r$, of the transmission line as shown by the capacitance distribution in the devices 450, 500, 530 and 570. Alternatively, the radial conductors may sandwich toroidal shaped dielectric material, distributed homogeneously, such as the dielectric core 603 used in the device 600 in FIGS. 18A and 18B or the dielectric material 654 shown sectioned in the device 620 in FIGS. 19A and 19B.

The devices 450, 500, 530, 570, 600 and 620 compared to a spiral winding such as that in the device 941 in FIG. 6 and the device 940 in FIGS. 7A and 7B is that they occupy the same footprint and use transmission line construction to contain and maximize the magnetic flux which presents the highest inductance with negligible parasitic circuits.

Capacitance Enhanced Electromechanical Core Construction—Rail Gun

Figure 8:
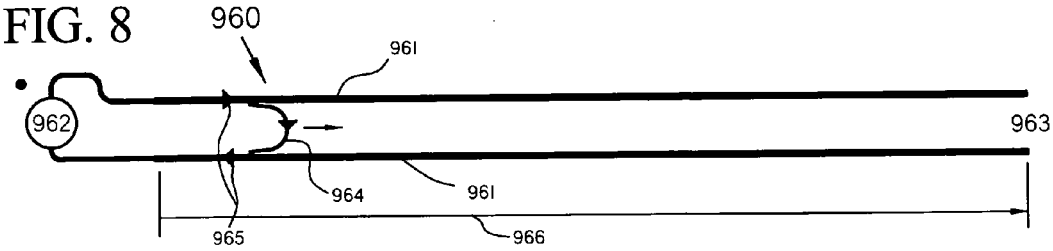
FIG. 8 is a side view of a rail gun.

A rail gun 960 shown in FIG. 8 is an example of using an air core to launch electro-magnetically accelerated projectiles with fast changing, extremely high magnetic flux density. Large transient currents 965 flow through the rail conductors 961 and a highly conductive projectile 964 to create a Lorentz force to accelerate the highly conductive projectile 964 down the rails 961 and out a muzzle 963.

FIG. 26 shows a capacitance enhanced rail gun 967 which is an example of a linear electro-mechanical device whose actuation force is increased by the addition of a series of distributed capacitances 968, 969, 970. The rail gun 967 is similar to the conventional rail gun 960 in FIG. 8. A projectile 964 which is a conductive slider, is accelerated by Lorentz forces over the length of a barrel 966. The acceleration of the slider 964 on a set of conductive rails 961 down the barrel 966 is analogous to the movement of a solenoid's plunger over a plunger's stroke length. Distributed capacitance along the length of the barrel 966 while the slider 964 can increase the acceleration forces applied to either the slider 964 during its transition time, $T_D$, thereby quickening the device's actuation time for the applied voltage 962.

Distributed discrete capacitances 968, 969, 970 are located along the length of the barrel 966. The sliding conductive projectile 964 is launched on the conductive rails 961 by the application of a high power voltage pulse 962 to the breech end of the gun 967. The projectile 964 is loaded at the breech and after the application of the applied voltage pulse 962 acts as an accelerated short circuit termination of a transmission line, traversing the transmission line length represented by the rails 961 and is then launched from the muzzle end 963 of the transmission line. Without the capacitance distribution, the electromagnetic propulsion force is simply that provided by the variable length single turn inductor whose length is determined by the position of the slider 964 along the rails 961 subjected to the voltage pulse. The distributed discrete capacitances 968, 969, 970 conduct displacement currents 971 that aid the rail currents 965 to increase the electromagnetic forces (Lorentz Forces) applied to the conductive slider 964.

The projectile 964 accelerates while traveling along length of the barrel 966 when subjected to a power pulse. This is similar to an electromagnetic wave traveling in a transmission line consisting of uniform distributed inductance and capacitance as a function of position along the length of the gun barrel 966. The distributed inductance and capacitance form a characteristic impedance, Zo, that allows a higher level of current, or more electrical power, to be applied to the device, in a quicker time. Thus the electro-mechanical forces in the "rail gun" build faster with distributed capacitance.

The rail gun 967 is similar in operation to most electromechanical devices where a plunger is operated by the application of electro-magnetic power to a coil surrounding the plunger or capsule containing the plunger. Power builds up faster in the electromechanical coil when capacitance is appropriately distributed throughout the coil.

Consequently, magnetic flux density redistributions in the varied conventional inductor and transformer magnetic core constructions are used as examples to illustrate the novel magnetic core construction modifications that may be employed to optimally redistribute magnetic flux density. These inductor and transformer magnetic core construction modifications can be applied to any type of magnetic core in any Electro-magnetic or permanent magnetic device of any size. Further, the core construction modifications can be applied to devices operating from single phase, three-phase, or any poly-phase power supply.

The methods and devices described above for transformers, inductors, or magnetic cores for transformers and inductors may be generally applied to other electro-magnetic and permanent magnetic devices such as motors, generators, relays, and delay lines.

It will be apparent to those skilled in the art that various modifications and variations can be made to the various magnetic flux density redistribution methods and systems, described herein, without departing from the spirit or scope of the novelty. Thus, the various magnetic flux density redistributions, described herein, are not limited by the foregoing descriptions but is intended to cover all modifications and variations that come within the scope of the spirit of the magnetic flux density redistribution schemes and the claims that follow.

What is claimed is:

1. An electro-magnetic device comprising:

a magnetic permeable core of magnetic material having a volume and magnetic flux induced into the magnetic permeable core; and a magnetic flux density distributor within the core to redistribute magnetic flux throughout the core volume so that all sections of the magnetic core can have uniform distribution of magnetic flux density, B(r).

2. The electro-magnetic device of claim 1 wherein the magnetic flux density distributor includes a bias current generator.

3. The electro-magnetic device of claim 2 wherein the bias current is supplied by a voltage tap coupled to a magnetization winding coupled around the magnetic permeable core.

4. The electro-magnetic device of claim 2 further comprising:

a primary voltage source coupled to a magnetization winding in the magnetic permeable core; and a secondary voltage source supplying the bias current.

5. The electro-magnetic device of claim 1 wherein the magnetic flux density distributor generates a displacement current in the core volume.

6. The electro-magnetic device of claim 1 further comprising a magnetizing winding carrying a magnetizing current to generate a magnetic field in the magnetic permeable core.

7. The electro-magnetic device of claim 6 wherein the magnetizing current flows in a magnetizing winding around the magnetic permeable core.

8. The electro-magnetic device of claim 7 wherein the device is a toroid transformer and the magnetic permeable core includes a winding window defined by an inner diameter radius and an outer diameter radius, the primary winding wound around the inner diameter radius and the outer diameter radius of the core;

wherein a passage is located between the inner diameter radius and the outer diameter radius; and wherein the magnetic flux distributor includes a secondary winding wound between the inner diameter radius and the outer diameter radius of the core to produce a bias current circuit within the core.

9. The electro-magnetic device of claim 8 further comprising a second passage located between the inner diameter radius and the outer diameter radius and in parallel orientation with the first passage, wherein the secondary winding is wound through the second passage.

10. The electro-magnetic device of claim 1 wherein the magnetic permeable core further includes an inner core and a magnetic foil which is tape wound around the inner core.

11. The electro-magnetic device of claim 1 wherein the magnetic permeable core is composed of a laminated magnetic material.

12. The electro-magnetic device of claim 1 wherein the magnetic permeable core is a solid block molded magnetic material.

13. The electro-magnetic device of claim 1 wherein the magnetic flux density distributor is mechanically interlaced with the permeable core.

14. The electro-magnetic device of claim 2 wherein the bias current generator includes a conductive strip located in a passage in the magnetic permeable core and electrical inputs coupled to the ends of the conductive strip.

15. The electro-magnetic device of claim 1 wherein the magnetic permeable core is deposited on a substrate.

16. The electro-magnetic device of claim 1 wherein the device is a transformer and the magnetic permeable core includes:

an E-shaped section having a center leg and two outer legs;

an I-shaped section located in proximity to the E-shaped section to form an air gap between the I-shaped section and the center and outer legs;

the electro-magnetic device further comprising:

a primary winding wound around the center leg;

a primary voltage source coupled to the primary winding which produces a load current;

a secondary winding wound around the center leg; and a first slit creating an air gap, the slit extending on one side of the center leg, one of the outer legs and on the portion of the I-shaped portion between the center leg and the one of the outer legs; and a second slit creating an air gap, the slit extending on the opposite side of the center leg, the other outer leg and on the portion of the I-shaped portion between the center leg and the other outer leg.

17. The electro-magnetic device of claim 16 wherein notches are formed in the first and second slit and wherein a bias current circuit is created through the notches.

18. The electro-magnetic device of claim 1 wherein the magnetic permeable core includes a spiral wound magnetic material tape, the device further comprising:

a series of conductors between the magnetic material tape, the conductors having a top end and a bottom end;

a series of capacitors coupled to top end of the conductors;

a top conductor having a first and second end coupled to the series of capacitors;

a bottom conductor having a first and second end coupled to the bottom end of the series of conductors;

a first transmission line terminal formed by an end of the top conductor; and a second transmission line terminal formed by an end of the bottom conductor.

19. The electro-magnetic device of claim 1 wherein the device is one of an inductor, a transformer, a generator, a rail gun, a solenoid, a relay, a motor, a delay line or a transmission line.

20. A method of re-distributing magnetic flux density in a magnetic permeable core having a volume comprising:

providing a primary magnetic field; and providing a secondary magnetic field to re-distribute magnetic flux over the volume of the core via a magnetic flux density distributor within the core.

21. The method of claim 20 further comprising:

coupling a voltage source to a primary winding in the core to generate the primary magnetic field; and coupling a secondary voltage source at the same frequency as the voltage source core to provide the secondary magnetic field.

22. The method of claim 20 further comprising sectioning the core into magnetically isolated core sections.

23. The method of claim 20 further comprising smoothing the cores on the course of a magnetic path defined by the core.

24. The method of claim 20 wherein providing the secondary magnetic field includes generating a bias current in the core.

25. The method of claim 20 wherein providing the primary magnetic field includes a magnetization winding in the core, and wherein generating the bias current includes coupling a voltage tap to the magnetization winding to generate the bias current.

26. The method of claim 20 wherein providing the secondary magnetic field includes generating a displacement current in the core.

27. The method of claim 20 wherein the core is a transformer core, the core further including a winding window defined by an inner diameter radius and an outer diameter radius, a primary winding wound around the inner diameter radius and the outer diameter radius of the core; and wherein providing the secondary magnetic field includes winding a secondary winding between the inner diameter radius and the outer diameter radius of the core to produce a bias current circuit within the core, the method further comprising:

providing a passage between the inner diameter radius and the outer diameter radius.

28. The method of claim 27 further comprising providing a second passage between the inner diameter radius and the outer diameter radius and in parallel orientation with the first passage, wherein the secondary winding is wound through the second passage.

29. The method of claim 20 wherein the core further includes an inner core and a magnetic foil which is tape wound around the inner core.

30. The method of claim 20 wherein the core is composed of a laminated magnetic material.

31. The method of claim 20 wherein the core is a solid block molded magnetic material.

32. The method of claim 20 wherein the core is composed of a mechanically interlaced magnetic material.

33. The method of claim 20 wherein the magnetic permeable core is divided into two magnetically separate sections.

34. The method of claim 20 wherein the core includes:

an E-shaped section having a center leg and two outer legs;

an I-shaped section located in proximity to the E-shaped section to form an air gap between the I-shaped section and the center and outer legs;

wherein providing a primary magnetic field includes winding a primary winding around the center leg and providing a secondary magnetic field includes winding a secondary winding around the center leg, the method further comprising:

coupling a primary voltage source to the primary winding to produce a load current;

providing a first slit creating an air gap extending on one side of the center leg, one of the outer legs and on the portion of the I-shaped portion between the center leg and the one of the outer legs; and providing a second slit creating an air gap extending on the opposite side of the center leg, the other outer leg and on the portion of the I-shaped portion between the center leg and the other outer leg.

35. The method of claim 34 further comprising forming notches in the first and second slits and wherein a bias current circuit is created through the notches.

36. The electro-magnetic device of claim 7 wherein the magnetic flux distributor includes a secondary winding through a first passage through the core to produce a bias current circuit within the core volume.

37. The electro-magnetic device of claim 36 further comprising a second passage located between the winding window and the outside of the core, wherein the secondary winding is wound through the second passage.

38. The method of claim 20 wherein the core includes a primary winding; and wherein providing the secondary magnetic field includes winding a secondary winding through the core to produce a bias current circuit within the core.

39. The method of claim 38, further comprising providing a second passage between the winding window and the outside of the core, wherein the secondary winding is wound through the second passage.

40. The electro-magnetic device of claim 36 wherein the passage divides the magnetic permeable core into two magnetically separate sections.

41. The electro-magnetic device of claim 36 wherein the passage forms a rounded corner.

42. The electro-magnetic device of claim 40 wherein the magnetically separate sections have gaps that are independently adjusted.

43. The electro-magnetic device of claim 36, wherein the two magnetically separate sections are composed of different materials.

* * * * *